US009630418B2

(12) United States Patent
Yamagishi et al.

(10) Patent No.: US 9,630,418 B2
(45) Date of Patent: Apr. 25, 2017

(54) LIQUID HOLDING CONTAINER

(71) Applicant: SEIKO EPSON CORPORATION, Tokyo (JP)

(72) Inventors: Ken Yamagishi, Nagano (JP); Toshinobu Yamazaki, Nagano (JP); Takeshi Iwamuro, Nagano (JP); Shigenori Nakagawa, Tatsuno-machi (JP); Ryoichi Tanaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 265 days.

(21) Appl. No.: 14/187,758

(22) Filed: Feb. 24, 2014

(65) Prior Publication Data

US 2014/0238926 A1 Aug. 28, 2014

(30) Foreign Application Priority Data

Feb. 28, 2013 (JP) ..... 2013-039321

(51) Int. Cl.
*B41J 2/175* (2006.01)

(52) U.S. Cl.
CPC ..... *B41J 2/17563* (2013.01); *B41J 2/17513* (2013.01)

(58) Field of Classification Search
None
See application file for complete search history.

(56) References Cited

U.S. PATENT DOCUMENTS

| | | | | |
|---|---|---|---|---|
| 5,922,199 | A * | 7/1999 | Hodgkins | B01D 29/15 210/130 |
| 8,608,301 | B2 * | 12/2013 | Oguchi | B41J 2/19 347/92 |
| 9,186,883 | B2 * | 11/2015 | Ono | B41J 2/175 |
| 2002/0109760 | A1 | 8/2002 | Miyazawa et al. | |
| 2005/0157104 | A1 | 7/2005 | Hirota et al. | |
| 2007/0171263 | A1 * | 7/2007 | Inoue | B41J 2/17513 347/74 |
| 2008/0007604 | A1 * | 1/2008 | Kang | B41J 2/17509 347/89 |
| 2012/0151738 | A1 | 6/2012 | Price et al. | |

FOREIGN PATENT DOCUMENTS

| | | | |
|---|---|---|---|
| CN | 1626347 | A | 6/2005 |
| JP | 60-106729 | U | 7/1985 |
| JP | 08-276602 | A | 10/1996 |
| JP | 2007-112151 | A | 5/2007 |
| JP | 2012-152985 | A | 8/2012 |

* cited by examiner

*Primary Examiner* — Benjamin Kurtz
(74) *Attorney, Agent, or Firm* — Global IP Counselors, LLP

(57) ABSTRACT

A liquid holding container includes a liquid accommodating chamber, a flow path, and a filter. The liquid accommodating chamber is configured and arranged to hold liquid. The flow path is communicated with the liquid accommodating chamber via a first through hole and a second through hole. The filter is disposed in the flow path. The first through hole and the second through hole are each communicated with the flow path.

11 Claims, 33 Drawing Sheets

X
Y
Z
34
34a
34b
74
76
82
85
86
87
88
89
90
91
92

Fig. 20A
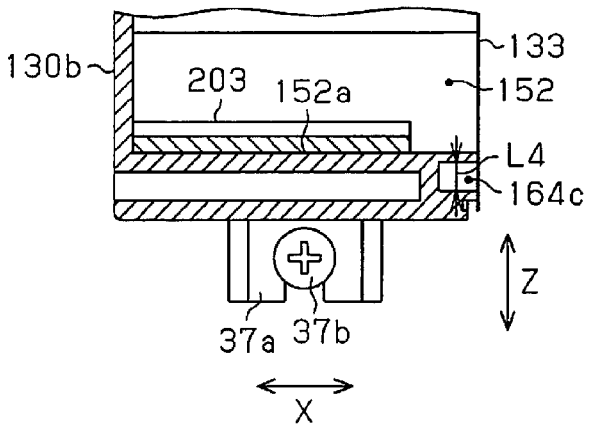
Fig. 20B
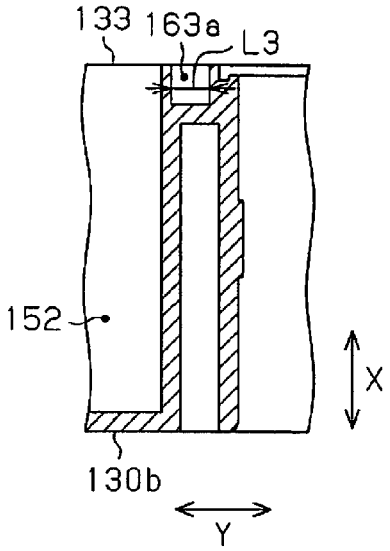
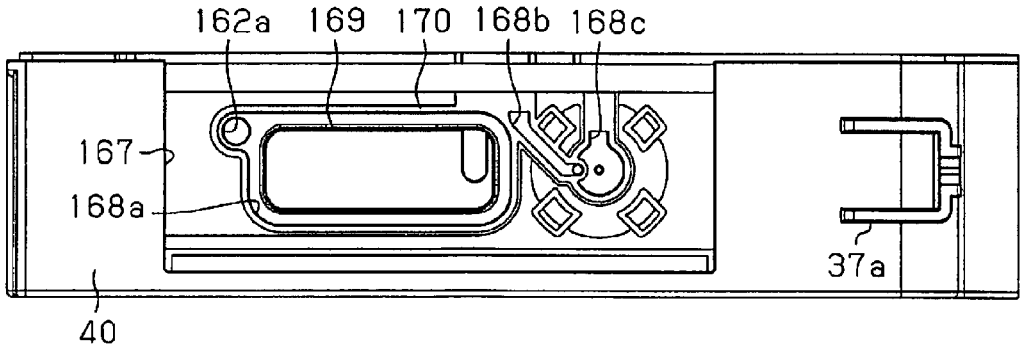
Fig. 21

LIQUID HOLDING CONTAINER

CROSS-REFERENCE TO RELATED APPLICATIONS

This application claims priority to Japanese Patent Application No. 2013-039321 filed on Feb. 28, 2013. The entire disclosure of Japanese Patent Application No. 2013-039321 is hereby incorporated herein by reference.

BACKGROUND

Technical Field

The present invention relates to a liquid holding container which holds a liquid which is supplied to a liquid consuming apparatus.

Related Art

In the prior art, ink jet printers, which perform printing (recording) by ejecting ink (a liquid) from a liquid ejecting head with regard to a target such as paper, are known as a kind of liquid consuming apparatus. Then, an ink accommodating container which supplies ink to such a printer is proposed (for example, Japanese Unexamined Patent Application Publication No. 2007-112151).

A filter for trapping foreign matter is provided in a flow path in the liquid holding container.

SUMMARY

However, such filters trap air (bubbles) inside the ink accommodating container. When air is trapped in the filter, there is a risk that pressure loss due to the filter will increase and the amount of ink supplied to the printer will be insufficient.

Here, this problem is not limited to the liquid holding containers which hold ink which is supplied to a printer and is generally shared with the liquid holding containers which hold liquid which is supplied to a liquid consuming apparatus.

The present invention was carried out in consideration of these circumstances and has an object of providing a liquid holding container which is able to reduce the risk that air will be trapped in the filter which is provided in the flow path.

A liquid holding container according to one aspect includes a liquid accommodating chamber, a flow path, and a filter. The liquid accommodating chamber is configured and arranged to hold liquid. The flow path is communicated with the liquid accommodating chamber via a first through hole and a second through hole. The filter is disposed in the flow path. The first through hole and the second through hole are each communicated with the flow path.

According to this configuration, since the two through holes are formed in the flow path, in a case where a liquid flows in from one through hole, it is possible to discharge air from the other through hole. Due to this, it is possible to reduce the risk that air will be trapped in the filter which is provided in the flow path.

In the liquid holding container described above, it is preferable that the second through hole is disposed in a tubular section provided along a direction intersecting with a horizontal direction.

According to this configuration, it is possible to efficiently discharge air since all of the buoyancy of air (bubbles) in the hollow portion of the tubular section is applied in an air discharge direction. Due to this, it is possible to reduce the risk that the air will be trapped in the filter.

In the liquid holding container described above, it is preferable that the first through hole and the second through hole are disposed closer to the liquid accommodating chamber than the filter with respect to a direction in which the liquid flows, with the filter being disposed between the first through hole and the second through hole with respect to a direction intersecting with a direction of gravity.

According to this configuration, since the two through holes are formed to be separated from each other to interpose the filter, it is possible to efficiently discharge air from the second through hole due to, for example, the flow of liquid which flows into the first through hole. Due to this, it is possible to reduce the risk that the air will be trapped in the filter.

In the liquid holding container described above, it is preferable that the first through hole and the second through hole are formed on a bottom surface of the liquid accommodating chamber, and the liquid accommodating chamber includes a protrusion section protruding from the bottom surface between the first through hole and the second through hole.

According to this configuration, it is possible to intercept the inflow of liquid into one of the through holes out of the two through holes using the protrusion section. That is, for example, it is possible to create a state where liquid does not flow in from the second through hole into the flow path regardless of liquid flowing in from the first through hole into the flow path. It is possible to efficiently discharge air by using a pressure difference between the first through hole and the second through hole which is generated due to this.

In the liquid holding container described above, it is preferable that an opening of each the first through hole and the second through hole on a side of the flow path is positioned at the same position as the filter with respect to a direction of gravity or positioned toward a direction against gravity than the filter.

According to this configuration, since the heights of the openings of the first through hole and the second through hole on the flow path side are the same or larger than the height where the filter is provided, it is easy for air to move through the through holes which are at positions which are higher than the filter. Due to this, it is possible to suppress the air from remaining below the filter.

In the liquid holding container described above, it is preferable that an inner diameter of the second through hole is 6 mm or more in a case where a density of the liquid is 1.05 g/cm$^3$ and a surface tension of the liquid is 27.6 mN/m.

According to this configuration, since the density of the liquid is 1.05 g/cm$^3$, the surface tension is 27.6 mN/m, and the inner diameter of the second through hole is 6 mm or more, it is possible to discharge air using buoyancy even in a case where the second through hole is blocked by liquid or the like.

The liquid holding container described above preferably further includes an inlet port through which the liquid is arranged to enter into the liquid accommodating chamber. The first through hole is preferably formed at a position closer to the inlet port than the second through hole in a direction in which the liquid flows.

According to this configuration, the liquid which is introduced flows into the inside of the flow path by first passing through the first through hole which is formed at a position which is close to the inlet port. At this time, liquid does not flow in from the second through hole which is positioned at a location which is more separated from the inlet port than the first through hole and the air inside the flow path is discharged via the second through hole. Due to this, it is possible to reduce the risk that the air will be trapped in the filter.

BRIEF DESCRIPTION OF THE DRAWINGS

Referring now to the attached drawings which form a part of this original disclosure:

FIG. 9A is a perspective diagram illustrating a state where an inlet port is covered with a covering body, and FIG. 9B is a perspective diagram illustrating a state where the covering body is detached from the inlet port.

FIG. 12A is a diagram of a cross section viewed along an arrow line B-B in FIG. 10 and FIG. 12B is a diagram of a cross section viewed along an arrow line C-C in FIG. 10.

FIG. 20A is a diagram of a cross section viewed along an arrow line E-E in FIG. 19 and FIG. 20B is a diagram of a cross section viewed along an arrow line F-F in FIG. 19.

FIG. 21 is a bottom surface diagram of the accommodating body case.

DETAILED DESCRIPTION OF EXEMPLARY EMBODIMENTS

First Embodiment

Below, a first embodiment of a liquid holding container and an ink jet printer (referred to below as a "printer") which is an example of a liquid consuming apparatus which consumes a liquid which is supplied from the liquid holding container will be described with reference to the diagrams.

Figure 1:
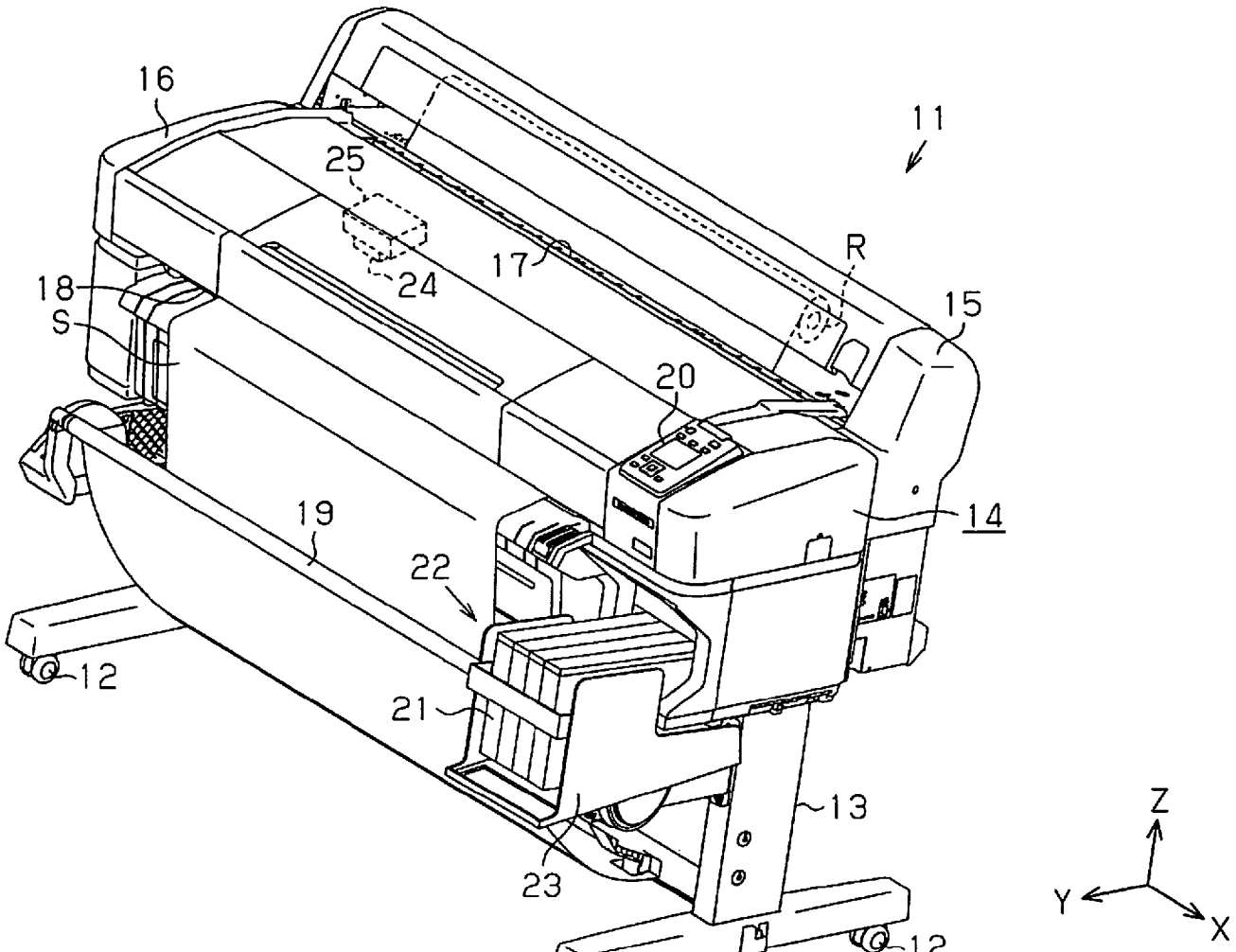
FIG. 1 is a perspective diagram of a printer where a liquid holding container of the first embodiment is fixed.

As shown in FIG. 1, a printer 11 of the present embodiment is provided with leg sections 13 where wheels 12 are attached at lower ends, and an apparatus body 14 with a substantially rectangular shape which is assembled on the leg sections 13. Here, the direction along the direction of gravity is an up and down direction Z and the longitudinal direction of the apparatus body 14 which intersects with (is orthogonal to in the present embodiment) the up and down direction Z is a left and right direction X in the present embodiment. In addition, the direction which intersects with (is orthogonal to in the present embodiment) both of the up and down direction Z and the left and right direction X is a front and back direction Y.

As shown in FIG. 1, a feeding section 15 which protrudes upward is provided at a rear section of the apparatus body 14. A roll paper R where paper S, which is a long medium, is cylindrically wound is loaded inside the feeding section 15. In a housing section 16 which configures the exterior of the apparatus body 14, an insertion opening 17 for introducing the paper S, which is fed from the feeding section 15 into the housing section 16, is formed at a position on the front side of the feeding section 15.

On the other hand, a discharge opening 18 for discharging the paper S to the outside of the housing section 16 is formed on the front surface side of the apparatus body 14. Here, a medium transporting mechanism, which is not shown in the diagram and which transports the paper S which is fed from the feeding section 15 from the insertion opening 17 side toward the discharge opening 18 side, is accommodated inside the housing section 16. Then, a medium receiving unit 19 which receives the paper S which is discharged from the discharge opening 18 is provided in the front surface side of the apparatus body 14 at a position which is lower than the discharge opening 18.

In addition, an operation panel 20 for performing setting operations and input operations is provided in an upper section of the apparatus body 14 at one end side (the right end side in FIG. 1) which is the outer side of a transport flow path of the paper S in the left and right direction X. Furthermore, a liquid holding container 21 which is able to hold ink which is an example of a liquid is fixed in a lower section of the apparatus body 14 at one end side (the right end side in FIG. 1) which is the outer side of the transport flow path of the paper S in the left and right direction X.

A plurality (four in the present embodiment) of the liquid holding containers 21 are provided to correspond to the types and colors of the inks. Then, a liquid accommodating unit 22 is configured by arranging the plurality of liquid holding containers 21 to line up in the left and right direction X. Here, the liquid accommodating unit 22 has a portion which is exposed to the front side (the outer side) of the apparatus body 14 in a state where each of the liquid holding containers 21 is fixed to the apparatus body 14. Then, both sides in the left and right direction X and the lower side in the up and down direction Z of an exposed portion in the liquid accommodating unit 22 are covered by a frame member 23 with a substantially U-shaped cross section which is fixed on the apparatus body 14 side.

In addition, a carriage 25 where a liquid ejecting head 24 is mounted is accommodated inside the housing section 16 in a state where it is possible for the carriage 25 to move back and forth in the left and right direction X which is the main scanning direction. Here, a liquid supply mechanism which is not shown in the diagram for supplying ink, which is accommodated in the liquid holding container 21 toward the liquid ejecting head 24, is accommodated inside the housing section 16. Then, recording (printing) is performed by ejecting ink droplets from the liquid ejecting head 24 with regard to the paper S which is transported by the medium transport mechanism, and the ink inside the liquid holding container 21 is consumed due to ejection of the ink droplets.

Figure 2:
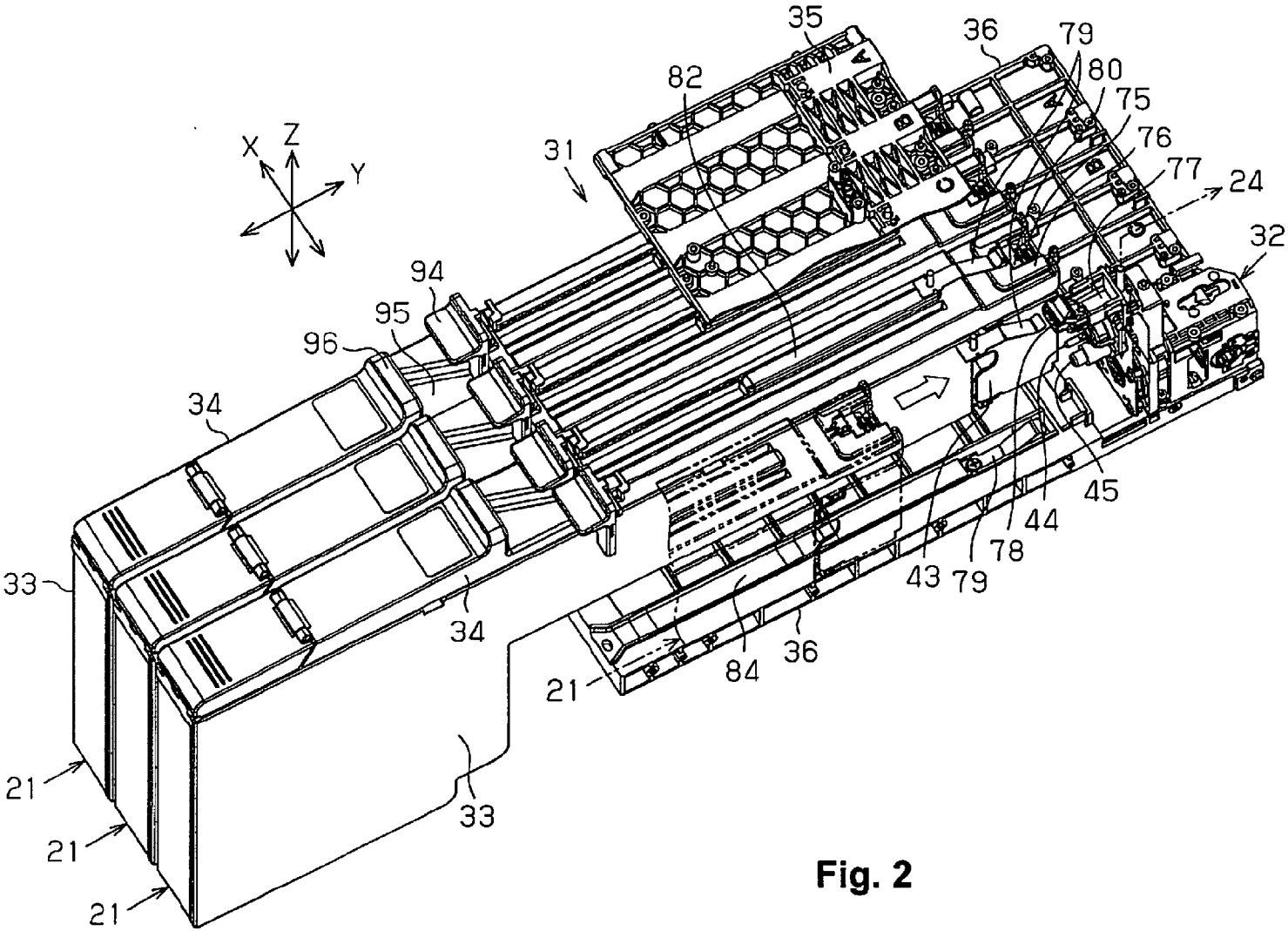
FIG. 2 is a perspective diagram illustrating a state where the liquid holding container is mounted onto a mounting section.

Next, a mounting section 31 where the liquid holding container 21 is mounted in a fixed state with regard to the apparatus body 14 and the liquid holding container 21 which is fixed to the apparatus body 14 via the mounting section 31 will be described. Here, in order to avoid complicating the diagram, FIG. 2 illustrates only one supply section 32 which is a portion of the liquid supply mechanism which supplies ink from each of the liquid holding containers 21 to the liquid ejecting head 24 side, and the liquid holding container 21 which corresponds to the one supply section 32 which is shown in the diagram is illustrated in a state before being mounted onto the mounting section 31 as shown by a two-dot chain line and a white arrow. In addition, FIG. 3 illustrates a state where a liquid accommodating body 33 which configures the liquid holding container 21 and a slider 34 which an example of a sub-holding member are separated.

As shown in FIG. 2, the printer 11 is provided with the mounting section 31 which has an upper frame 35 and a lower frame 36 which are disposed to be spaced at predetermined intervals in the vertical direction (the up and down direction Z). In addition, in the mounting section 31, the supply section 32 which is a portion of the liquid supply mechanism is attached to correspond to each of the liquid holding containers 21. Here, FIG. 2 illustrates the upper frame 35 in a state where a portion is cut away and removed in the left and right direction X.

The liquid holding container 21 is fixed to be not able to move with regard to the printer 11 in a state where one end side (the right end side in FIG. 2) in the longitudinal direction is positioned inside the mounting section 31. Then, ink which is held in the liquid holding container 21 is supplied to the liquid ejecting head 24 side using the supply sections 32 which are attached to correspond to the one end side of each of the liquid holding containers 21 in the mounting section 31 in a state of being fixed to the printer 11. Accordingly, the state where the liquid holding containers 21 are fixed to be not able to move with regard to the printer 11 by being mounted onto the mounting section 31 of the printer 11 is a posture state of the liquid holding containers 21 during use in the present embodiment.

Figure 3:
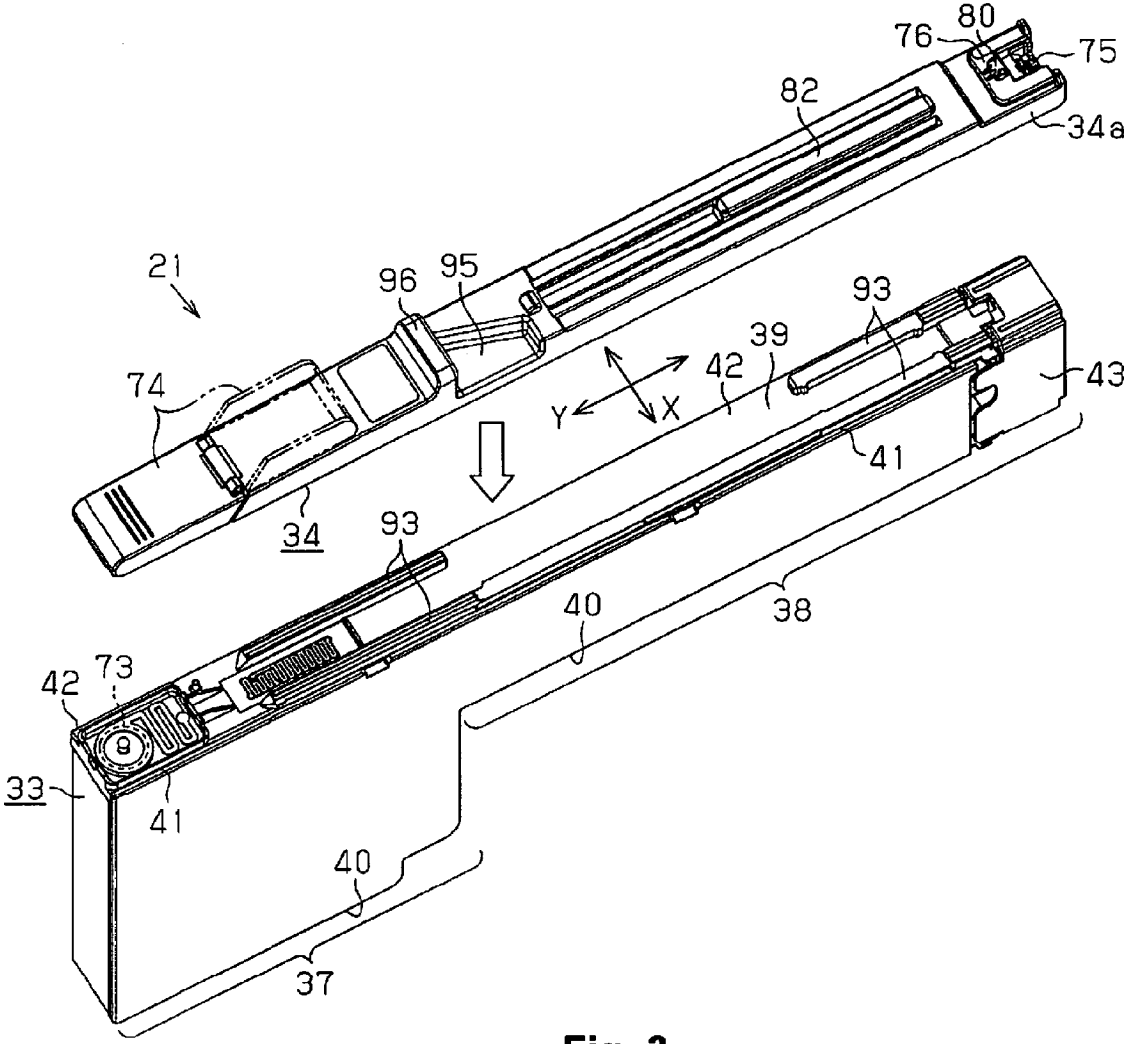
FIG. 3 is a perspective diagram illustrating the liquid holding container in a state of being separated from a slider.

Here, as shown in FIG. 2 and FIG. 3, the liquid holding container 21 of the present embodiment is provided with the liquid accommodating body 33 which holds ink, and the slider 34 which is disposed to overlap with the upper side of the liquid accommodating body 33 in the direction against gravity in the vertical direction.

The liquid accommodating body 33 has a rectangular shape which is a substantially L shape in a side surface view with a direction which is orthogonal to the longitudinal direction of the apparatus body 14 in the substantially horizontal direction as the longitudinal direction (the front and back direction Y) and a constant width in the lateral direction (the left and right direction X) which is orthogonal to the longitudinal direction in the substantially horizontal direction. That is, the liquid accommodating body 33 has a first accommodating body section 37 where the side surface shape of the liquid accommodating body 33 viewed from the lateral direction (the left and right direction X) of the liquid accommodating body 33 is substantially square, and a second accommodating body section 38 which has a long substantially rectangular shape in the front and back direction Y more to the rear side than the first accommodating body section 37. Then, flat surface sections 41 and 42 which extend continuously without stages in the longitudinal direction (the front and back direction Y) are formed on an upper surface 39 of the liquid accommodating body 33 at both end sections in the lateral direction, and it is possible for the slider 34 to slide along the flat surface sections 41 and 42. On the other hand, a lower surface 40 of the liquid accommodating body 33 has a shape which has a staged surface where the first accommodating body section 37 is lower than the second accommodating body section 38 in the longitudinal direction (the front and back direction Y) of the lower surface 40.

Then, in the present embodiment, the liquid holding container 21 is fixed to be not able to move with regard to the printer 11 by a fixed section 37*a* (refer to FIG. 13, FIG. 14, and FIG. 20) which is provided on the lower surface of the first accommodating body section 37 being screwed with regard to a fixing section (which is not shown in the diagram) which is provided on the apparatus body 14 side using a screw 37*b* (refer to FIG. 20). Then, in the liquid accommodating body 33 which is fixed by screwing, approximately all of the second accommodating body section 38 is a second part which is positioned inside the apparatus body 14 of the printer 11, and the first accommodating body section 37 is a first part which is exposed to the front of the apparatus body 14 by being positioned outside the apparatus body 14 of the printer 11.

Furthermore, a connecting section 43, which is formed by a separate member to a housing member (an accommodating body case 130 shown in FIG. 13) which configures the liquid accommodating body 33 and which is attached to be able to relatively move with regard to the second accommodating body section 38, is provided in the second accommodating body section 38 at the rear end side which is the opposite side to the first accommodating body section 37 side in the longitudinal direction of the second accommodating body section 38. An ink supply path, which guides ink which is held inside the liquid accommodating body 33 to an ink supply needle 44 which is provided in the supply section 32 which is attached to the mounting section 31 side, and a transmission mechanism, which transmits the state of the presence or absence of ink inside the liquid accommodating body 33 to an ink remaining amount detection rod 45 which is provided in the same supply section 32, are formed in the connecting section 43.

Here, the configuration of the connecting section 43 where the ink flow path and the transmission mechanism are formed will be described with reference to FIG. 4 and FIG. 5. Here, out of the constituent members of the supply section 32, constituent members which relate to the supply needle 44 and the remaining amount detection rod 45 are illustrated in FIG. 4 and FIG. 5 and others are omitted as appropriate.

Figure 4:
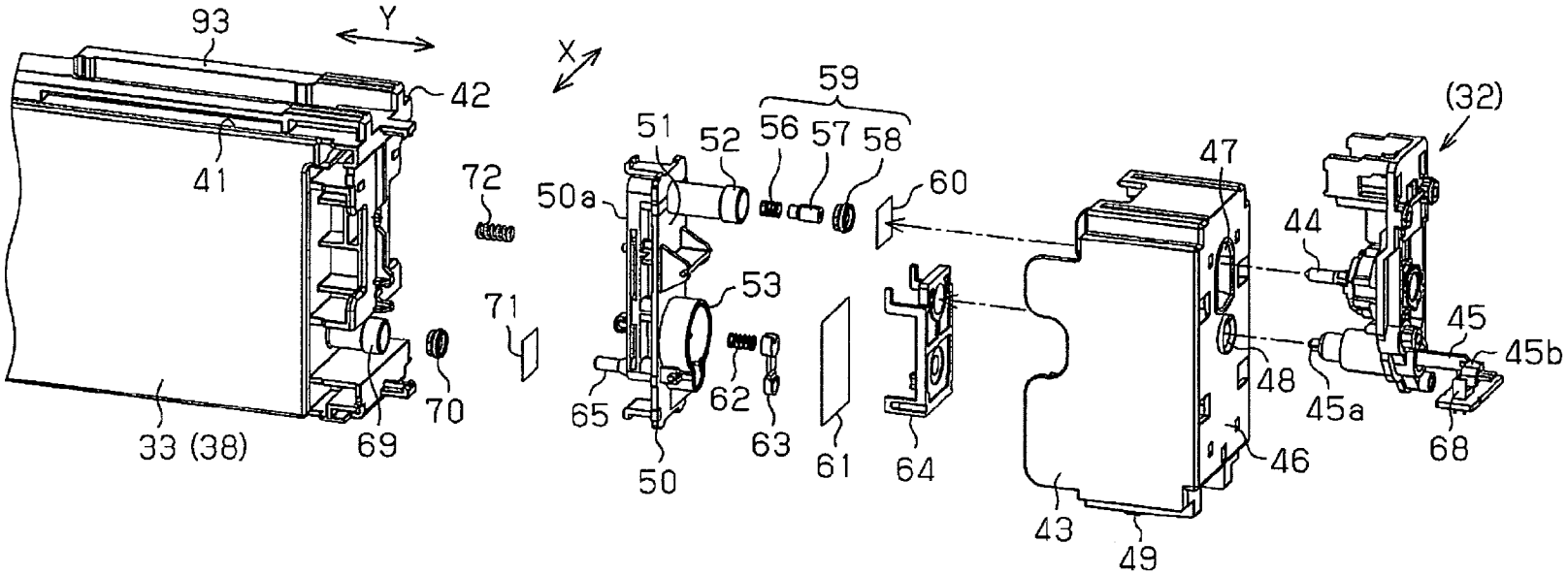
FIG. 4 is an exploded perspective diagram illustrating a configuration of a connecting section which is provided in the liquid holding container.
Figure 5:
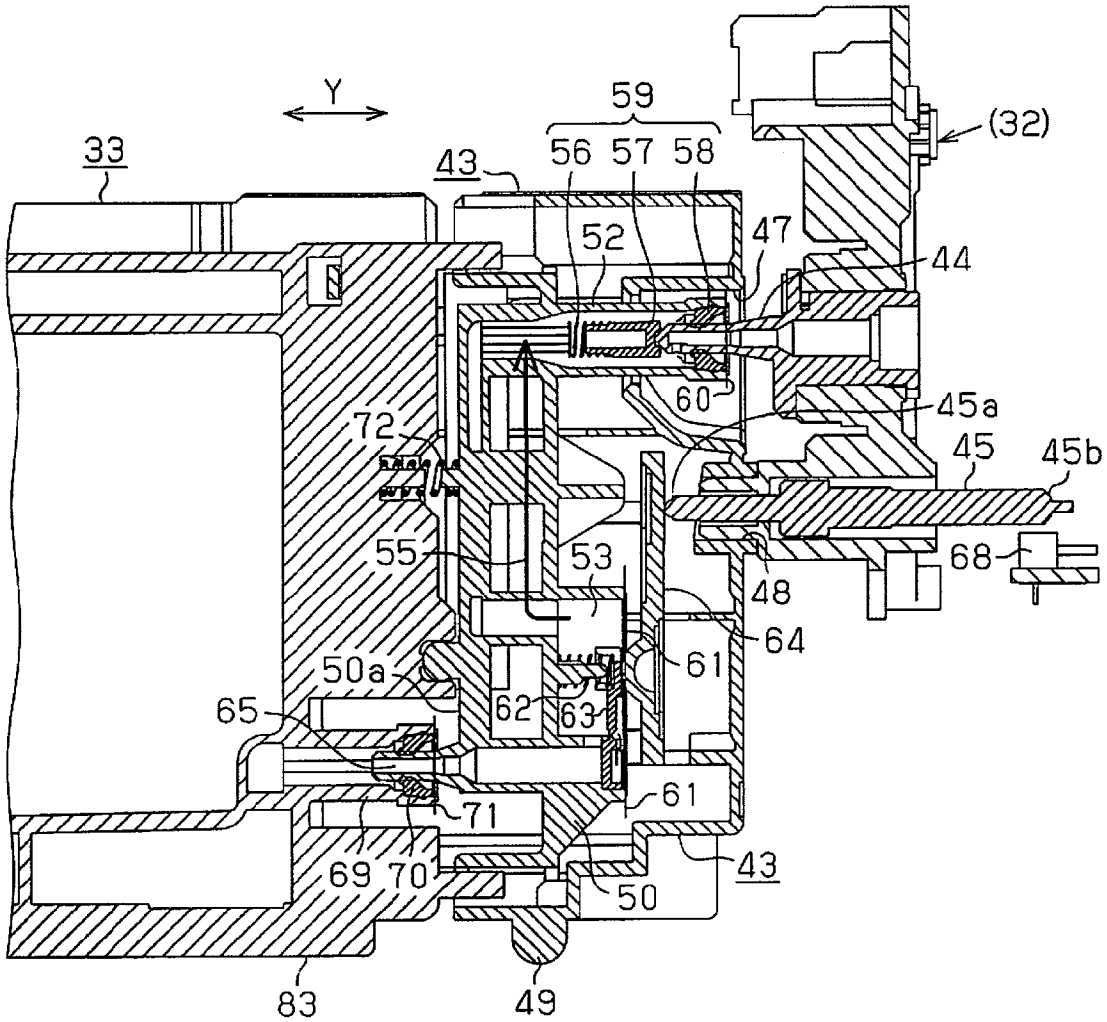
FIG. 5 is cross sectional diagram illustrating the configuration of the connecting section which is provided in the liquid holding container.

As shown in FIG. 4 and FIG. 5, the connecting section 43 which is provided in the second accommodating body section 38 has a housing which has a substantially box shape with a bottom where one side is opened, and the bottom wall section of the housing configures an end surface 46 of the supply section 32 side in the second accommodating body section 38 of the liquid accommodating body 33. Then, a needle insertion hole 47, where the supply needle 44 of the supply section 32 is inserted, is formed in the end surface 46 of the connecting section 43, and a rod insertion hole 48, where the remaining amount detection rod 45 is inserted, is formed at a position which is adjacent with regard to the needle insertion hole 47. In addition, a protrusion part 49 is formed so that the surface of the connecting section 43 at the lower surface side has a substantially cylindrical shape.

An attached member 50 with a substantially flat plate shape, which has a predetermined thickness in the direction where the supply needle 44 is inserted into the needle insertion hole 47, is provided inside the housing of the connecting section 43. An outflow port 52 with a substantially cylindrical shape where the supply needle 44 is inserted via the needle insertion hole 47 and a liquid chamber 53 with the same substantially cylindrical shape are formed in the attached member 50 on an end surface 51 of one side which is the supply section 32 side in the thickness direction of the attached member 50. Then, an outlet flow path 55 which links the liquid chamber 53 and the outflow port 52 is formed by passing through the attached member 50 as shown by a thick solid line arrow in FIG. 5.

In order for the supply needle 44 to be inserted into the outflow port 52 via the needle insertion hole 47, an opening and closing valve 59 which suppresses ink which is supplied from the liquid accommodating body 33 side from flowing out and which is formed of a spring 56, a valve member 57, and packaging 58 is installed. In addition, a seal 60 which covers an opening of the outflow port 52 is provided by welding such that ink does not flow out prior to the supply needle 44 being inserted.

In addition, a flexible thin film 61 is welded to the liquid chamber 53 so as to cover the opening of the liquid chamber 53. Therefore, the volume of the liquid chamber 53 changes due to the thin film 61 changing shape to match with pressure changes in the inner section. In addition, a spring 62 which presses the thin film 61 toward the outer side of the liquid chamber 53 is provided inside the liquid chamber 53. Here, a pressure plate 63 which transfers pressing force of the spring 62 to the thin film 61 is inserted between the spring 62 and the thin film 61.

In addition, a moving member 64 is attached to the outer surface of the liquid chamber 53 in the attached member 50. The moving member 64 is configured to freely rotate centered on a predetermined rotation fulcrum which extends in the horizontal direction (the left and right direction X) which is orthogonal to the longitudinal direction (the front and back direction Y) of the liquid accommodating body 33, and the moving member 64 comes into contact with regard to the thin film 61 which configures a portion of the inner surface of the liquid chamber 53 from the outside of the liquid chamber 53.

On the other hand, an inflow port 65 with a substantially cylindrical shape is formed in the attached member 50 on an end surface 50*a* of the other side in the thickness direction of the attached member 50 to protrude in the thickness direction of the attached member 50. Then, a lead out port (a lead out port section) 69 with a substantially cylindrical shape where the inflow port 65 is inserted is provided on the liquid accommodating body 33 (the second accommodating body section 38) side to correspond to the inflow port 65. The lead out port 69 is configured to link the inside of the liquid accommodating body 33 (the second accommodating body section 38) and the liquid chamber 53 by insertion of the inflow port 65 into the lead out port 69. Here, packaging 70, which suppresses leaking and flowing out of ink which is held in the liquid accommodating body 33, is installed in the lead out port 69, and a seal 71 which covers the opening of the lead out port 69 is provided by welding such that ink does not flow out from the liquid accommodating body 33 prior to the inflow port 65 being inserted in the liquid accommodating body 33 (the second accommodating body section 38).

In addition, the attached member 50 is pressed to the mounting section 31 side inside the connecting section 43 by a compression spring 72 which is inserted between the liquid accommodating body 33 (the second accommodating body section 38) and the attached member 50 such that, for example, insertion of the supply needle 44 into the outflow port 52 and contact of the remaining amount detection rod 45 with the moving member 64 are stabilized.

Here, the transmission mechanism will be described with reference to FIG. 5.

As shown in FIG. 5, the thin film 61 of the liquid chamber 53 in the connecting section 43, has a configuration so as to be pushed out by the spring 62 so as to increase the volume of the liquid chamber 53 via the pressure plate 63. As a result, ink inside the liquid accommodating body 33 flows into the liquid chamber 53 by passing through the outflow port 65 along with the increase in the volume of the liquid chamber 53. On the other hand, by suctioning ink from the outflow port 52 toward the supply needle 44 using the supply section 32, ink inside the liquid chamber 53 flows out from the liquid chamber 53 by passing through the outlet flow path 55. At this time, since the inner diameter of the outlet flow path 55 is larger than the inner diameter of the inflow port 65 in the present embodiment, the outflow amount of ink from the liquid chamber 53 does not keep pace with the inflow amount of ink to the liquid chamber 53 and the pressure inside the liquid chamber 53 becomes negative. As a result, the thin film 61 changes shape so as to be drawn to the inside of the liquid chamber 53 against the pressing force of the spring 62. Here, FIG. 5 illustrates a state where the thin film 61 is drawn to the inside of the liquid chamber 53.

The negative pressure which is generated in the liquid chamber 53 is gradually eliminated due to ink inside the liquid accommodating body 33 flowing into the liquid chamber 53 by passing through the inflow port 65. By doing this, the volume of the liquid chamber 53 is restored by the thin film 61 being pushed out again to the outside of the liquid chamber 53 due to the force of the spring 62. As a result, after a predetermined time passes since stopping of the supply of ink to the liquid ejecting head 24 in the supply section 32, there is a return to the original state prior to starting the supply of ink to the liquid ejecting head 24. In addition, when the ink is supplied again from the supply section 32 to the liquid ejecting head 24 side, the pressure inside the liquid chamber 53 becomes negative and the thin film 61 is in a state of being drawn to the inner side of the liquid chamber 53. On the other hand, when all of the ink inside the liquid accommodating body 33 is consumed, ink does not flow into the liquid chamber 53 even when the pressure inside the liquid chamber 53 is negative. That is, even after the predetermined time has passed since stopping of the supply of ink by the supply section 32, the state where the thin film 61 is drawn to the inner side of the liquid chamber 53 is maintained without eliminating the negative pressure inside the liquid chamber 53.

A spring (which is not shown in the diagram), which presses the remaining amount detection rod 45 so as to impact with the moving member 64, is attached to the remaining amount detection rod 45. In addition, an other end section 45*b* in the remaining amount detection rod 45 on the opposite side to one end section 45*a*, which comes into contact with the moving member 64, is a target part to be detected using a sensor 68 with a concave shape. The sensor 68 is a transmission photosensor and is provided such that a light receiving section and a light generating section which are not shown in the diagram oppose each other. The presence or absence of ink inside the liquid accommodating body 33 is detected using a detection signal which is output from the sensor 68.

That is, when there is no ink inside the liquid accommodating body 33, the thin film 61 is maintained in a state of changing shape in a direction where the volume of the liquid chamber 53 is reduced since ink does not flow from inside the liquid accommodating body 33 into the liquid chamber 53. Accordingly, the moving member 64 rotates centered on a rotation fulcrum by the moving member 64 being pushed by the one end section 45*a* of the remaining amount detection rod 45 which is pressed by the spring which is not shown in the diagram, and the other end section 45*b* of the remaining amount detection rod 45 is inserted between the light generating section and the light receiving section of the sensor 68 by the remaining amount detection rod 45 being moved to the liquid accommodating body 33 side. Therefore, the sensor 68 detects that there is no ink inside the liquid accommodating body 33 based on light being maintained in an interrupted state.

Next, returning to FIG. 2 and FIG. 3, the slider 34 will be described.

As shown in FIG. 3, an inlet port (an inlet port section) 73 where ink is introduced into the inside of the liquid accommodating body 33 is provided in the upper surface 39 of the liquid accommodating body 33 at a first part, which is positioned outside the printer 11, of the liquid accommodating body 33. In the present embodiment, the first accommodating body section 37 corresponds to the first part and an inlet port 73 is provided in the first accommodating body section 37. Then, there is a configuration where it is possible to cover the inlet port 73 with the slider 34 such that the inlet port 73 which is positioned outside the printer 11 is not exposed other than when ink is being introduced.

That is, the slider 34 is formed with an outer shape which has a substantially rectangular shape which has a longitudinal direction and substantially overlaps with the upper surface 39 of the liquid accommodating body 33. Then, the slider 34 is configured to cover above the inlet port 73 of ink which is provided in liquid accommodating body 33 using an opening and closing cover 74 which is freely opened and closed when the slider 34 is disposed in a state of substantially overlapping with the upper surface 39 of the liquid accommodating body 33 by one end side of the slider 34 being inserted inside the mounting section 31. In detail, the opening and closing cover 74, which is displaced between a position where the inlet port 73 is covered and a position where the inlet port 73 is open, is provided in the slider 34 at an end section of the slider 34 in the longitudinal direction. Here, in the following description, a case of an "insertion direction" indicates the "insertion direction" of the slider 34 with regard to the mounting section 31 unless otherwise specified.

In the present embodiment, the opening and closing cover 74 is axially supported to freely rotate by the slider 34 at a position more to the second accommodating body section 38 (the second part) side than the inlet port 73 in a state where the inlet port 73 is covered such that an axis which extends along the lateral direction of the liquid accommodating body 33 is the center of rotation. Accordingly, as shown by a two-dot chain line in FIG. 3, in a case where the inlet port 73 is opened, it is possible for the user to lift up and rotate the front side of the opening and closing cover 74, which is the front end side of the slider 34 in the longitudinal direction, by approximately 180 degrees to the printer 11 side which is the second accommodating body section 38 side.

As a result, by setting the opening and closing cover 74 to a state where the inlet port 73 is open as shown by the two-dot chain line in FIG. 3 from the state where the inlet port 73 is covered shown by the solid line in FIG. 3, it is possible to displace the opening and closing cover 74 so as to be positioned to the rear side with regard to the inlet port 73. Here, in the present embodiment, the inlet port 73 is provided in the vicinity of an end section on the front side in the first accommodating body section 37 of the liquid accommodating body 33 and is configured so that the length in the front and back direction Y which is necessary for the opening and closing cover 74 to cover the inlet port 73 is not long.

In addition, the slider 34 is provided to be attached with a chip holder 76 as an example of a storage section holding member, where it is possible to place a recording chip 75 as an example of a storage section where relationship information which relates to ink which is introduced into the liquid accommodating body 33 from the inlet port 73, in an end section 34*a* at a far side in the insertion direction into the mounting section 31. Here, when the slider 34 is inserted inside the mounting section 31 in a state of overlapping with the upper surface 39 of the liquid accommodating body 33, it is possible for the recording chip 75 which is attached to the chip holder 76 to be engaged with a communication section 77 which is provided on the mounting section 31 side of the printer 11. By engaging with the communication section 77, the recording chip 75 which is placed in the chip holder 76 is electrically connected by coming into contact with an electric terminal 78 which is provided in the communication section 77. As a result, the relationship information which is recorded in the recording chip 75 is transmitted to the printer 11 side.

Here, in the printer 11 of the present embodiment, when the slider 34 is inserted inside the mounting section 31 of the printer 11 in a state of overlapping with the upper surface 39 of the liquid accommodating body 33, the slider 34 is positionally aligned with the connecting section 43 inside the printer 11 by a pair of plate springs 79 which are attached in the mounting section 31.

That is, as shown in FIG. 2, the plate springs 79 with an inclined shape, where an interval between each of the plate springs 79 is narrowed in each of the insertion directions, are fixed in the vertical direction by screws to the upper frame 35 and the lower frame 36. Then, the plate spring 79 of the upper frame 35 in a pressed state abuts with a protrusion part 80 which is provided in the chip holder 76 which is provided in the slider 34, while the plate spring 79 of the lower frame 36 in a pressed state abuts with the protrusion part 49 (refer to FIG. 5) which is provided in the connecting section 43. As a result, the slider 34 (the chip holder 76) and the connecting section 43 are positionally aligned in the up and down direction Z using the pair of plate springs 79.

In addition, the slider 34 which is inserted in a state of overlapping with the liquid accommodating body 33 and the second accommodating body section 38 of the liquid accommodating body 33 are both in a state of being positionally aligned in the mounting section 31. That is, as shown in FIG. 2, a guiding groove, (which is not shown in the diagram) where a ridge section 82 which extends along the upper surface side of the slider 34 in the longitudinal direction is inserted by sliding, is provided on the upper surface of the upper frame 35 of the mounting section 31. In addition, a guiding groove 84, where a ridge section 83 (refer to FIG. 5 and FIG. 23) which extends along the lower surface side of the liquid accommodating body 33 in the longitudinal direction is engaged, is provided on the upper surface of the lower frame 36 of the mounting section 31. Accordingly, the slider 34 and the second accommodating body section 38 are each positionally aligned by each of the ridge sections engaging with the guiding grooves in the lateral direction. As a result, the slider 34 (and the chip holder 76 which is attached to the slider 34) and the connecting section 43 which is provided in the second accommodating body section 38 are each positionally aligned in the lateral direction.

Here, in the liquid holding container 21 of the present embodiment, the chip holder 76 and the opening and closing cover 74, which are provided in the slider 34, are attached to be freely attached and detached with regard to the slider 34. Then, the slider 34 is configured to be able to slide with regard to the upper surface 39 of the liquid accommodating body 33 in a state where the chip holder 76 and the opening and closing cover 74 are attached. In other words, the slider 34 is configured to be able to be inserted and removed with regard to the mounting section 31 in a state where the liquid accommodating body 33 is fixed to the printer 11.

Furthermore, the configuration of the slider 34 will be described in detail with reference to FIGS. 6A and 6B.

Figures 6A, 6B:
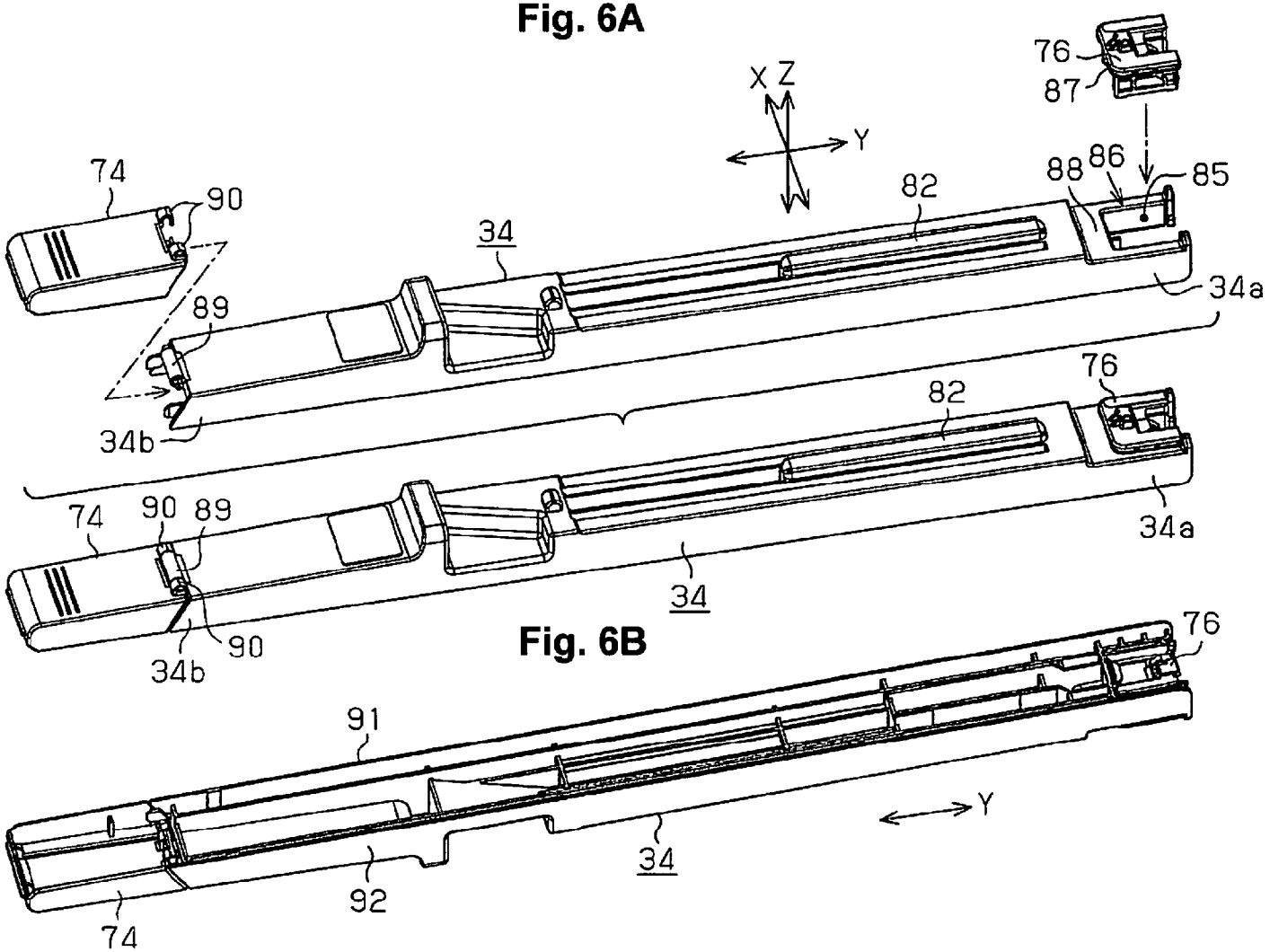
FIG. 6A is an exploded perspective diagram illustrating a configuration of the slider and FIG. 6B is a perspective diagram illustrating a rear surface side of the slider.

As shown in FIG. 6A, a holder attachment section 86, which is provided with an opening 85 with a substantially U shape where the far side in the insertion direction is cut away, is formed in the slider 34 in the end section 34*a* which is the far side in the insertion direction into the mounting section 31. With regard to the opening 85, it is possible to insert and extract the chip holder 76 in the insertion direction of the slider 34, in other words, a direction which intersects with the sliding direction. In the present embodiment, a flange shaped section 87, which is provided on an upper side in the chip holder 76, is inserted and attached inside the opening 85 from above, which is the opposite side to the liquid accommodating body 33, with regard to the slider 34 so as to abut with an upper surface 88 with a substantially C shape which forms the opening 85 in the holder attachment section 86. In addition, the chip holder 76 is detached from the slider 34 by being taken out upward from the holder attachment section 86.

On the other hand, the opening and closing cover 74 is attached to the slider 34 to be able to rotate (swing) by forming a rotation shaft 89 in the slider 34 in an end section 34*b* on the front side in the insertion direction into the mounting section 31 and fitting a bearing section 90 which is formed in the opening and closing cover 74 with regard to the rotation shaft 89.

It is possible for the slider 34 of the present embodiment where the chip holder 76 and the opening and closing cover 74 are attached in this manner to slide along the longitudinal direction (the front and back direction Y) of the liquid accommodating body 33 while abutting with both end portions of the upper surface 39 of the liquid accommodating body 33 in the width direction which is the lateral direction (the left and right direction X) of the liquid accommodating body 33 in a state of overlapping with the liquid accommodating body 33.

In detail, as shown in FIG. 6B, side wall sections 91 and 92 with a linear rib shape which extend in the longitudinal direction are each formed on the lower surface side of the slider 34 which overlaps with the upper surface 39 of the liquid accommodating body 33 at both side ends in the width direction which intersects with the longitudinal direction. On the other hand, the flat surface sections 41 and 42 with a linear shape which extends along the longitudinal direction are formed as abutting surfaces, which abut with each of the side wall sections 91 and 92, on the upper surface 39 of the liquid accommodating body 33 at both side ends in the width direction which intersects with the longitudinal direction. Accordingly, it is possible for the side wall sections 91 and 92 which are formed in the slider 34 to move (slide) along the longitudinal direction while each abutting with the flat surface sections 41 and 42 which are formed on the upper surface 39 of the liquid accommodating body 33.

That is, as shown in FIG. 2 and FIG. 3, a plurality of convex sections 93 which are adjacent to an inner side of the flat surface sections 41 and 42 are formed along the longitudinal direction on the upper surface 39 of the liquid accommodating body 33. Accordingly, by movement of the slider 34 in the width direction (the left and right direction X) being regulated by the plurality of convex sections 93, the slider 34 is stabilized and moved (slid) along the longitudinal direction (the front and back direction Y) with regard to the liquid accommodating body 33.

Here, in the printer 11 of the present embodiment, a sliding knob 94, which is provided so that sliding movement in the up and down direction is possible, is provided on the upper side of the liquid holding container 21 which is fixed to the printer 11 in a state where the second accommodating body section 38 is positioned inside the mounting section 31. By displacing the sliding knob 94 which is provided in the printer 11 from above to below, the sliding knob 94 is engaged with a concave section 95 which is provided on the upper surface of the slider 34, and movement (sliding) of the slider 34 is regulated in the direction of being taken out from the mounting section 31 along the longitudinal direction. Accordingly, by the user moving the sliding knob 94 from below to above, engagement with the concave section 95 is released and the slider 34 is in a state of being able to be taken out from the mounting section 31. Then, in this state, by the user sliding the slider 34 with regard to the liquid accommodating body 33, it is possible to insert and remove the slider 34 with regard to the mounting section 31. Then, a finger hook section 96 which projects along the lateral direction on the upper surface side of the slider 34 is formed in the slider 34 in the present embodiment, and insertion and removal of the slider 34 by the user is made easy due to the finger hook section 96.

Furthermore, the recording chip 75 which is placed on the chip holder 76 is placed so as to be able to be replaced in the present embodiment. The configuration will be described with reference to FIGS. 7A and 7B. Here, the chip holder 76 is shown in FIGS. 7A and 7B in a state of being detached from the slider 34.

Figure 7A:
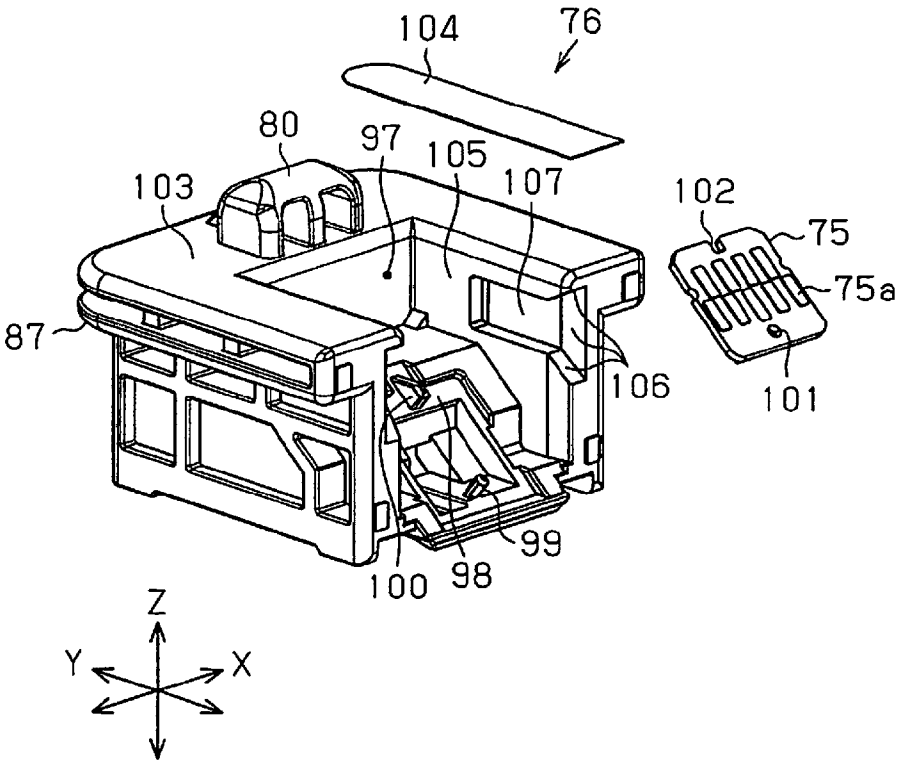
FIG. 7A is an exploded perspective diagram illustrating a configuration of a chip holder and FIG. 7B is a perspective diagram of a chip holder where a recording chip is placed.

As shown in FIG. 7A, the chip holder 76 is configured by a plurality of walls. A concave section 97, where both of the upper side and the far side in the insertion direction of the slider 34 with regard to the mounting section 31 are open in a state of being assembled with the slider 34, is provided in the chip holder 76 and an inclined surface 98 which slopes downward in the insertion direction is provided in the concave section 97. A boss 99 with a cylindrical shape is formed at the lower end side of the inclined surface 98, while a rib 100 with a plate shape, where the insertion direction with regard to the mounting section 31 is the longitudinal direction, is formed at the upper end side of the inclined surface 98. Any and all of the inclined surface 98, the boss 99 with a cylindrical shape, and the rib 100 are referred to as a support section.

On the other hand, in the present embodiment, the recording chip 75 which is placed in the chip holder 76 has a substantially rectangular shape and a plurality (here, nine) of electrodes 75*a* are provided with the insertion direction into the surface of the recording chip 75 as the longitudinal direction. Then, a round hole 101 is formed in the recording chip 75 at one end section which is the front and back in the insertion direction of the plurality of electrodes 75*a* and a slit 102 is formed in the other end section in the recording chip 75. Then, the boss 99 which is provided in the chip holder 76 is inserted in the round hole 101 which is formed in the recording chip 75 and, in accordance with the insertion, the rib 100 which is provided in the chip holder 76 is inserted with regard to the slit 102 which is provided in the recording chip 75. Due to this, the recording chip 75 is placed on the inclined surface 98 of the chip holder 76 in a state of being inclined with regard to the horizontal direction. In addition, even in a case where the chip holder 76 is placed on a plane in any kind of posture (an arbitrary posture), the recording chip 75 is supported by the chip holder 76 such that a wall protrudes further in the direction of gravity than the recording chip 75. An identification seal 104 (an identification label) which identifies the recording chip 75 which is placed in the chip holder 76 is stuck to at least a portion of an upper surface 103 of the chip holder 76 of the present embodiment. The identification seal 104 is the same color as the color of the liquid which is held in the liquid holding container 21 which corresponds to the chip holder 76 or the liquid which is held in a liquid introduction source 126 which will be described later.

Figure 7B:
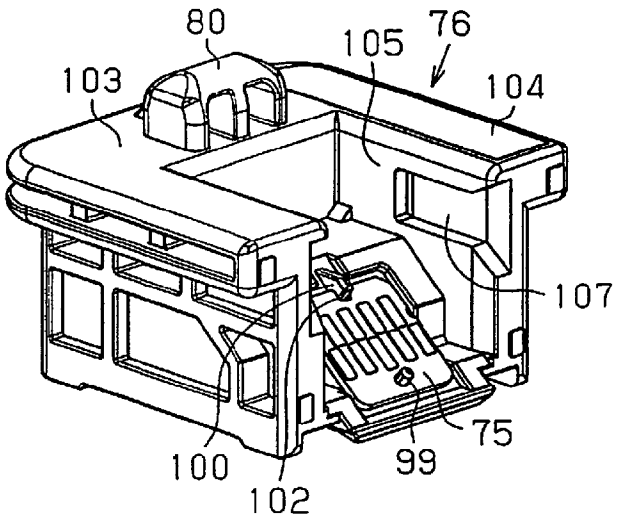

As shown in FIG. 7B, in a state where the recording chip 75 is placed in the chip holder 76, the recording chip 75 is in a state where rotation centered on the boss 99 inside the inclined surface 98 is regulated by the rib 100. In addition, slight gaps are provided between the round hole 101 and the boss 99 and between the slit 102 and the rib 100, and it is possible to detach the recording chip 75, which is placed in the chip holder 76, from the chip holder 76.

Here, although only one is shown in FIGS. 7A and 7B, groove shaped sections 107, which extend in the insertion direction and where chamfered sections 106 are formed at the insertion direction side end, are provided in the concave section 97 in the chip holder 76 at side wall sections 105 which are each formed at both sides in the left and right direction X which intersects with the insertion direction with regard to the mounting section 31. In addition, the protrusion part 80 which abuts with the plate spring 79 which is provided in the upper frame 35 is formed on the upper surface 103 of the chip holder 76.

Next, the configuration of the opening and closing cover 74 will be described with reference to FIGS. 8A, 8B, and 8C. In the present embodiment, the opening and closing cover 74 is attached to be able to be attached and detached with regard to the slider 34 and rotation is suppressed by imparting a load on rotation centered on the rotation shaft 89 at a closed lid position of the inlet port 73.

Figure 8A:
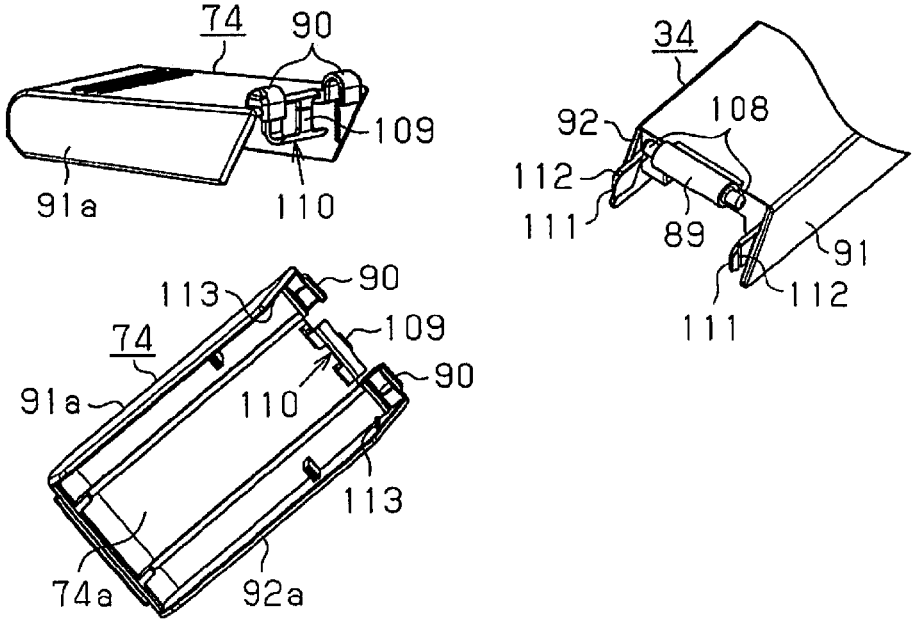
FIG. 8A is a perspective diagram illustrating a configuration of an opening and closing cover.

As shown in FIG. 8A, two bearing sections 90 with substantially semi-cylindrical shapes, which engage with regard to shaft end sections 108 at both sides of the rotation shaft 89 which is provided in the slider 34, and an abutting section 109, which abuts with regard to the substantially central portion in the axial direction of the rotation shaft 89 from the opposite direction to the bearing sections 90, are formed in the opening and closing cover 74. The abutting section 109 is provided at a front end of the hook shape of a hook part 110 which has a substantially J shape viewed from a lateral direction and which is provided with two parts with a plate shape which have flexibility and are formed to protrude from the inner surface (a rear surface 74*a*) side which opposes the inlet port 73 in the opening and closing cover 74. Then, after the abutting section 109 is displaced to match with the temporary bending displacement of the hook part 110 due to the rotation shaft 89 when the two bearing sections 90 are engaged with the shaft end section 108 of the rotation shaft 89, the abutting section 109 engages with the rotation shaft 89 in a substantially abutting state due to the return of the bending displacement in a state where the bearing section 90 is engaged with the shaft end section 108 of the rotation shaft 89. Due to this, the opening and closing cover 74 is configured to be supported to be able to rotate with regard to the rotation shaft 89.

In addition, extension parts 111 which extend in the longitudinal direction are each provided in the slider 34 in side wall sections 91 and 92 at both sides in the lateral direction of the slider 34. Groove sections 112 are formed in the extension parts 111 along the up and down direction. On the other hand, ridge sections 113 which are able to fasten with the groove sections 112 are formed in cover side wall sections 91*a* and 92*a*, which configure a portion of the side wall sections 91 and 92 of the slider 34 in the opening and closing cover 74, at positions which correspond to the groove sections 112 in a state where the opening and closing cover 74 which is attached to the liquid accommodating body 33 covers the inlet port 73.

Figure 8B:
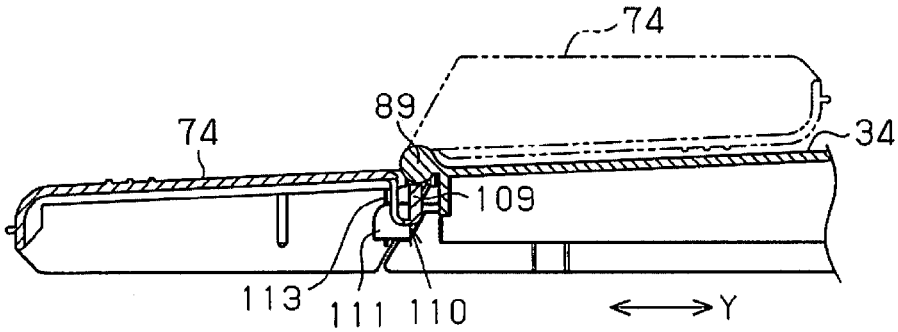
FIG. 8B is a cross sectional diagram illustrating a state where the opening and closing cover is attached to the slider.
Figure 8C:
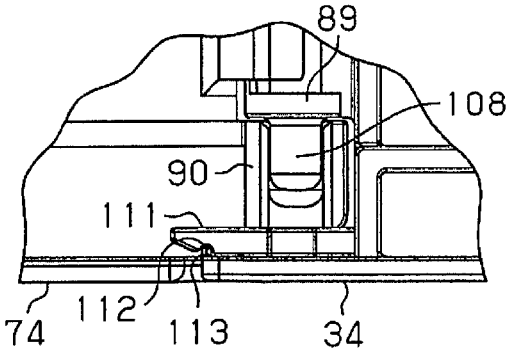
FIG. 8C is a partial enlarged diagram illustrating a configuration of an engaging section.

That is, as shown in FIGS. 8B and 8C, the opening and closing cover 74 is incorporated into the slider 34 by the bearing section 90 and the abutting section 109 being in an engaged state with regard to the rotation shaft 89 of the slider 34. When the opening and closing cover 74 which is incorporated into the slider 34 is in the closed lid position where the inlet port 73 is covered, the ridge sections 113 which are formed in the cover side wall sections 91*a* and 92*a* overlap with the groove sections 112 viewed from the lateral direction and are in an engaged state of being pushed in with regard to the groove sections 112. Accordingly, as shown by the two-dot chain line in FIG. 8B, when the opening and closing cover 74 is displaced to the open lid position of the inlet port 73 by rotating centered on the rotation shaft 89, a rotation load is generated with regard to the opening and closing cover 74. In this point, the groove sections 112 of the slider 34 functions as an example of an engaging section which suppresses displacement from the closed lid position to the open lid position by engaging with the opening and closing cover 74.

Next, the configuration of the periphery of the inlet port 73 in the liquid holding container 21 will be described.

Figure 9A:
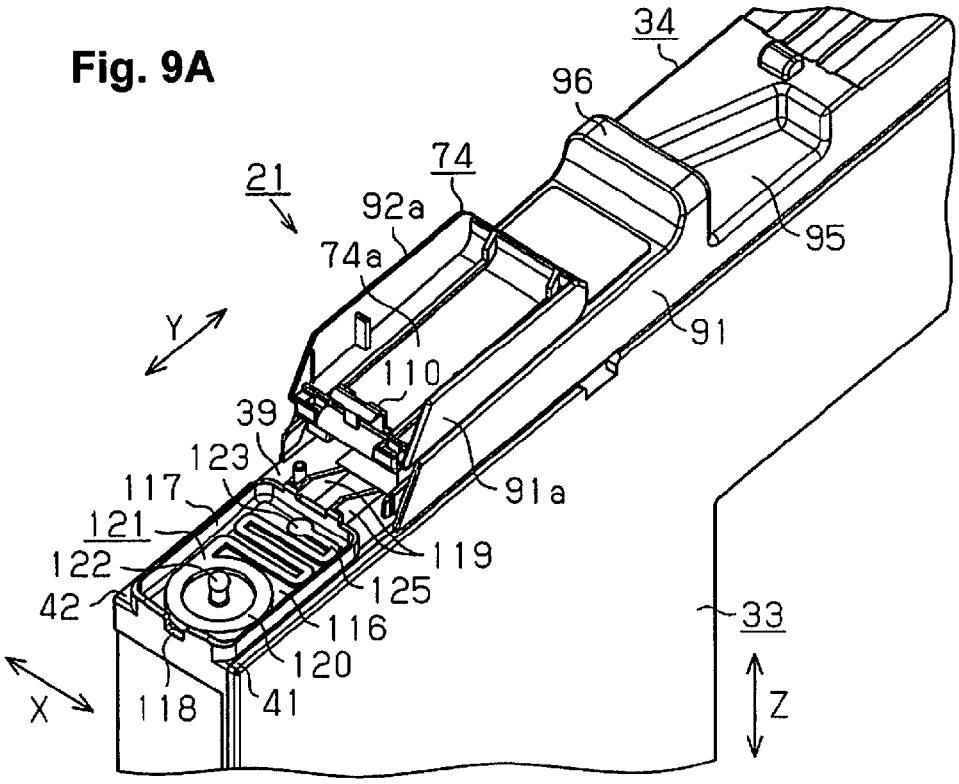
FIGS. 9A and 9B are diagrams illustrating the liquid holding container in a state where the opening and closing cover is positioned in an open lid position.

As shown in FIG. 9A, a liquid receiving surface 116 is formed at the front side portion in the upper surface 39 of the liquid accommodating body 33 as an example of a liquid receiving section which extends along a direction which intersects with the up and down direction Z. The liquid receiving surface 116 has a substantially rectangular shape in a plan view and the width dimension in the left and right direction X of the liquid receiving surface 116 is slightly smaller with regard to the width dimension in the left and right direction X of the liquid accommodating body 33.

In addition, a circumference wall section 117 is provided on the upper surface 39 of the liquid accommodating body 33 to be projected in the upward direction (the direction against gravity) which intersects with the liquid receiving surface 116 so as to surround the periphery of the liquid receiving surface 116. Then, a cut away groove 118 which is recessed downward more than the other portions of the circumference wall section 117 is formed in the wall portion on the front side of the circumference wall section 117 in substantially the center in the left and right direction X of the circumference wall section 117. That is, in the present embodiment, the cut away groove 118 which is an example of a concave section is formed in the circumference wall section 117 which is an example of the circumference position of the inlet port 73. On the other hand, a pair of reinforcing ribs 119 which extend to the rear while intersecting with the wall portion are formed at the wall portion on the rear side of the circumference wall section 117.

In addition, a covering member 121 which has a substantially cylindrical shape and which is provided with a covering body 120 which is able to cover and open the inlet port 73 (refer to FIG. 9B) is placed on the liquid receiving surface 116. A knob section 122, which has a substantially columnar shape which protrudes in the upward direction from the upper side surface of the covering body 120, is formed in the covering body 120. The knob section 122 is a part which is grasped when the user detaches the covering body 120 from the inlet port 73 or conversely covers the inlet port 73 with the covering body 120.

In addition, in the state shown in FIG. 9A, the covering member 121 is provided with a fixing section 123 for fixing the covering member 121 to the liquid receiving surface 116 at the rear side which is the opposite side to the front side where the covering body 120 is provided. The fixing section 123 is fixed in a fixing hole 124 (refer to FIG. 10) which formed as an opening in the liquid receiving surface 116 to able to rotate with the axis of the fixing hole 124 as the center of rotation and such that removal from the liquid receiving surface 116 is not possible. Accordingly, the covering member 121 is able to rotate with regard to the liquid receiving surface 116 with the fixing section 123 as the center of rotation while it not possible for the covering member 121 to be easily detached from the liquid receiving surface 116. However, it is possible to replace the covering member 121 with a new covering member 121 by including the fixing section 123.

In addition, the covering member 121 is provided with a coupling section 125 which couples the covering body 120 and the fixing section 123 while curving a plurality of times (three times in the left and right direction X in the present embodiment) in the direction which intersects with the up and down direction Z in a state of being placed on the liquid receiving surface 116. The cross sectional shape of the coupling section 125 in the extension direction is a rectangular shape and the length in the rectangular cross sectional shape in the direction along the liquid receiving surface 116 is longer than the length in the direction (the up and down direction Z) which intersects with the liquid receiving surface 116. As a result, when the coupling section 125 is placed on the liquid receiving surface 116, the contact area with the liquid receiving surface 116 is increased and the coupling section 125 is stably placed on the liquid receiving surface 116.

In addition, it is possible for the covering body 120, the coupling section 125, and the fixing section 123 which configure the covering member 121 to be formed of elastomers or the like such as rubber or resin and elastically change shape. Accordingly, in the state shown in FIG. 9A, the covering body 120 covers the inlet port 73 such that there is no gap between the covering body 120 and the inlet port 73 by being fitted to the inlet port 73 in a state where the shape of the covering body 120 changes elastically.

As shown in FIG. 9A, it is possible to place the covering body 120 which is detached from the inlet port 73 at the rear surface 74*a* (an example of the bottom surface) of the opening and closing cover 74 which is in the open lid position. In addition, since the area of the rear surface 74*a* of the opening and closing cover 74 is larger than the projection area in a case where the covering body 120 projects in a direction along the up and down direction Z, it is possible to place the covering body 120 more stably.

Furthermore, the rear surface 74*a* of the opening and closing cover 74 is a surface with a downward gradient toward the front where the inlet port 73 is located in a state (the state shown in FIG. 9A) where the opening and closing cover 74 is positioned in the open lid position. In addition, the cover side wall sections 91*a* and 92*a* are in a state of facing in the upward direction at both side ends of the rear surface 74*a* of the opening and closing cover 74 which is positioned in the open lid position. Accordingly, when the covering body 120 where ink is attached is placed at the rear surface 74*a* of the opening and closing cover 74 which is positioned in the open lid position, the cover side wall sections 91*a* and 92*a* also function as an example of a shielding section which suppresses ink from leaking out from the opening and closing cover 74 to the outside.

Figure 9B:
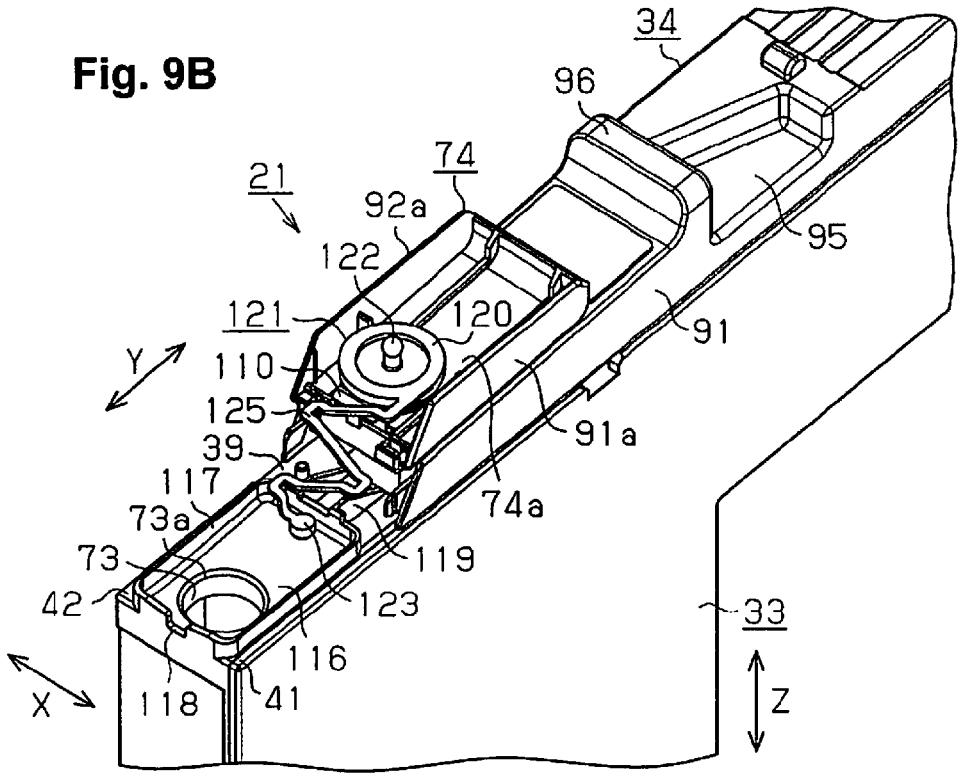

FIG. 9B illustrates the liquid holding container 21 in a state where the covering body 120 is detached from the inlet port 73 and the covering body 120 is placed at the rear surface 74*a* of the opening and closing cover 74. As shown in FIG. 9B, by the inlet port 73 which is formed as an opening in a portion of the liquid receiving surface 116 being exposed, it is possible for the user to introduce ink to an inner section (a first ink chamber 151 (refer to FIG. 14)) of the liquid accommodating body 33 via the inlet port 73. In addition, an opening edge 73*a* which is the upper end edge of the inlet port 73 is formed with an inclined shape by being chamfered and ink flows easily inside the inlet port 73 when the ink is introduced.

In addition, as shown in FIG. 9B, the length of the coupling section 125 of the covering member 121 is a length where it is possible for the covering body 120 to be placed at the rear surface 74*a* of the opening and closing cover 74 in a state of being positioned in the open lid position. Here, in the state shown in FIG. 9B, the coupling section 125 is in a state of being slightly extended, while the covering body 120 is in a state of being placed at the rear surface 74*a* of the opening and closing cover 74 and in a state of abutting with the hook part 110 of the opening and closing cover 74.

Figure 10:
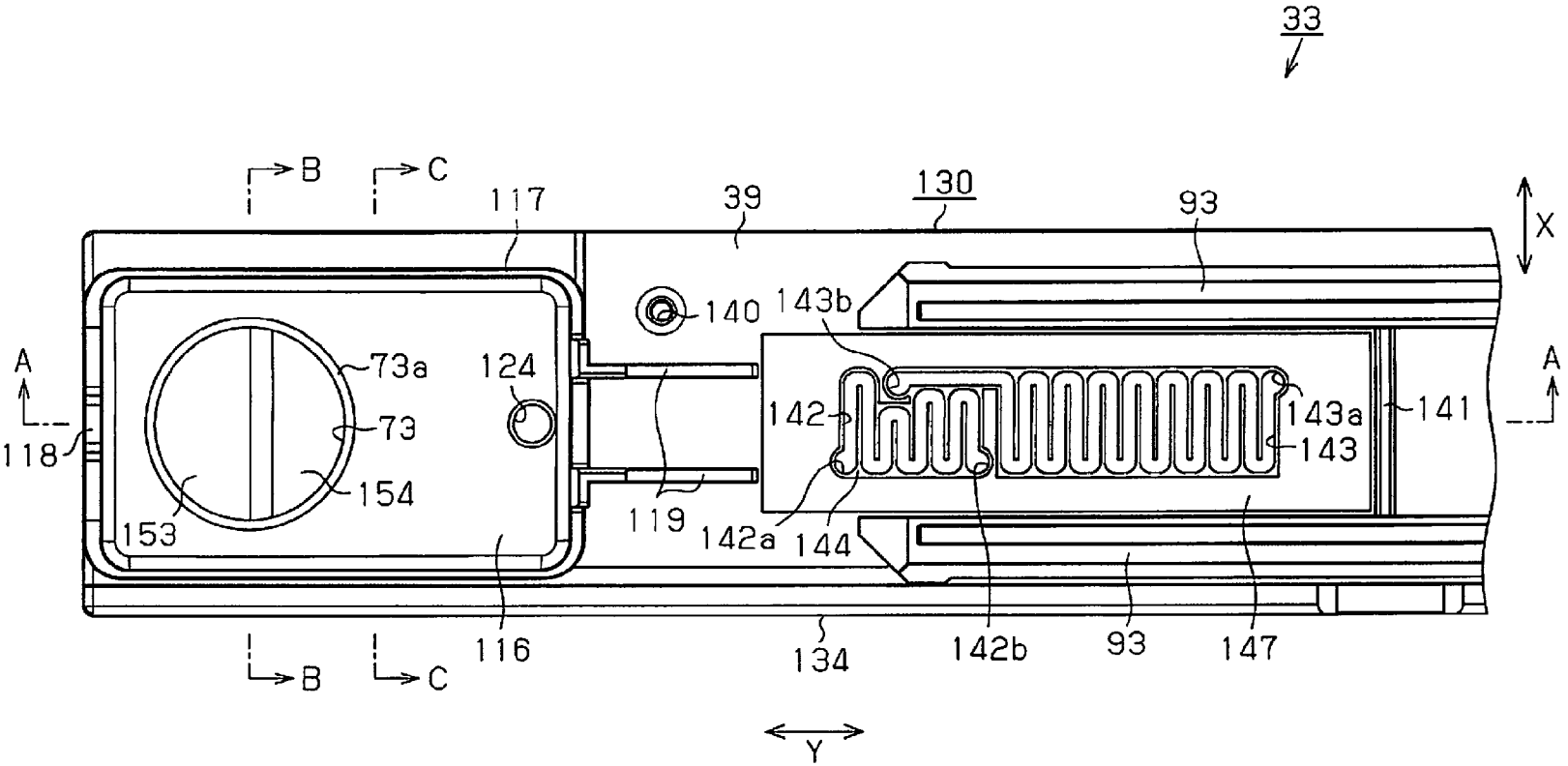
FIG. 10 is a planar diagram of a liquid accommodating body.

As shown in FIG. 10, the fixing hole 124 where the fixing section 123 of the covering member 121 is fixed by insertion is formed as an opening in the vicinity of a wall portion of the rear side (the right side in FIG. 10) of the circumference wall section 117 in the liquid receiving surface 116 in the direction which intersects with the liquid receiving surface 116. The fixing hole 124 is provided such that the center position of the fixing hole 124 in the left and right direction X substantially coincides with the center position of the inlet port 73 in the left and right direction X. Here, the fixing hole 124 is formed as an opening on the liquid receiving surface 116 in the same manner as the inlet port 73, but does not communicate with the first ink chamber 151.

Figure 11:
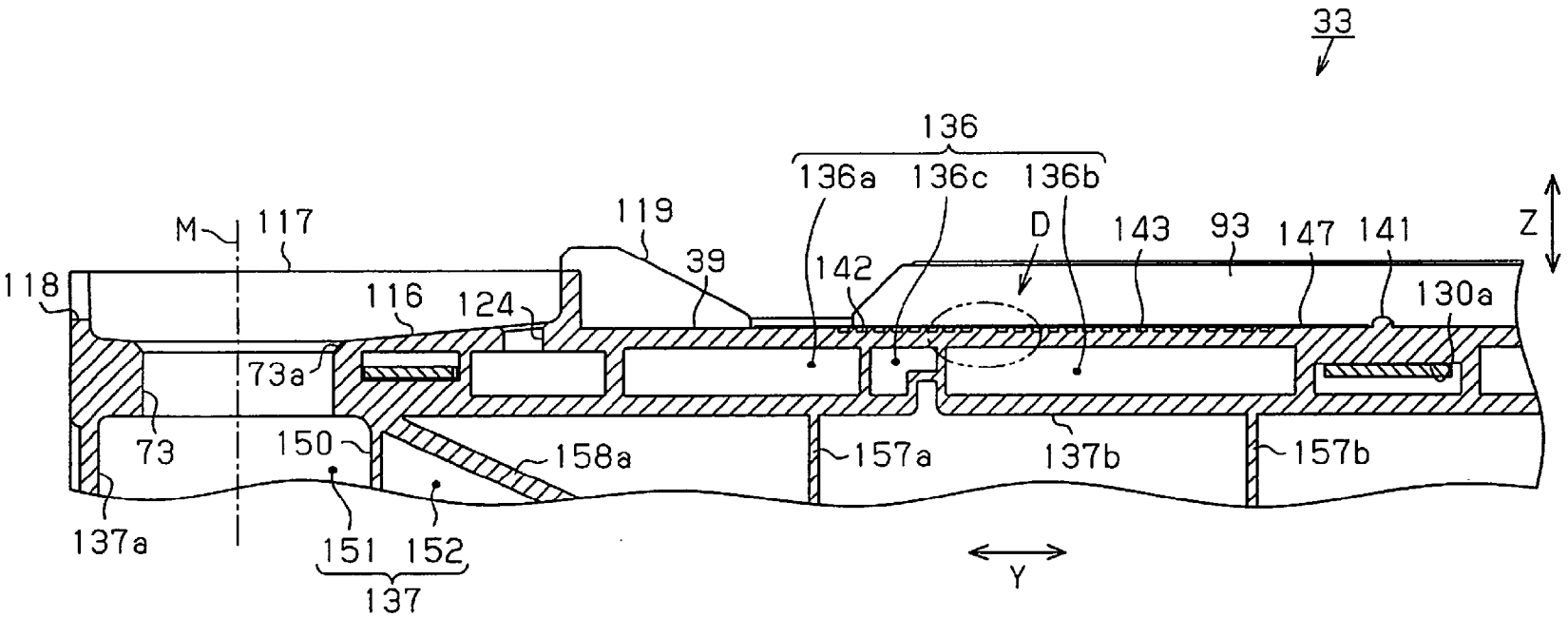
FIG. 11 is a diagram illustrating a cross sectional structure of the liquid accommodating body which is a diagram of a cross section viewed along an arrow line A-A in FIG. 10.

As shown in FIG. 11, the liquid receiving surface 116 is formed so as to be inclined downward (in the direction of gravity) toward the inlet port 73 in the front and back direction Y. Accordingly, the vicinity of the fixing hole 124 which is at a position which is separated from the inlet port 73 is the highest position on the liquid receiving surface 116. In other words, since the fixing section 123 of the covering member 121 which is fixed to the fixing hole 124 is positioned at a position which is higher than the periphery of the inlet port 73 in the liquid receiving surface 116, it is difficult for ink to be attached even when ink flows onto the liquid receiving surface 116 when the ink is introduced into the inlet port 73.

Figure 12A:
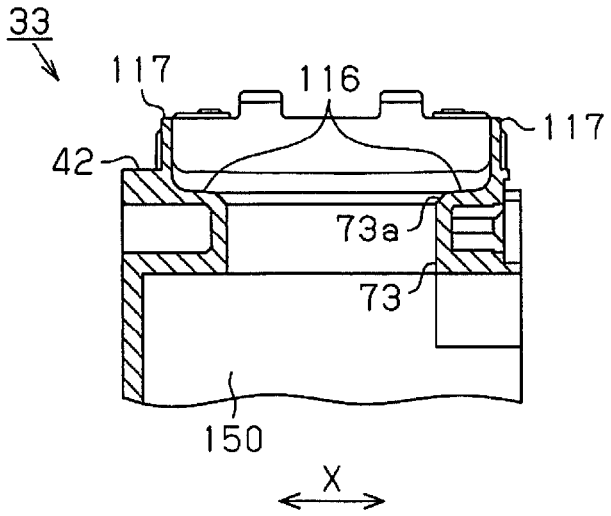
FIGS. 12A and 12B are diagrams illustrating a cross sectional structure of the liquid accommodating body, where
Figure 12B:
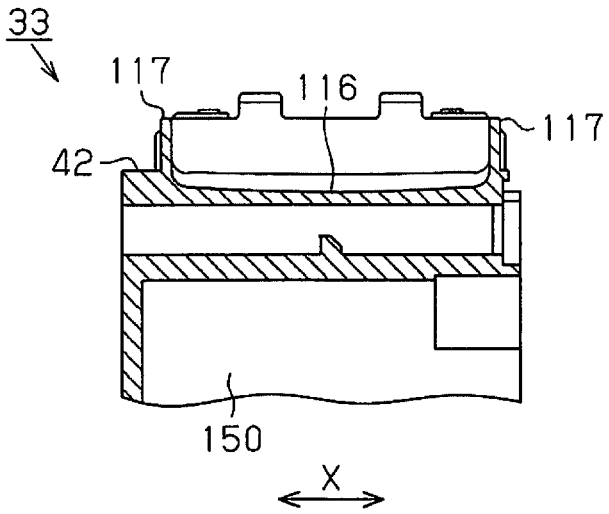

In addition, as shown in FIG. 12A, the liquid receiving surface 116 is formed so as to incline downward toward the inlet port 73 even in the left and right direction X. Furthermore, as shown in FIG. 12B, the liquid receiving surface 116 is formed to incline downward toward the center in the left and right direction X at a position which is close to the fixing hole 124 which is separated from the inlet port 73.

Next, the internal configuration of the liquid accommodating body 33 will be described.

Figure 13:
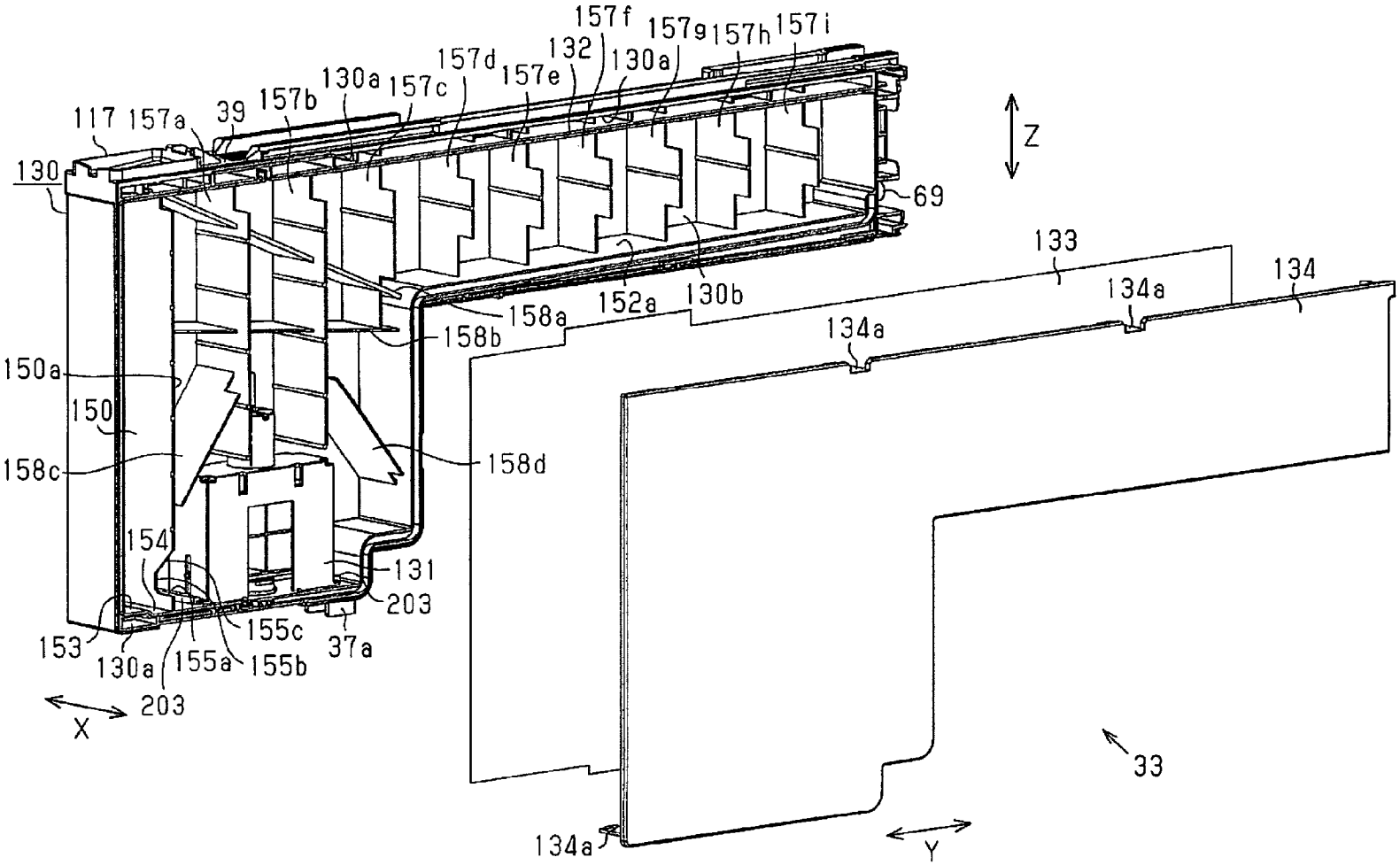
FIG. 13 is an exploded perspective diagram of the liquid accommodating body.

As shown in FIG. 13, the liquid accommodating body 33 is provided with the accommodating body case 130 which has a substantially L shape in a side surface view viewed from the left and right direction X, a float valve 131 which is one type of valve mechanism which is accommodated inside the accommodating body case 130, a film 133 which is adhered (for example, heat welded) to a case opening section 132 of the accommodating body case 130, and a cover 134 made of resin which covers the case opening section 132 over the film 133. Here, the accommodating body case 130 is integrally molded such that the right side surface is open and a fastening section 130*a* which fastens with a claw section 134*a* which is formed in the cover 134 is formed on an outer side of the case opening section 132 which has a ring shape.

Figure 14:
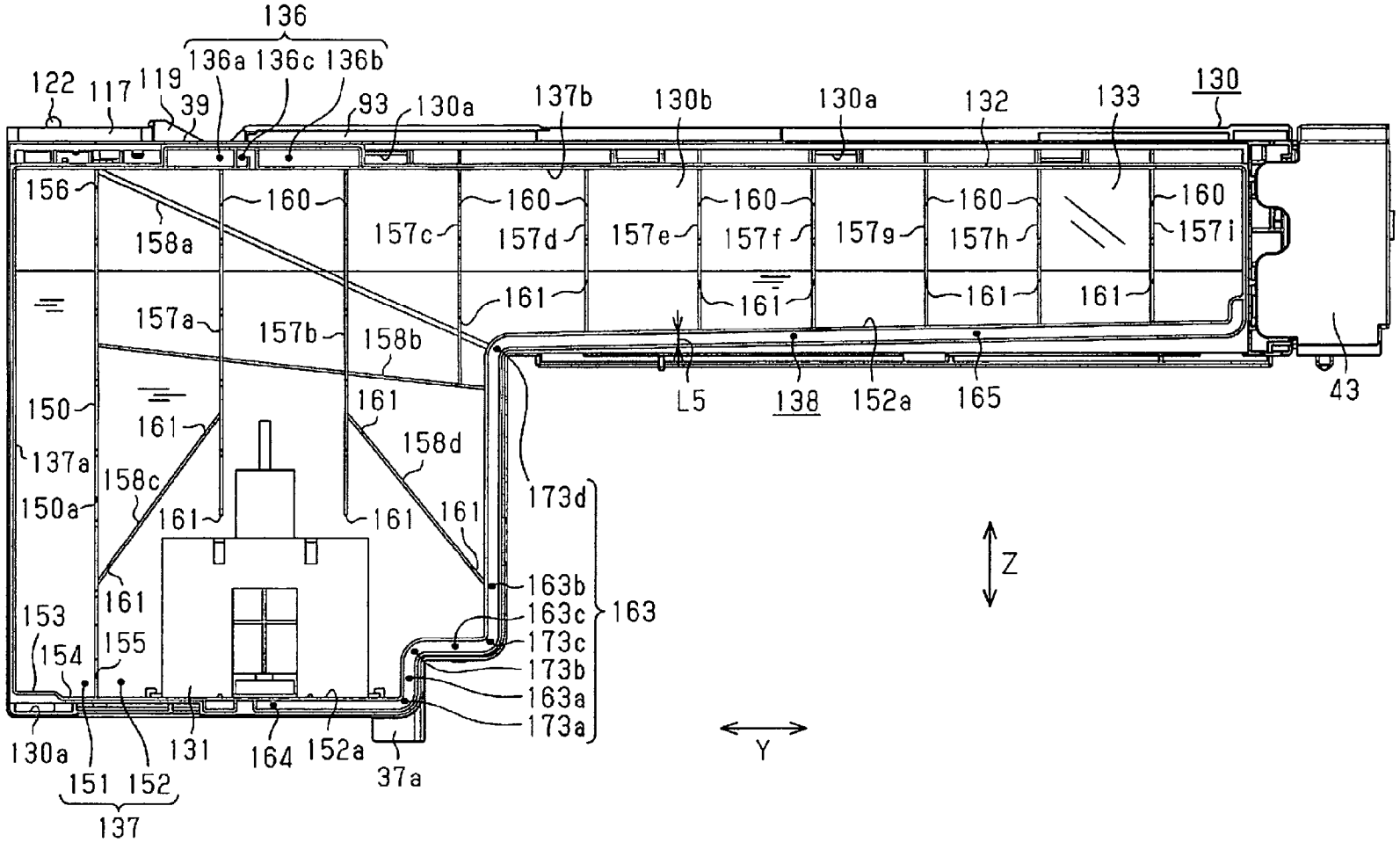
FIG. 14 is a side surface diagram of an accommodating body case where a film is adhered.

As shown in FIG. 14, when the film 133 is adhered to the case opening section 132 of the accommodating body case 130, a space region which is surrounded by the accommodating body case 130 and the film 133 functions as an air chamber 136 which is communicated with the atmosphere, an ink chamber 137 which is an example of a liquid accommodating chamber which holds ink, and a lead out flow path 138 which is an example of a liquid flow path. Here, one end of the lead out flow path 138 is communicated with the ink chamber 137 and the lead out port 69 (refer to FIG. 4 and FIG. 5) where the ink which is held in the ink chamber 137 is led out to the liquid ejecting head 24 (the printer 11 side) is formed at the other end side of the lead out flow path 138.

Next, the air chamber 136 and the configuration for taking in air into the air chamber 136 will be described.

As shown in FIG. 10, an atmosphere communicating hole 140 which is communicated with the atmosphere and a position alignment ridge 141 which extends along the left and right direction X are formed on the upper surface 39 where the inlet port 73 of the accommodating body case 130 is formed. Furthermore, at least one (two in the present embodiment) winding grooves 142 and 143 which are formed to meander, and a meandering convex section 144 which surrounds the periphery of the winding grooves 142 and 143 are formed between the reinforcing ribs 119 and the position alignment ridge 141 described above.

Figure 15:
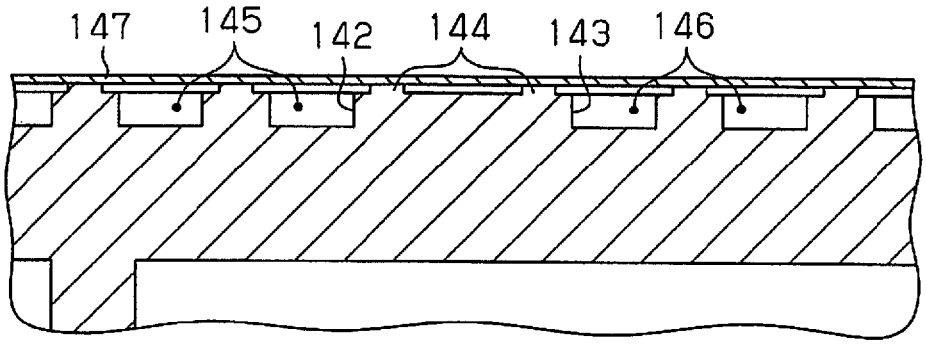
FIG. 15 is an enlarged diagram of D portion in FIG. 11.

Then, as shown in FIG. 10 and FIG. 15, an air conducting path forming film 147 which forms air conducting paths 145 and 146 by covering the winding grooves 142 and 143 is adhered (for example, heat welded) onto the upper surface 39 of the accommodating body case 130. That is, when the air conducting path forming film 147 is adhered to the meandering convex section 144 in a state where the reinforcing ribs 119 and the position alignment ridge 141 are positionally aligned, the first air conducting path 145 is formed by the first winding groove 142 and the air conducting path forming film 147. Furthermore, the second air conducting path 146 is formed by the second winding groove 143 and the air conducting path forming film 147.

As shown in FIG. 10 and FIG. 11, the atmosphere communicating hole 140 is communicated with a first air chamber 136*a*. In addition, one end 142*a* of the first winding groove 142 is communicated with the first air chamber 136*a* while an other end 142*b* of the first winding groove 142 is communicated with a second air chamber 136*b*. Furthermore, one end 143*a* of the second winding groove 143 is communicated with the second air chamber 136*b* while an other end 143*b* of the second winding groove 143 is communicated with a third air chamber 136*c*.

Figure 16:
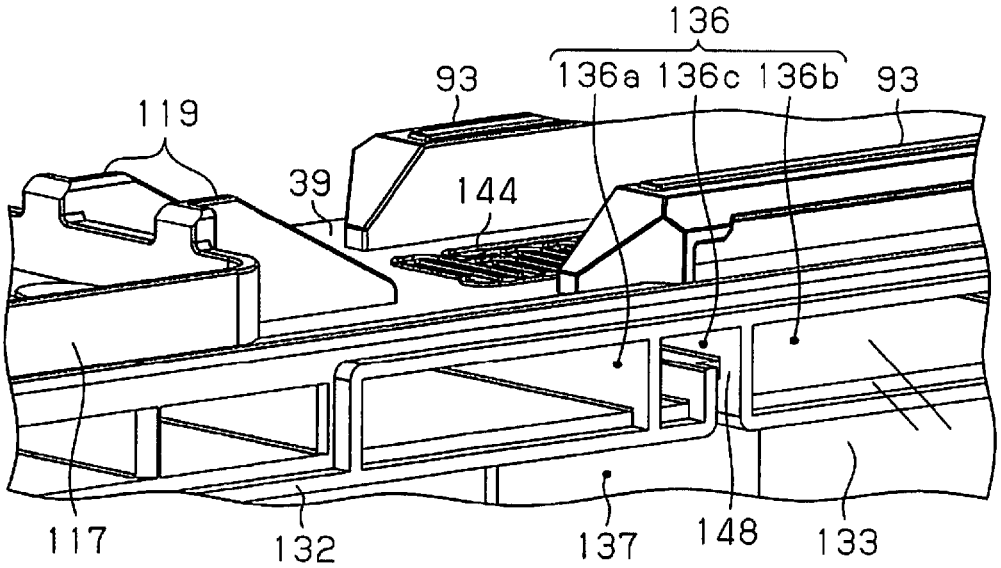
FIG. 16 is an enlarged diagram of the accommodating body case where a film is adhered.

As shown in FIG. 16, an air intake port 148 is formed in the third air chamber 136*c*, and the third air chamber 136*c* and the ink chamber 137 are communicated via the air intake port 148. As a result, for example, when the pressure inside the ink chamber 137 decreases due to ink which is held in the ink chamber 137 being led out, outside air which is taken in from the atmosphere communicating hole 140 is taken into the ink chamber 137 via the first air chamber 136*a*, the first air conducting path 145, the second air chamber 136*b*, the second air conducting path 146, and the third air chamber 136*c*.

Next, the ink chamber 137 will be described.

As shown in FIG. 14, in the shape of the ink chamber 137, the height dimension in the up and down direction Z at the front side is larger than the height dimension in the up and down direction Z at the rear side in the same manner as the shape of the liquid accommodating body 33. Furthermore, the ink chamber 137 is partitioned into the first ink chamber 151 which is an example of a first liquid accommodating chamber and a second ink chamber 152 which is an example of a second liquid accommodating chamber by a partition wall 150 which intersects with a ceiling surface 137*b* which is an example of an inlet port forming surface where the inlet port 73 is formed in the ink chamber 137.

Here, the partition wall 150 is provided so as to extend along the up and down direction Z and intersect with a bottom surface 153 which opposes the ceiling surface 137*b*. In addition, the width of the partition wall 150 in the left and right direction X is substantially equal to the width from a side wall 130*b* on the left side of the accommodating body case 130 to the case opening section 132. In addition, the partition wall 150 is molded integrally with the accommodating body case 130 at a position in the ink chamber 137 close to the front side where the height in the up and down direction Z is large so as to be orthogonal to the side wall 130*b* of the accommodating body case 130 and to protrude from the side wall 130*b* toward the case opening section 132 side (the front side in FIG. 14). As a result, the height of the second ink chamber 152 in the up and down direction Z on the first ink chamber 151 side is substantially equal to the height of the first ink chamber 151 in the up and down direction Z and is larger than the height of the second ink chamber 152 in the up and down direction Z at the rear side which is separated from the first ink chamber 151. Then, the volume of the first ink chamber 151 is smaller than the volume of the second ink chamber 152.

In detail, as shown in FIG. 11, the partition wall 150 is formed to be substantially line symmetrical with a front wall surface 137*a* in the first ink chamber 151 centered on an introduction virtual line M which extends along the up and down direction Z by passing through the center of the opening of the inlet port 73. That is, the inlet port 73 is formed in the ceiling surface 137*b* of the first ink chamber 151 which is more to the front side than the partition wall 150.

Figure 17:
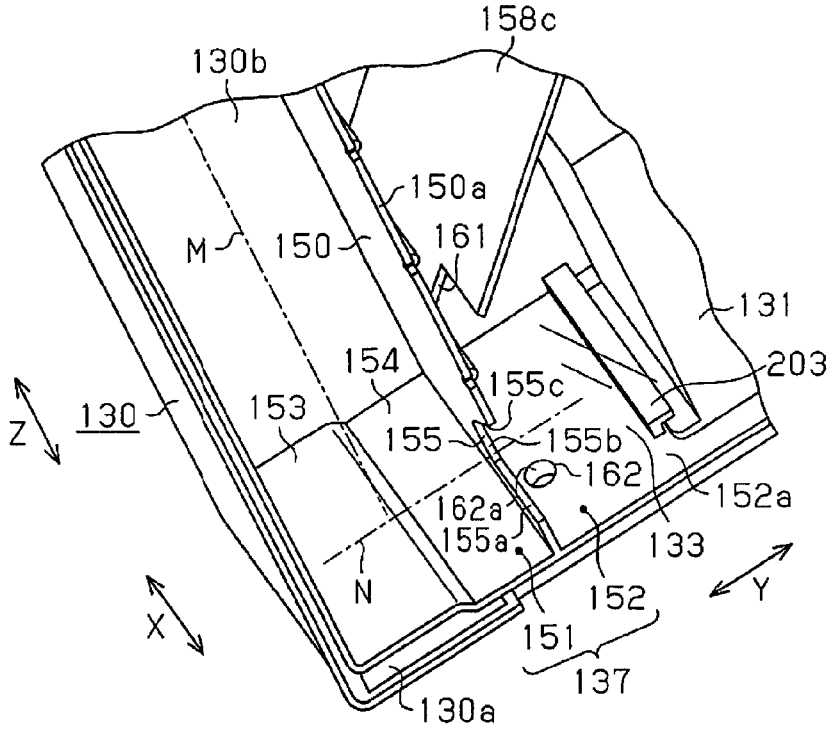
FIG. 17 is an enlarged diagram of the accommodating body case where a film is adhered.

In addition, as shown in FIG. 17, a concave section 154, which is recessed in the direction of gravity so as to be separated from the inlet port 73, is provided in the first ink chamber 151 at a position in the bottom surface 153 close to the partition wall 150 by shifting the position from the inlet port 73 in a direction which intersects with the direction of gravity. That is, the concave section 154 is provided to span the left and right direction X at a position which is shifted from the introduction virtual line M in the front and back direction Y.

As shown in FIG. 14 and FIG. 17, when the film 133 is adhered to the partition wall 150, a portion, which is formed as a recess from an adhesion surface 150*a* to the side wall 130*b* side, functions as a wall communicating opening (a wall communicating opening section) 155 which is an example of a communicating opening and functions as a wall ventilation opening (a wall ventilation opening section) 156 which is an example of a ventilation opening. That is, the first ink chamber 151 and the second ink chamber 152 are communicated via the wall communicating opening 155 and the wall ventilation opening 156. Here, the wall ventilation opening 156 is formed at an upper end of the partition wall 150 so as to be in contact with the ceiling surface 137*b* and is positioned at a side which is above the wall communicating opening 155.

On the other hand, the wall communicating opening 155 is positioned on the bottom surface 153 side which is more to the lower side than the wall ventilation opening 156 and is formed at a position which is separated upward from the concave section 154. Furthermore, in the wall communicating opening 155, a lower surface 155*a* which is positioned at the lower side inside the wall communicating opening 155 is formed substantially horizontally by being substantially orthogonal with regard to a far surface 155*b* which is on the left side, while an upper surface 155*c* which is positioned at the upper side (the direction against gravity side) is not orthogonal with regard to the far surface 155*b*. That is, the upper surface 155*c* is inclined in the direction which intersects with the horizontal direction and is also separated from the lower surface 155*a* as separation from the far surface 155*b* increases. In addition, the wall communicating opening 155 has a relationship where a communicating port axis N, (which extends along the front and back direction Y in the present embodiment) which is orthogonal with an opening cross section passing through the center of the opening of the wall communicating opening 155, is not parallel with an introduction virtual line M and does not intersect with each other. That is, the wall communicating opening 155 is formed at a position which is twisted with regard to the inlet port 73.

Furthermore, the area of the wall communicating opening 155 corresponds to the area of a portion which is formed as a recess in the partition wall 150, is smaller than the area of the partition wall 150, and is smaller than the area of the inlet port 73. Furthermore, the area of the wall ventilation opening 156 is smaller than the area of the wall communicating opening 155.

In addition, as shown in FIG. 14, at least one of (nine in the present embodiment) intersecting rib sections 157*a* to 157*i* which extend along the up and down direction Z by intersecting with the ceiling surface 137*b* is formed in the second ink chamber 152 with intervals in the front and back direction Y. Furthermore, at least one (four in the present embodiment) of diagonal rib sections 158*a* to 158*d* which are an example of overhanging sections and which intersect with the up and down direction Z and the front and back direction (the horizontal direction) Y are formed in the second ink chamber 152. Here, the intersecting rib sections 157*a* to 157*i* and the diagonal rib sections 158*a* to 158*d* are molded integrally with the accommodating body case 130 so as to be orthogonal with the side wall 130*b* of the accommodating body case 130 and to protrude from the side wall 130*b* toward the case opening section 132 side (the front side in FIG. 14).

The width of the intersecting rib sections 157*a* to 157*i* in the left and right direction X is substantially equal to the width of the intersecting rib sections 157*a* to 157*i* from the side wall 130*b* of the accommodating body case 130 to the case opening section 132. Furthermore, a portion of the intersecting rib sections 157*a* to 157*i* at the upper end which is in contact with the ceiling surface 137*b* is formed as a recess toward the side wall 130*b* side. As a result, when the film 133 is adhered to the adhesion surface (the right end surface) of the intersecting rib sections 157*a* to 157*i*, the portion which is formed as a recess functions as a rib ventilation opening (a rib ventilation opening section) 160 which is an example of a ventilation opening. Here, the area of a rib ventilation opening 160 is larger than the area of the wall ventilation opening 156, and the size of the rib ventilation opening 160 in the up and down direction Z is larger than the size of the wall ventilation opening 156 in the up and down direction Z. That is, the lower side opening end of the wall ventilation opening 156 is positioned at a position which is closer to the ceiling surface 137*b* than the lower side opening end of the rib ventilation opening 160. Accordingly, the wall ventilation opening 156 is formed to be closer to the ceiling surface 137*b* than the rib ventilation opening 160.

The first intersecting rib section 157*a* which is closest to the partition wall 150 and the second intersecting rib section 157*b* which is second closest are formed to have a gap with a bottom surface 152*a* to the front where the size in the up and down direction Z in the second ink chamber 152 is large. As a result, when the film 133 is adhered to the adhesion surfaces of the first intersecting rib section 157*a* and the second intersecting rib section 157*b*, the lower ends of the first intersecting rib section 157*a* and the second intersecting rib section 157*b* function as a rib communicating opening (a rib communicating opening section) 161 which is an example of a communicating opening through which it is possible for ink to pass. Here, the bottom surface 152*a* of the second ink chamber 152 is a surface which is positioned at the lower side in the second ink chamber 152 in the up and down direction Z and is partially curved and inclined to match the shape of the second ink chamber 152. Then, the float valve 131 is accommodated between the first intersecting rib section 157*a*, the second intersecting rib section 157*b* and the bottom surface 152*a*.

The third intersecting rib section 157*c* to the ninth intersecting rib section 157*i* are formed at positions to the rear of the second ink chamber 152. Furthermore, a portion of the lower ends of the third intersecting rib section 157*c* to the ninth intersecting rib section 157*i* is formed as a recess toward the side wall 130*b* side. As a result, when the film 133 is adhered to the adhesion surface (the right end surface) of the third intersecting rib section 157*c* to the ninth intersecting rib section 157*i*, a portion which is formed as a recess toward the side wall 130*b* side at the lower ends of the third intersecting rib section 157*c* to the ninth intersecting rib section 157*i* functions as the rib communicating opening 161 which is an example of an opening through which it is possible for ink to pass. That is, in the second ink chamber 152, spaces which are set apart by the intersecting rib sections 157*a* to 157*i* are communicated via the rib communicating opening 161 and the rib ventilation opening 160 which is formed more to the ceiling surface 137*b* side than the rib communicating opening 161.

As shown FIG. 13 and FIG. 14, the first diagonal rib section 158*a* which is at the highest position is formed so as to be a downward inclined surface toward the rear from the intersection point of the partition wall 150 and the ceiling surface 137*b*. Furthermore, the second diagonal rib section 158*b* which is at the second highest position is formed in the partition wall 150 so as to be a downward inclined surface with a gentler gradient than the first diagonal rib section 158*a* toward the rear from a position which is below the first diagonal rib section 158*a*. That is, the first diagonal rib section 158*a* and the second diagonal rib section 158*b* are formed so as to intersect with the partition wall 150 and to intersect with the front and back direction Y. Here, the widths of the first diagonal rib section 158*a* and the second diagonal rib section 158*b* in the left and right direction X are smaller than the widths of the partition wall 150 and the intersecting rib sections 157*a* to 157*i*. As a result, in a case where the film 133 is adhered to the case opening section 132, gaps are formed between the first diagonal rib section 158*a*, the second diagonal rib section 158*b*, and the film 133. Accordingly, the spaces which are divided by the first diagonal rib section 158*a* and the second diagonal rib section 158*b* are communicated with each other via the gaps.

Furthermore, a third diagonal rib section 158*c* which is an example of a first overhanging section and a fourth diagonal rib section 158*d* which is an example of a second overhanging section are formed at an upper side position of the float valve 131 which is more to the bottom surface 152*a* side than the second diagonal rib section 158*b*. The third diagonal rib section 158*c* is formed between the partition wall 150 and the first intersecting rib section 157*a* and the fourth diagonal rib section 158*d* is formed more to the rear side than the second intersecting rib section 157*c*. Then, the third diagonal rib section 158*c* and the fourth diagonal rib section 158*d* are formed so as to be line symmetric with an axis (which is not shown in the diagram) along the direction of gravity which passes through the center of the float valve 131 as a reference and to each be downwardly inclined surfaces from the center of the float valve 131 to the end section. That is, the distance from the upper end of the third diagonal rib section 158*c* to the upper end of the fourth diagonal rib section 158*d* is shorter than the distance from the lower end of the third diagonal rib section 158*c* to the lower end of the fourth diagonal rib section 158*d*.

Here, the widths of the third diagonal rib section 158*c* and the fourth diagonal rib section 158*d* in the left and right direction X are substantially equal to the width of the partition wall 150. Furthermore, both ends of the third diagonal rib section 158*c* and the fourth diagonal rib section 158*d* are formed as a recess toward the side wall 130*b* side. Therefore, when the film 133 is adhered to the adhesion surface (the right end surface) of the third diagonal rib section 158*c* and the fourth diagonal rib section 158*d*, the portion which is formed as a recess to the side wall 130*b* side functions as the rib communicating opening 161 through which it is possible for ink to pass. Accordingly, the spaces which are divided by the third diagonal rib section 158*c* and the fourth diagonal rib section 158*d* are communicated with each other via the rib communicating opening 161.

Figure 18:
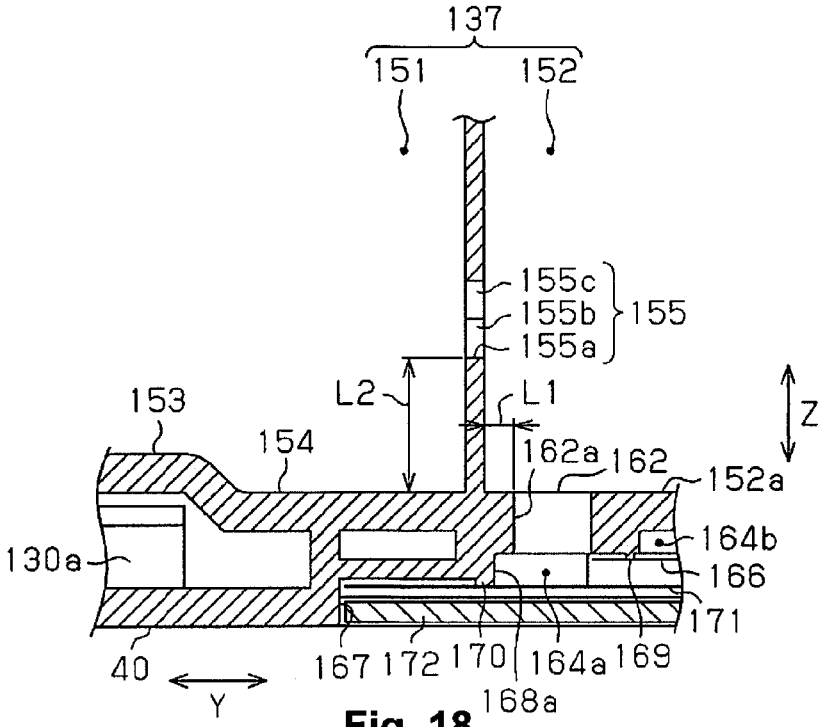
FIG. 18 is a partial cross sectional diagram of the accommodating body case.

As shown in FIG. 17 and FIG. 18, a flow path opening (a flow path opening section) 162 which is communicated with the lead out flow path 138 is formed in the bottom surface 152*a* of the second ink chamber 152. That is, the diagonal rib sections 158*a* to 158*d* are provided so as to be positioned more to an upper side position than the flow path opening 162 and the float valve 131 and to cover the flow path opening 162 and the float valve 131 from above. Here, a distance L1 between the flow path opening 162 and the partition wall 150 in the front and back direction Y is shorter than a distance L2 between the bottom surface 153 and the wall communicating opening 155 in the up and down direction Z. Here, the distance L2 in the present embodiment corresponds to the distance between the upper end of the concave section 154 which is formed in the bottom surface 153 and the lower end of the wall communicating opening 155. That is, the flow path opening 162 is formed at a position, which is close to the partition wall 150, in the bottom surface 152*a* of the second ink chamber 152.

Next, the lead out flow path 138 will be described.

As shown in FIG. 14, the lead out flow path 138 is formed at the lower side of the second ink chamber 152 along the bottom surface 152*a* of the second ink chamber 152. Then, the lead out flow path 138 has a curved flow path section 163 where ink flows while the direction of the ink flow (referred to below as "flow direction") is changed by being formed so as to bend to match the shape of the liquid accommodating body 33. Furthermore, the lead out flow path 138 has a coupling flow path section 164 which joins the flow path opening 162 and the curved flow path section 163, and an inclined flow path section 165 which joins the curved flow path section 163 and the lead out port 69.

Figure 19:
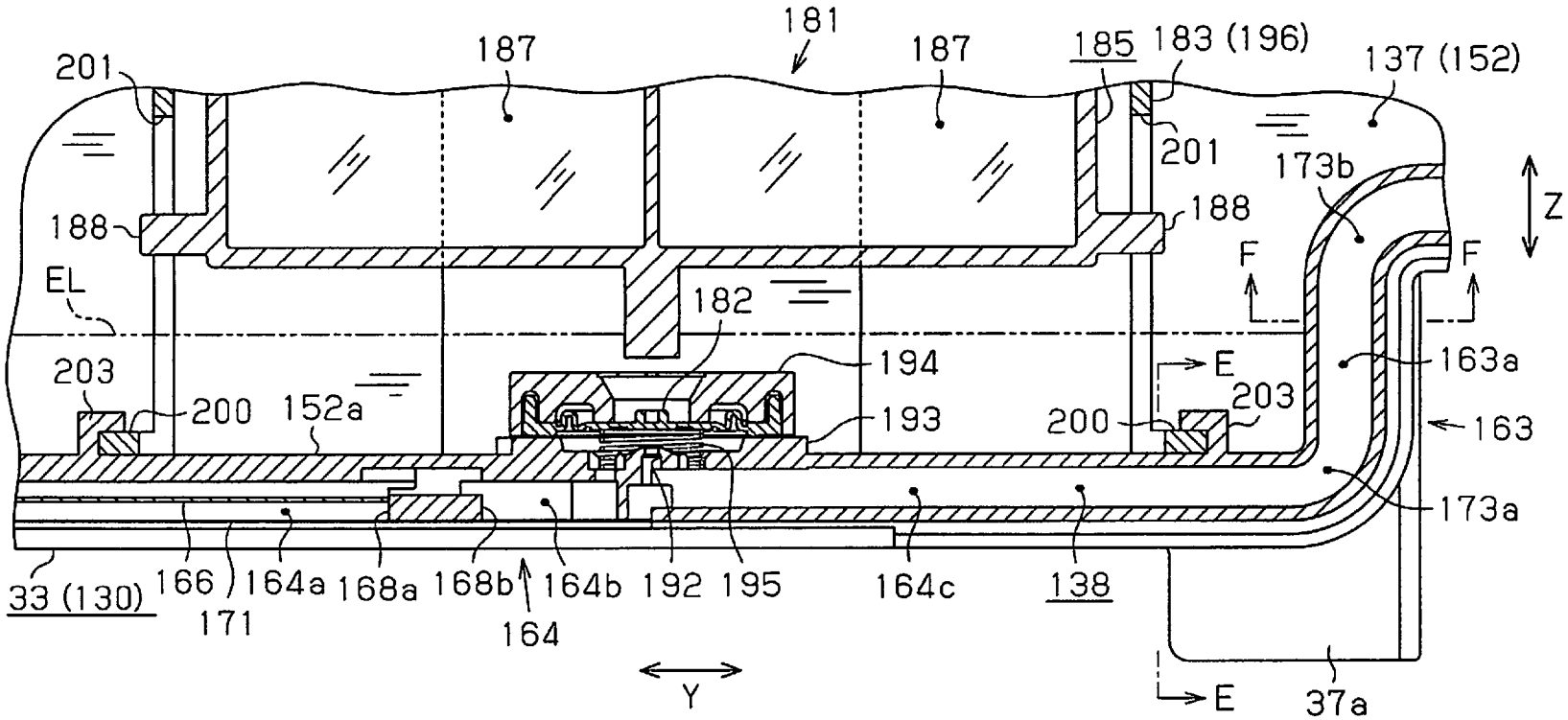
FIG. 19 is a partial cross sectional diagram of the accommodating body case.

As shown in FIG. 18 and FIG. 19, the coupling flow path section 164 is provided with a filter 166 with a substantially rectangular shape in a bottom surface view from the lower side. That is, the coupling flow path section 164 is divided by the filter 166 into a first coupling flow path section 164*a* on the flow path opening 162 side and a second coupling flow path section 164*b* more to the float valve 131 side than the filter 166. Furthermore, the coupling flow path section 164 is provided with a third coupling flow path section 164*c* which is coupled with the curved flow path section 163 more to the lead out port 69 side than the float valve 131.

As shown FIGS. 20A and 20B, the cross sectional area of the curved flow path section 163 is larger than the cross sectional area of the third coupling flow path section 164*c*. Here, the width of the lead out flow path 138 in the left and right direction X is substantially equal across the flow direction. As a result, a width L3 of the curved flow path section 163 in a direction (the front and back direction Y in a first long flow path section 163*a*), which is orthogonal with the flow direction (the first long flow path section 163*a* in FIG. 20B) and which is also orthogonal with the left and right direction X, is wider than a width L4 of the third coupling flow path section 164*c* in a direction (the up and down direction Z) which is orthogonal with the flow direction and which is also orthogonal with the left and right direction X. Furthermore, the cross sectional area of the inclined flow path section 165 is substantially equal to the cross sectional area of the curved flow path section 163. Accordingly, a width L5 (refer to FIG. 14) of the inclined flow path section 165 in a direction which is orthogonal with the flow direction and which is also orthogonal with the left and right direction X is wider than the width L4 of the third coupling flow path section 164*c*.

As shown in FIG. 18 and FIG. 21, a staged section 167 with a substantially rectangular shape which is recessed to the upper side which is the ink chamber 137 side is formed on the lower surface 40 close to the front side where the height of the accommodating body case 130 in the up and down direction Z is large. In addition, first to third flow path forming concave sections 168*a* to 168*c* are formed in the staged section 167 as a recess toward the ink chamber 137 side. In the first flow path forming concave section 168*a*, an other end side of a through hole 162*a* where one end is the flow path opening 162 is opened by being formed to pass through the bottom surface 152*a* of the second ink chamber 152. Furthermore, the first flow path forming concave section 168*a* is formed with different stages such that the inner side of a ring-shaped convex section 169 with a substantially rectangular shape is deeper compared to the outer side in a bottom surface view where the filter 166 is adhered. Furthermore, flow path convex sections 170 are formed at circumference edges of the first to third flow path forming concave sections 168*a* to 168*c*. That is, the through hole 162*a* and the ring-shaped convex section 169 are surrounded by the flow path convex sections 170.

Accordingly, the coupling flow path section 164 is formed by adhering the filter 166 to the ring-shaped convex section 169 and adhering (for example, heat welding) the flow path forming film 171 to the flow path convex section 170. That is, when the flow path forming film 171 is adhered to the flow path convex section 170, the first flow path forming concave section 168*a* functions as the first coupling flow path section 164*a* and the second coupling flow path section 164*b*. In addition, the second flow path forming concave section 168*b* functions as the second coupling flow path section 164*b*. Furthermore, the third flow path forming concave section 168*c* functions as the third coupling flow path section 164*c*. Then, a protective member 172 with a substantially rectangular plate shape which protects the flow path forming film 171 is attached to the staged section 167.

As shown in FIG. 14, the curved flow path section 163 is provided with at least one of (two in the present embodiment) long flow path sections 163*a* and 163*b* which extend along the up and down direction Z, a plurality of (four in the present embodiment) curved sections 173*a* to 173*d* which are formed at both ends of the long flow path sections 163*a* and 163*b*, and a cross flow path section 163*c* which extends along the front and back direction Y.

That is, the first curved section 173*a* joins the rear end of the third coupling flow path section 164*c* and the lower end of the first long flow path section 163*a* by being positioned at the lowest side. The second curved section 173*b* is positioned more to the upper side than the first curved section 173*a* and joins the upper end of the first long flow path section 163*a* and the front end of the cross flow path section 163*c*. The third curved section 173*c* joins the rear end of the cross flow path section 163*c* and the lower end of the second long flow path section 163*b*. The fourth curved section 173*d* joins the upper end of the second long flow path section 163*b* and the front end of the inclined flow path section 165. Accordingly, the curved flow path section 163 is bent with regard to the inclined flow path section 165 and the flow direction in which the ink flows is different to the inclined flow path section 165.

The inclined flow path section 165 is formed so as to extend along the direction which intersects with the front and back direction (the horizontal direction) Y such that an end section of the rear side which is the lead out port 69 side is positioned above (in the direction against gravity) the end section of the front side which is the side of the flow path opening 162 which continues onto the fourth curved section 173*d*. That is, the inclined flow path section 165 is an inclined surface which inclines continuously upward from the flow path opening 162 side toward the lead out port 69 side. Then, the inclined flow path section 165 is communicated with the lead out port 69 by the rear end side being curved upward.

Here, the lead out flow path 138 is positioned on the direction of gravity side of the second ink chamber 152 and extends along the bottom surface 152*a*. As a result, the bottom surface 152*a* of the second ink chamber 152 which is a portion which corresponds to the coupling flow path section 164 and the cross flow path section 163*c* is substantially horizontal, while the bottom surface 152*a* of the second ink chamber 152 which is a portion which corresponds to the inclined flow path section 165 is an inclined surface inclined downward toward the flow path opening 162 side.

Next, the float valve 131 will be described.

Figure 22:
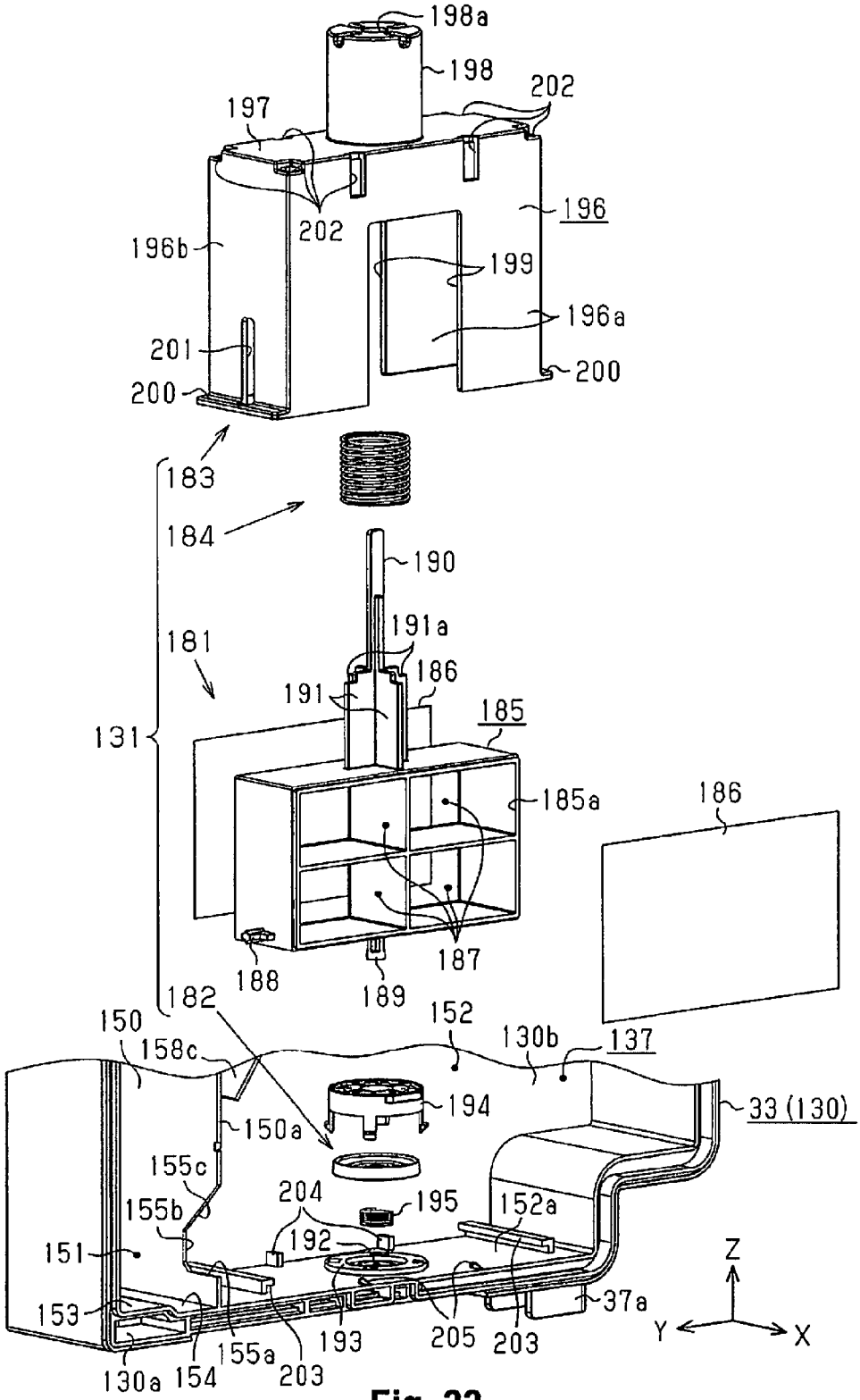
FIG. 22 is an exploded perspective diagram illustrating a portion of the accommodating case and each constituent member of a float valve.

As shown in FIG. 22, the float valve 131 has a float member 181 which is arranged inside the ink chamber 137, a valve body 182 which is arranged below the float member 181, a regulating case 183 which is an example of a regulating member which is arranged on the upper side of the float member 181, and a coil spring 184 which is an example of a pressing member which is arranged between the float member 181 and the regulating case 183. Here, in FIG. 22, in order to show a simplified attachment structure of the float valve 131 to the inside of the ink chamber 137, a portion of the accommodating body case 130 where the ink chamber 137 is formed is shown with each of the constituent members described above which configure the float valve 131.

Below, each of the constituent members of the float valve 131 will be described.

Firstly, the float member 181 has a frame body 185 with a rectangular shape where the inner side is divided into a plurality (four in the present embodiment) of space regions. For example, a thin film member 186 which is formed of a transparent film or the like is adhered in an opening section 185*a* of both left and right side surfaces of the frame body 185 along the front and back direction Y. As a result, a plurality (four in the present embodiment) of gas chambers 187 which are sealed are formed in the float member 181 at the inner side of the thin film member 186 by blocking the opening section 185*a* of the frame body 185 with the thin film member 186. Accordingly, due to buoyancy which is produced by the gas chambers 187, it is possible for the float member 181 to float in the up and down direction Z along with changes in the remaining amount of ink inside the ink chamber 137.

On the other hand, convex sections 188 which protrude in the front and back direction Y are each formed at the lower section of both front and the rear side surfaces along the left and right direction X where the opening section 185*a* is not formed in the frame body 185. In addition, a pushing section 189 with a substantially columnar shape is provided to project vertically downward from the center position of the lower surface in the frame body 185. In addition, a rod shaped section 190, which is arranged on the same axis as the pushing section 189 on the lower surface, is provided to project so as to extend to be long vertically upward from the center position of the upper surface in the frame body 185.

Furthermore, a plate shaped section 191, which has a cross shape in a plan view from above centered on the rod shaped section 190, is formed on the upper surface of the frame body 185 in the periphery of the rod shaped section 190 such that the protrusion length from the upper surface of the frame body 185 is substantially half the protrusion length of the rod shaped section 190. The size of the cross section cross shape of the plate shaped portion 191 is formed to be larger than the outer diameter dimension of the coil spring 184. Then, a spring seat 191*a* for placing and supporting the coil spring 184 is formed by being cut away in a rectangular shape at a front end edge of the upper end section of the plate shaped section 191 with the cross section cross shape in a radial direction from the rod shaped section 190.

Next, the valve body 182 is a diaphragm valve with a substantially circular plate shape, which is formed of an elastomer or the like which has flexibility, and is arranged at a position which is above a valve port 192 (refer to FIG. 19 and the like) which formed as an opening in the bottom surface 152*a* of the second ink chamber 152 so as to be positioned in the lead out flow path 138 at a boundary between the second coupling flow path section 164*b* and the third coupling flow path section 164*c*. That is, there is a configuration where an attachment seat 193 with an annular shape which surrounds the valve port 192 is formed on the bottom surface 152*a* of the second ink chamber 152 and an attachment tool 194 with the same annular shape is fastened from above with regard to the attachment seat 193, and the valve body 182 is arranged at a position which is above the valve port 192 in a state of being interposed between the attachment seat 193 and the attachment tool 194.

In addition, a coil spring 195 which functions as a second pressing member which has a second pressing force is arranged on the inner side of the attachment seat 193 so as to always abut with the valve body 182 from below when the coil spring 184 described above is a first pressing member which has a first pressing force. Then, due to the coil spring 195, the valve body 182 is always pressed toward the open valve position (the position shown in FIG. 19 and FIG. 28) which opens the lead out flow path 138 by upward separating from the valve port 192.

Here, the following force relationship is set on the premise that, in the force relationship between the first pressing force of the coil spring 184 and the second pressing force of the coil spring 195, the first pressing force of the coil spring 184 is larger than the second pressing force of the coil spring 195.

Figure 28:
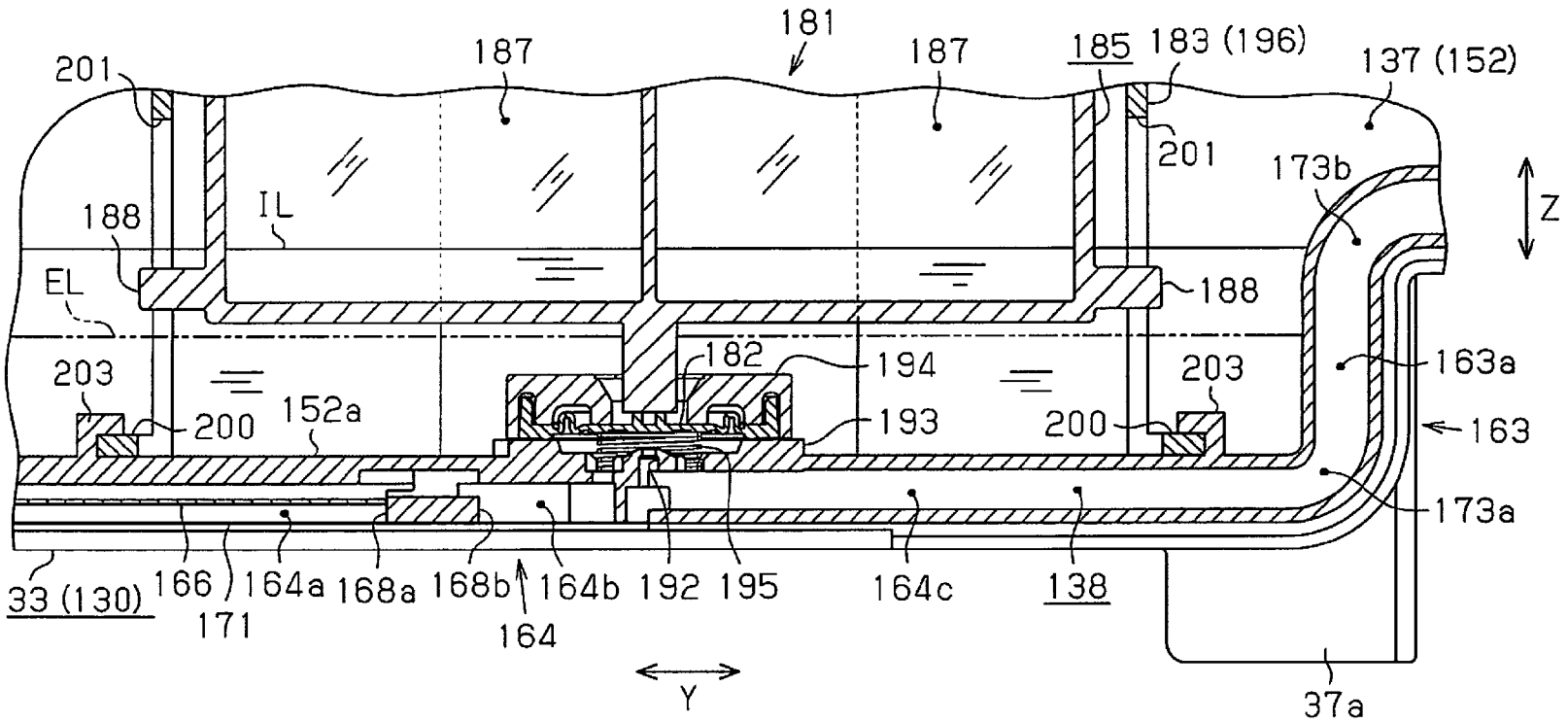
FIG. 28 is a partial cross sectional diagram illustrating a state of the float valve when a remaining amount of ink approaches a threshold remaining amount.
Figure 29:
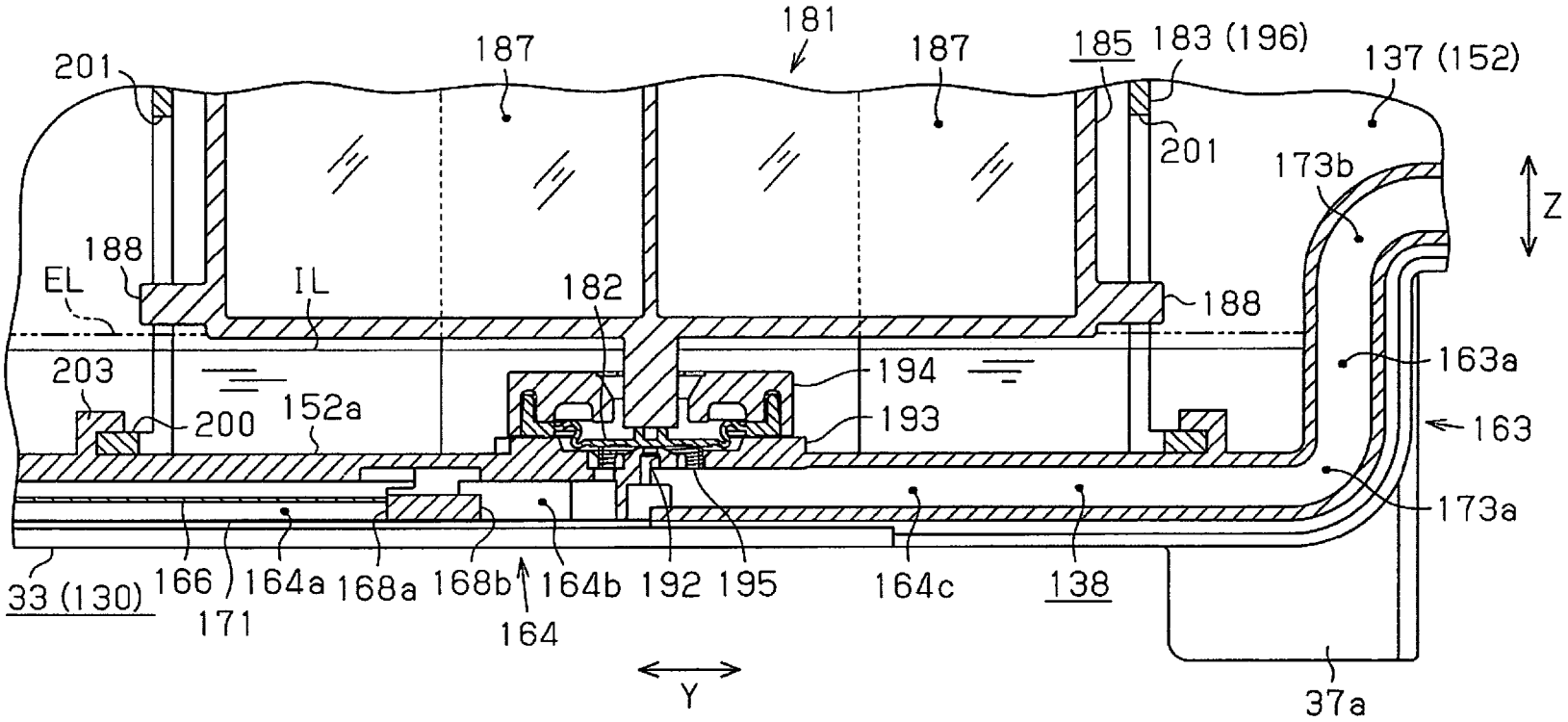
FIG. 29 is a partial cross sectional diagram illustrating a state of the float valve when the remaining amount of ink is less than the threshold remaining amount.

That is, for example, as shown in FIG. 29, in a case where the remaining amount of ink inside the ink chamber 137 is less than a threshold remaining amount which is a small remaining amount which is set in advance, the sum of the buoyancy of the float member 181 which floats in the remaining ink at this time and the second pressing force of the coil spring 195 is set so as to be smaller than the first pressing force of the coil spring 184. On the other hand, for example, as shown in FIG. 19 and FIG. 28, in a case where the remaining amount of the ink inside the ink chamber 137 is the threshold remaining amount or more, the sum of the buoyancy of the float member 181 which floats in the remaining ink at this time and the second pressing force of the coil spring 195 is set so as to be equal to or more than the first pressing force of the coil spring 184.

Next, the regulating case 183 has a box shape where the bottom is opened which is formed by having a ring-shaped wall section 196 which has a square ring shape where it is possible to insert and remove the float member 181 in the up and down direction Z and an upper wall section 197 which closes the upper opening of the ring-shaped wall section 196. That is, the ring-shaped wall section 196 is formed with a ring shape which is able to surround the periphery of a floating region in the float member 181 in the up and down direction Z with gaps with the side wall of the float member 181.

In addition, a cylindrical section 198 where the upper opening is closed is formed in the center position of the upper wall section 197 so as to pass through the inner section space of the ring shape wall section 196 and the lower opening of the cylindrical section 198. Then, an insertion hole 198*a* where it is possible to insert the rod shaped section 190 which protrudes upward from the upper surface of the float member 181 is formed to pass through the upper wall section of the cylindrical section 198. In addition, a spring seat (which is not shown in the diagram) which opposes the spring seat 191*a*, which is formed by being cut away from the plate shaped section 191 on the float member 181 side, in the up and down direction Z is formed to bulge downward in the upper wall section of the cylindrical section 198 in a part which has a cross shape in a plan view from above centered on the insertion hole 198*a*.

In addition, the ring-shaped wall section 196 of the regulating case 183 is an opposing part which opposes the thin film member 186 of the float member 181 in a state where each of the side walls 196*a* at the left and right along the front and back direction Y is assembled with each of the constituent members of the float valve 131. Then, a cut away section 199 with a rectangular shape which extends along the up and down direction Z where the float member 181 floats is formed by being cut away from the lower end edge to the upper part of each of the side walls 196*a* substantially in the center of each of the side walls 196*a* at the left and right in the front and back direction Y. The cut away section 199 is formed into a shape where the width dimension of the cut away section 199 in the front and back direction Y is larger than the outer diameter dimension of the cylindrical section 198 of the upper wall section 197 and the height dimension of the cut away section 199 in the up and down direction Z is larger than the height dimension of the frame body 185 in the float member 181 in the up and down direction Z.

Furthermore, a flange section 200 with a strip shape which has a predetermined width in the front and back direction Y is formed from the lower end section of each of the side walls 196*b* at the front and rear in the ring-shaped wall section 196 of the regulating case 183 along the left and right direction to protrude horizontally to the front and the rear. Then, a guide slot 201 where it is possible to insert a convex section 188 on the float member 181 side is formed along the up and down direction Z from a position which is substantially the center of the flange section 200 in the left and right direction X and the substantially the center of the flange section 200 in the front and back direction Y to a position which is slightly below the substantial center of each of the side walls 196*b* in the up and down direction Z. In addition, holes 202 which permit the passage of ink by communicating the inside and outside of the regulating case 183 are each formed in the regulating case 183 at parts from each of two locations on both the left and right long sides of the upper wall section 197 to an upper end section of each side wall 196*a* at the left and right of the ring-shaped wall section 196 and parts which are the four corners of the upper end section of the ring-shaped wall section 196.

Next, the coil spring 184 is arranged between the float member 181 and the regulating case 183 to able to contract in the up and down direction Z. That is, by inserting the rod shaped section 190 of the float member 181 from below into the inner side of the coil spring 184, the coil spring 184 is placed on the spring seat 191*a* which is formed at the upper end of the plate shaped section 191 in the periphery of the rod shaped section 190. Then, from this state, the upper end of the coil spring 184 abuts with a spring seat (which is not shown in the diagram) which is formed to bulge downward from the upper wall of the cylindrical section 198 of the regulating case 183 when the frame body 185 is inserted from below into the ring-shaped wall section 196 while the rod shaped section 190 of the float member 181 is inserted into the insertion hole 198*a* of the cylindrical section 198 in the regulating case 183.

Then, so that the coil spring 184 is further contracted from this state, the float valve 131 is accommodated in the accommodating body case 130 by the regulating case 183 where the float member 181 is inserted being attached to the bottom surface 152*a* of the second ink chamber 152 of the ink chamber 137 while the state, where the float member 181 is pressed to the inside of the regulating case 183, is maintained.

Next, the attachment structure of the float valve 131 in the accommodating body case 130 will be described.

As shown in FIG. 22, a fastening rail section 203 with an inverted L cross sectional shape, where it is possible to insert each flange section 200 at the front and rear of the regulating case 183 by sliding in the left and right direction X, is formed in the accommodating body case 130 at the bottom surface 152*a* of the second ink chamber 152 at two positions of the front and rear which interpose the attachment seat 193 of the valve body 182 by being spaced at a distance which corresponds to the dimension of the regulating case 183 in the front and back direction Y. In addition, a position aligning section 204, which is able to abut with the side wall 196*a* which is the far side out of the left and right side walls 196*a* along the front and back direction Y of the regulating case 183 which moves by sliding toward the far side of the accommodating body case 130 in a state where the flange sections 200 are inserted in the fastening rail sections 203, is formed at two positions of the front and rear which are the far side of the accommodating body case 130 between each of the fastening rail sections 203 and the attachment seat 193.

Furthermore, protrusion sections 205, which are able to be fastened from the front side which is the opening side of the accommodating body case 130 at the lower end section of the side wall 196*a* which is the front side of the regulating case 183 where the side wall 196*a* which is the far side abuts with the position aligning section 204, are formed in the bottom surface 152*a* of the second ink chamber 152 at two positions at the front side which corresponds to the position aligning section 204 which is the far side in the left and right direction. The protrusion sections 205 are structural bodies which are able to elastically change shape and extend diagonally upward to the far side of the accommodating body case 130, and the protrusion sections 205 are provided with an inclined posture such that it is possible for the lower end edges of each of the side walls 196*a* to ride over the protrusion sections 205 while being slid from the front side to the far side when the regulating case 183 moves by sliding to the far side by the flange section 200 being inserted into the fastening rail section 203. Then, due to being fastened with the surface of the front sides of the side walls 196*a* by being elastically restored to the original inclined posture after being ridden over by the side walls 196*a* which are the front side, the regulating case 183 does not come out to the front side from the far side of the accommodating body case 130.

Next, operation of the liquid holding container 21 of the present embodiment will be described. Here, in FIGS. 24A, 24B, and 24C, the slider 34 and the liquid accommodating body 33 are omitted from the diagrams.

Figure 23:
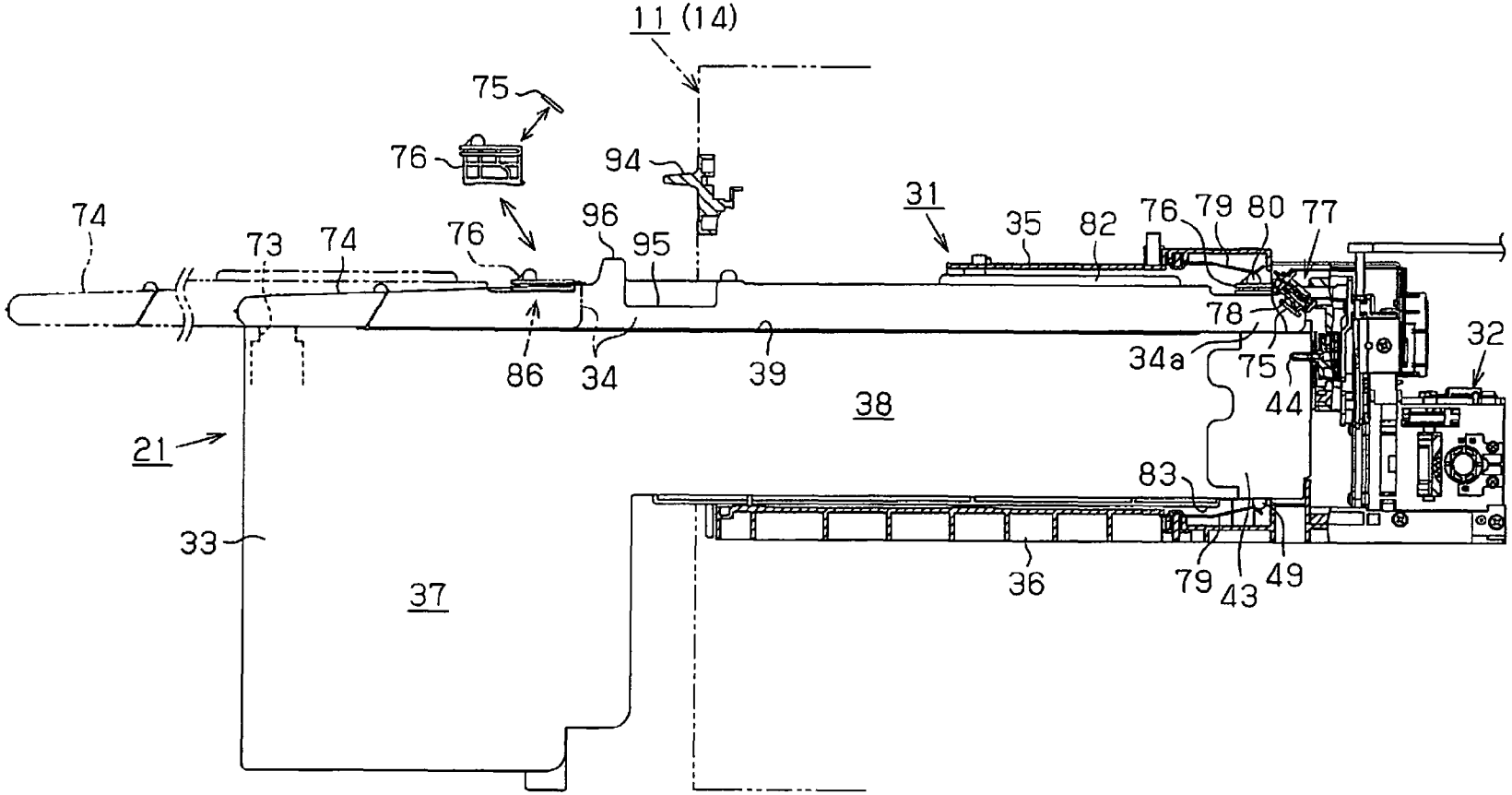
FIG. 23 is an explanatory diagram of an operation of the slider in the liquid holding container which is mounted onto the holder.

As shown in FIG. 23, engagement of the sliding knob 94 with the concave section 95 of the slider 34 is eliminated when the sliding knob 94 is displaced upward in the liquid holding container 21 which is fixed to the printer 11 so as to be not able to move by a portion of the second accommodating body section 38 being positioned inside the mounting section 31. By doing this, it is possible for the user to take out the slider 34 from the printer 11 (the mounting section 31) by sliding the slider 34 in the direction which is opposite to the insertion direction along the longitudinal direction of the slider 34.

By such taking out, a part of the slider 34 which is positioned inside the printer 11, that is, a part which overlaps with a part (the second part) of the slider 34, which is positioned inside the printer 11 in the second accommodating body section 38 which includes the connecting section 43 out of the upper surface 39 of the liquid accommodating body 33, is moved outside of the printer 11. In the present embodiment, as shown by the two-dot chain line in FIG. 23, the slider 34 moves the chip holder 76 which is attached to the end section 34*a* which is the far side in the insertion direction of the slider 34 to a position where it is possible for the user to take out the chip holder 76 from the holder attachment section 86 of the slider 34 outside the printer 11. Accordingly, the part of the slider 34 which overlaps with the part (the second part), which is positioned inside the printer 11 in the second liquid accommodating body section 38 which includes the connecting section 43 out of the upper surface 39 of the liquid accommodating body 33, functions as a moving part which moves between the inside of the printer 11 and the outside of the printer 11.

As a result, the user detaches the chip holder 76 which is moved to the outside of the printer 11 by taking out the chip holder 76 from the slider 34 (the holder attachment section 86). Then, for example, in a case where there is the recording chip 75 which is already placed on the chip holder 76, the recording chip 75 is replaced with the recording chip 75 which records relationship information (for example, hue, saturation, and brightness of ink, density of the ink, the types of solute of the ink, and the like) which relates to inks which are introduced from the inlet port 73 with regard to the liquid accommodating body 33. Then, after the chip holder 76 where the replaced recording chip 75 is placed is attached by being inserted again into the slider 34 (the holder attachment section 86), the user inserts the slider 34 inside the printer 11 (the mounting section 31) along the upper surface 39 of the liquid accommodating body 33.

Due to insertion of the slider 34, the chip holder 76 is electrically connected by coming into contact with the electric terminal 78 of the communication section 77 where the recording chip 75, which is placed to be inclined with regard to the insertion direction, is provided in the supply section 32, and the relationship information which is recorded in the recording chip 75 is transmitted to the printer 11 side. During this connection, the recording chip 75 is positionally aligned with regard to the electric terminal 78. In a state where the relationship information which is recorded in the recording chip 75 is transmitted to (read by) the printer 11 side, the chip holder 76 is positioned at an inner section of the printer 11 and a portion (the first part) of the slider 34 is positioned on an outer side of the printer 11. In other words, in a state where the relationship information which is recorded in the recording chip 75 is read by the printer 11 side, the recording chip 75 and the chip holder 76 are positioned at positions which it is not possible for the user to touch by hand.

Figure 24A:
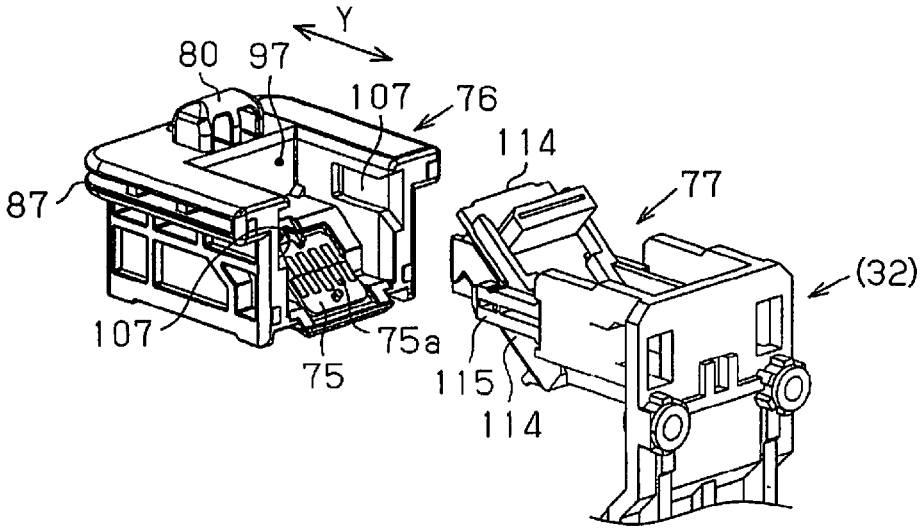
FIG. 24A is a perspective diagram illustrating the chip holder and a communication section prior to engagement.

That is, as shown in FIG. 24A, the communication section 77 which is provided in the supply section 32 is provided with a terminal section 114 which is provided with the electric terminal 78 which comes into contact with the plurality of electrodes 75*a* which are formed in the recording chip 75, and protrusion shaped sections 115 which protrude in the lateral direction and extend in the insertion direction at both sides in the lateral direction. The terminal section 114 engages with the concave section (the engagement section) 97 of the chip holder 76 and the protrusion shaped sections 115 engage with groove shaped sections 107 of the chip holder 76. The concave section 97 is a surface of a wall which configures the chip holder 76 and is formed on the surface of the recording chip 75 side.

Figure 24B:
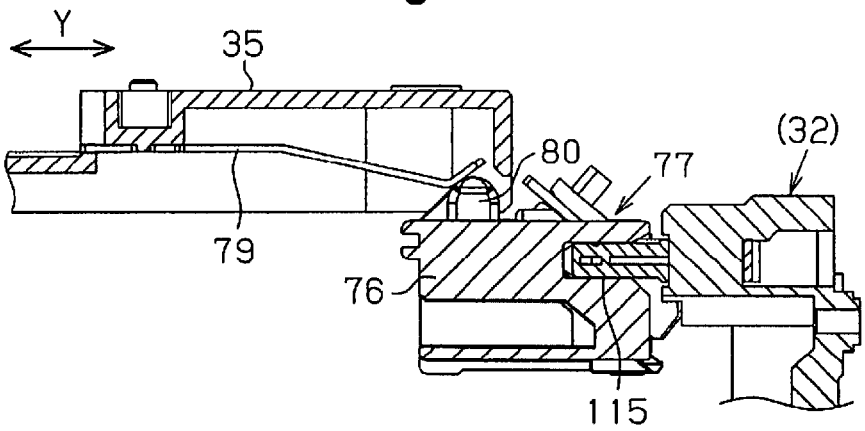
FIG. 24B is a side surface diagram illustrating an engagement state of the chip holder and the communication section as a partial cross section.

At this time, as shown in FIG. 24B, when the slider 34 is inserted into the mounting section 31, the chip holder 76 is moved toward the communication section 77 while the protrusion parts 80 are pressed downward by the plate spring 79 which is fixed to the upper frame 35 so as to not separate from the slider 34. With this movement, the chip holder 76 is engaged by inserting the protrusion shaped section 115 of the communication section 77 into the groove shaped section 107 by being guided by the chamfered section 106, and the chip holder 76 is positionally aligned with regard to the communication section 77. In this point, the groove shaped section 107 of the chip holder 76 functions as an example of a position aligning shape section which is positionally aligned in the printer 11.

Figure 24C:
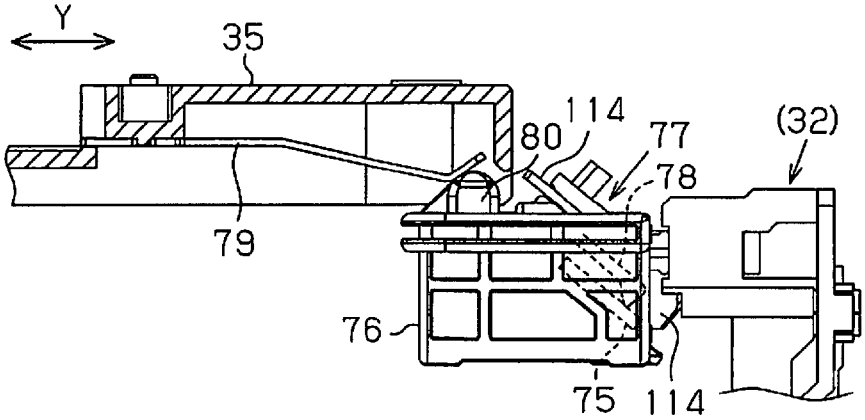
FIG. 24C is a side surface diagram illustrating the chip holder and the communication section after engagement.

As a result, as shown in FIGS. 24A and 24C, the recording chip 75 which is placed in the chip holder 76 is positionally aligned with regard to the terminal section 114 of the communication section 77, and the plurality of electric terminals 78 which are provided in the terminal section 114 appropriately come into contact with the plurality (here, nine) of electrodes 75*a* in the recording chip 75. Here, since the electrodes 75*a* of the recording chip 75 are in a state of being inclined downward in the insertion direction during this contact, the electric terminals 78 come into contact while rubbing with the surface of the electrode 75*a*.

Next, an operation relating to introduction of ink in the liquid holding container 21 will be described.

Here, when ink is introduced into the liquid accommodating body 33, the opening and closing cover 74 is displaced to the open lid position as shown in FIG. 9A and the inlet port 73 is exposed by placing the covering body 120 at the rear surface 74*a* of the opening and closing cover 74 as shown in FIG. 9B.

At this time, after the user detaches the covering body 120 from the inlet port 73, the covering body 120 is placed at the rear surface 74*a* of the opening and closing cover 74 by rotating the covering member 121 at an arbitrary angle (180 degrees in the present embodiment) with regard to the liquid receiving surface 116 with the fixing section 123 as the rotation center. In addition, in the state shown in FIG. 9B, since the rear surface 74*a* of the opening and closing cover 74 is positioned at a position which is higher than liquid receiving surface 116 in the up and down direction Z, the coupling section 125 is in a slightly extended state in a state where the covering body 120 is placed at the rear surface 74*a* of the opening and closing cover 74. By doing this, the restoring force according to elastic shape changing (extending) of the coupling section 125 operates on the covering body 120 from the opening and closing cover 74 toward the front. In this point, since the covering body 120 abuts with the hook part 110 of the opening and closing cover 74 in the present embodiment, the covering body 120 is suppressed from falling or the like from the opening and closing cover 74. In addition, since the rear surface 74*a* of the opening and closing cover 74 which is positioned at the open lid position is in a state where the side where the hook part 110 is formed is the lowest, ink is suppressed from spreading on the entire surface (in particular, to a region to the rear) of the opening and closing cover 74 even when, for example, the covering body 120 where ink is attached is placed at the rear surface 74*a* of the opening and closing cover 74.

Figure 25:
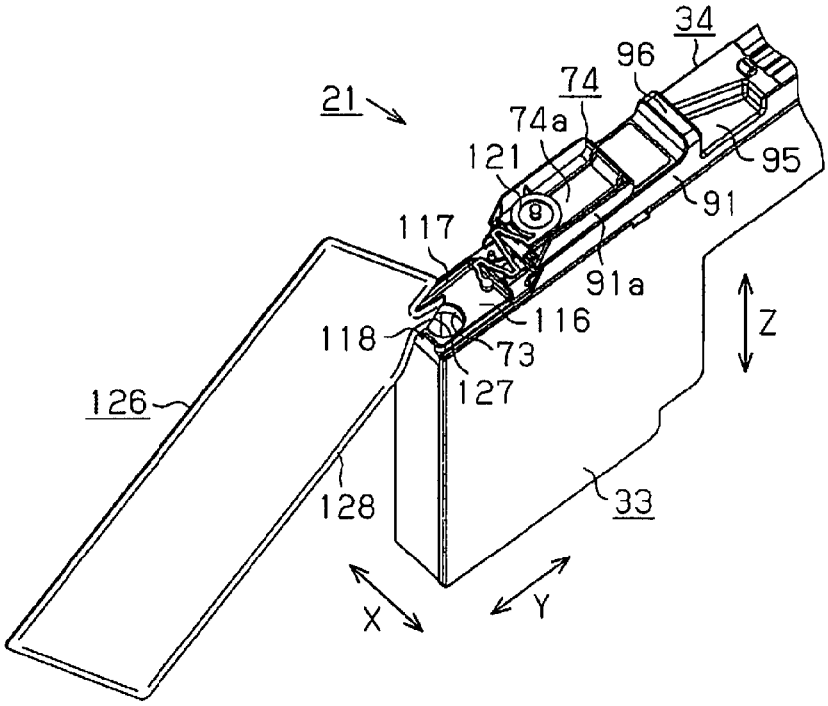
FIG. 25 is a perspective diagram illustrating a positional relationship of the liquid holding container and a liquid accommodating source when ink is introduced.
Figure 26:
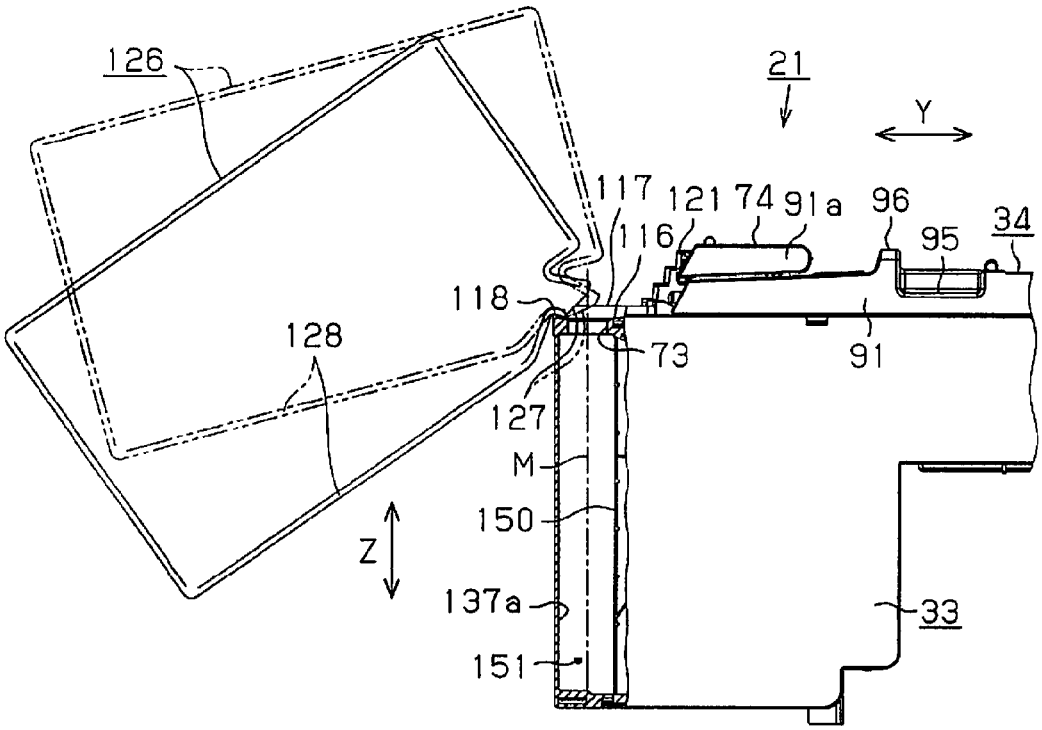
FIG. 26 is a partial cross sectional side surface diagram illustrating the positional relationship of the liquid holding container and the liquid accommodating source when ink is introduced.

Then, as shown in FIG. 25 and FIG. 26, an edge section 128 of the superimposed film or the like is welded and ink is introduced into the liquid accommodating body 33 from the liquid introduction source 126 where a pouring spout 127 is formed. When ink is introduced, the liquid introduction source 126 is positionally aligned with regard to the liquid accommodating body 33 by the edge section 128 in the vicinity of the pouring spout 127 of the liquid introduction source 126 being inserted into and abutting with the cut away groove 118 which is formed in the circumference wall section 117 of the liquid accommodating body 33. Then, as shown in FIG. 26, ink inside the liquid introduction source 126 is introduced into the inside of the first ink chamber 151 via the inlet port 73 of the liquid accommodating body 33 by the liquid introduction source 126 being inclined such that the pouring spout 127 of the liquid introduction source 126 faces downward with the point of abutting of the liquid introduction source 126 and the liquid accommodating body 33 as the center of inclination.

At this time, when the user vigorously tilts the liquid introduction source 126, there are cases where ink which flows out from the pouring spout 127 of the liquid introduction source 126 deviates from the inlet port 73 and is poured into the periphery of the inlet port 73 in the liquid receiving surface 116. Even in these cases, by the circumference wall section 117 which surrounds the periphery of the liquid receiving surface 116 stopping ink which is poured onto the liquid receiving surface 116, ink is suppressed from flowing out from the liquid receiving surface 116 to the outer side. Then, since the liquid receiving surface 116 is inclined downward toward the inlet port 73 in the left and right direction X and the front and back direction Y, ink which is attached to the liquid receiving surface 116 is guided to the inlet port 73 along the inclination of the liquid receiving surface 116.

When introduction of ink is finished, the introduction operation is completed by the inlet port 73 of the liquid accommodating body 33 being covered by the covering body 120 which is placed at the rear surface 74*a* of the opening and closing cover 74 as shown in FIG. 9A and the opening and closing cover 74 being displaced to the closed lid position as shown in FIG. 2.

Figure 27:
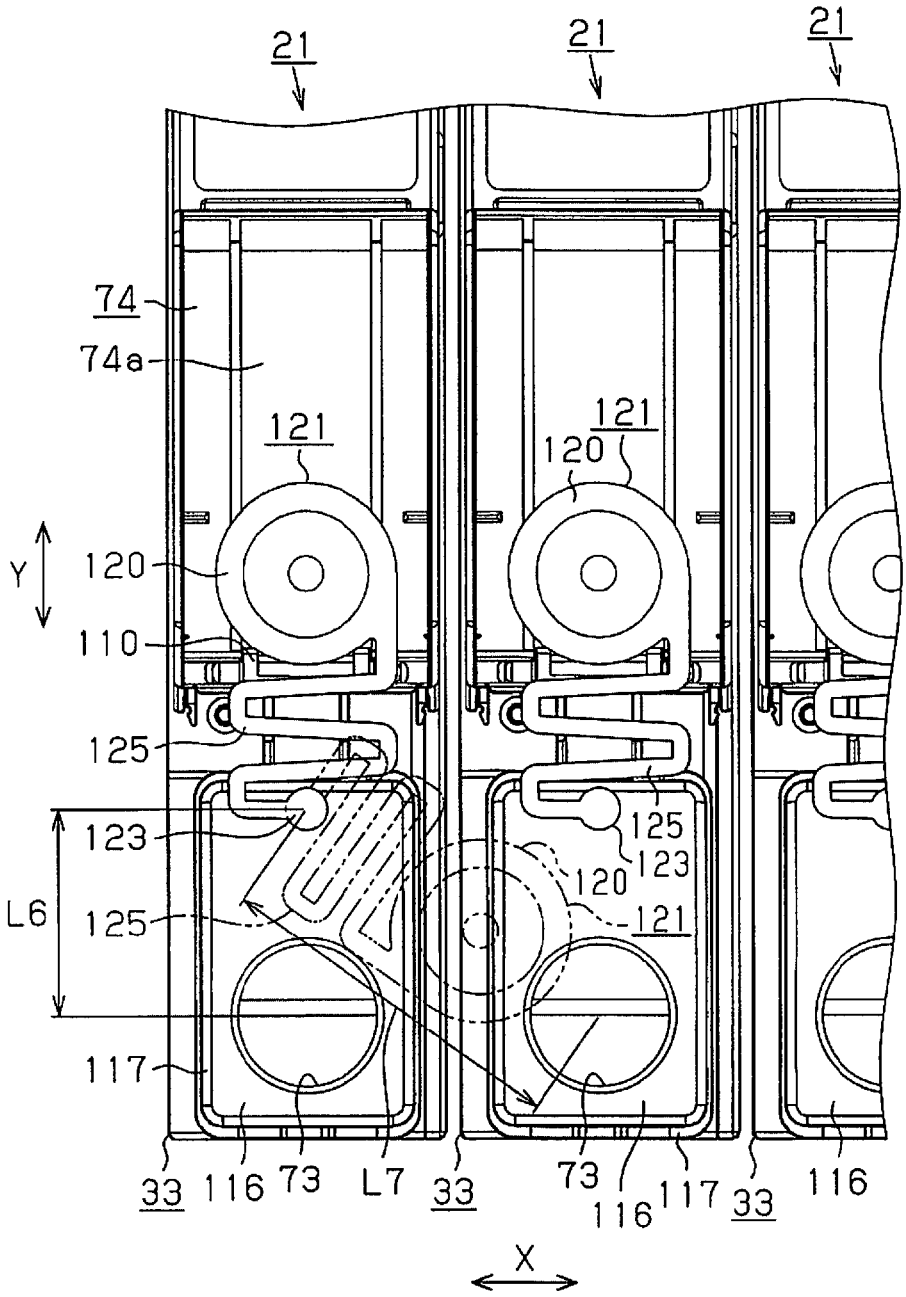
FIG. 27 is a planar diagram illustrating a rotation range of a cover member, which is provided in the liquid holding container, centered on a fixing section.

In addition, as shown in FIG. 27, in a state where a plurality of liquid holding containers 21 are used by being provided in parallel, a distance L6 from the fixing section 123 (the fixing hole 124) of the covering member 121 to the inlet port 73 in one liquid holding container 21 (for example, the left end) is shorter than a distance L7 from the fixing section 123 in one liquid holding container 21 to the inlet port 73 in an other liquid holding container 21 which is provided in parallel with the one liquid holding container 21. By doing this, as shown in FIG. 27, it is not possible for the covering body 120 to cover the inlet port 73 even when the covering body 120 of the covering member 121, which is provided to correspond to the liquid accommodating body 33 which is positioned at the left end, faces toward the inlet port 73 of the liquid accommodating body 33 which is provided in parallel with the fixing section 123 as the center of rotation (shown by the two-dot chain line in FIG. 27). Here, the distances L6 and L7 indicate the distances where the center positions of the fixing sections 123 (the fixing holes 124) and the inlet ports 73 are joined in a plan view as shown in FIG. 27.

Next, an operation inside the liquid accommodating body 33 when ink is introduced from the inlet port 73 will be described.

Here, as shown in FIG. 14, when ink is introduced from the inlet port 73, the liquid surface in the first ink chamber 151 is raised and ink flows into the second ink chamber 152 via the wall communicating opening 155. Here, since the concave section 154 which is formed in the first ink chamber 151 is formed to be shifted to a position from the inlet port 73 in the front and back direction Y, the foreign matter is suppressed from rising up even in a case where foreign matter is deposited in the concave section 154.

Here, the first ink chamber 151 and the second ink chamber 152 are communicated via the wall ventilation opening 156. As a result, since the pressure inside the first ink chamber 151 and the second ink chamber 152 is substantially the same, the liquid surfaces of ink in the first ink chamber 151 and the second ink chamber 152 rise so as to be substantially the same heights as each other in the up and down direction Z.

Since rib communicating openings 161 are formed at both ends in the third diagonal rib section 158*c* and the fourth diagonal rib section 158*d*, ink passes through the rib communicating opening 161 and the liquid surfaces of ink are positioned at substantially the same position at both sides of the third diagonal rib section 158*c* and the fourth diagonal rib section 158*d*. Furthermore, ink passes through gaps which are formed between the first diagonal rib section 158*a*, the second diagonal rib section 158*b*, and the film 133, and the liquid surface of ink is moved to a position which is above the first diagonal rib section 158*a* and the second diagonal rib section 158*b*. Then, when the liquid surface of ink is further raised, ink spreads so as to rise over the bottom surface 152*a* which is inclined and the liquid surface is raised by ink passing through the rib communicating openings 161 of the fourth to ninth intersecting rib sections 157*d* to 157*i*.

Furthermore, the rib ventilation openings 160 are formed in each of the intersecting rib sections 157*a* to 157*i*. As a result, the pressure in the spaces in the second ink chamber 152 on both sides of the intersecting rib sections 157*a* to 157*i* is substantially the same. As a result, the liquid surfaces of ink in the second ink chamber 152 are also raised to be substantially the same heights as each other in the up and down direction Z.

Here, in the liquid accommodating body 33 which has the inlet port 73, there are cases where foreign matter such as dirt and dust is mixed in from the inlet port 73 and the foreign matter itself is deposited or ink is dried or the like at a gas-liquid interface such that the ink itself becomes foreign matter. Here, the foreign matter is deposited in the first ink chamber 151 at the bottom surface 153 and the concave section 154. Then, since the wall communicating opening 155 is formed to be separated from the concave section 154, taking in of foreign matter is suppressed compared to the inflow of ink to the second ink chamber 152. That is, it is easy for foreign matter which entered from the inlet port 73, in particular, foreign matter with a large size or foreign matter with a large weight to remain in the first ink chamber 151.

In addition, foreign matter is deposited at the diagonal rib sections 158*a* to 158*d* in the region which is the front side in the second ink chamber 152 along with the passage of time, and foreign matter is deposited at the bottom surface 152*a* in the region which is the rear side. Then, since the diagonal rib sections 158*a* to 158*d* and the bottom surface 152*a* where foreign matter is deposited are inclined so as to intersect with the front and back direction Y, foreign matter which is deposited is moved in one direction (the downward direction) according to the movement of the liquid surface when the liquid surface of ink falls due to ink being led out from the lead out port 69.

Furthermore, when ink is introduced from the inlet port 73, there are cases where bubbles enter along with introduction of ink. Then, when the bubbles enter into the second ink chamber 152 or dissolved gas becomes bubbles in the second ink chamber 152, the bubbles move upward and reach the diagonal rib sections 158*a* to 158*d*. In this point, since the diagonal rib sections 158*a* to 158*d* intersect with regard to the front and back direction Y in the present embodiment, the bubbles are directed to the liquid surface by being moved along the diagonal rib sections 158*a* to 158*d* which are inclined.

In addition, ink in the second ink chamber 152 is led out from the lead out port 69 by flowing from the flow path opening 162 into the leading out flow path 138. That is, first, foreign matter and bubbles in ink which is led out from the flow path opening 162 are trapped by the filter 166. After this, ink flows into the curved flow path section 163 via the second coupling flow path section 164*b* and the third coupling flow path section 164*c*.

Here, since the ink flow direction changes in the curved flow path section 163, it is easy for the gas which is dissolved in the ink to turn into bubbles. In this point, since the cross sectional area of the curved flow path section 163 is large compared to the cross sectional area of the third coupling flow path section 164*c* according to this configuration, bubbles which are generated are moved to the inclined flow path section 165 side along with the flow of ink. Furthermore, the cross sectional area of the inclined flow path section 165 is larger than the cross sectional area of the third coupling flow path section 164*c* and is an inclined surface which inclines upward toward the lead out port 69 side. Therefore, bubbles which are generated in the curved flow path section 163 move to the lead out port 69 side along the inclined flow path section 165 and are led out from the lead out port 69 along with ink.

Next, the operation of the float valve 131 will be described.

Here, the state shown in FIG. 19 indicates a state where a liquid surface IL of ink inside the ink chamber 137 is equivalent to or above a threshold remaining time line EL, that is, a state where the remaining amount of ink inside the ink chamber 137 is sufficient for what is necessary to continue printing by ejecting ink from the liquid ejecting head 24 with regard to paper S. As a result, in the state shown in FIG. 19, since the sum of the second pressing force of the coil spring 195 and the buoyancy of the float member 181 is equal to or more than the first pressing force of the coil spring 184, the valve body 182 does not abut with the valve port 192 due to the float member 181 being pressed downward by the first pressing force of the coil spring 184.

That is, in this case, as shown in FIG. 19, there is a state where the sum of the buoyancy which is produced by each of the gas chambers 187 of the float member 181 is greater than the first pressing force of the coil spring 184, and the float member 181 is in a state of being suspended at a position which is separated upward from the valve body 182. On the other hand, since the valve body 182 is not pushed downward from the coil spring 184 via the float member 181, the valve body 182 is positioned at an open valve position where the lead out flow path 138 is open by being separated upward from the valve port 192 by receiving only the upward second pressing force from the coil spring 195.

Then, when the remaining amount of ink inside the ink chamber 137 gradually decreases and the ink liquid surface line IL approaches the threshold remaining amount time line EL due to continuing of printing from the state which is shown in FIG. 19, the sum of the buoyancy of the float member 181 and the second pressing force of the coil spring 195 is in a state of being balanced with the first pressing force of the coil spring 184 as shown in FIG. 28. As a result, the float member 181 is pushed downward by the first pressing force of the coil spring 184, and the pushing section 189 on the lower surface of the float member 181 is in a state of abutting with the valve body 182 which is in the open valve position from above. Here, at this time, the float member 181 abuts with the valve body 182 from above, but the valve body 182 is not yet displaced toward the lower closed valve position.

Then, when the remaining amount of the ink inside the ink chamber 137 is further decreased and the ink liquid surface line IL is lower than threshold remaining amount time line EL due to further continuing of printing from the state shown in FIG. 28, the sum of the buoyancy of the float member 181 and the second pressing force of the coil spring 195 is smaller than the first pressing force of the coil spring 184 as shown in FIG. 29. As a result, the float member 181 is further pushed downward by the first pressing force of the coil spring 184, and the valve body 182 which is in the open valve position is pushed downward by the pushing section 189 on the lower surface of the float member 181. As a result, the valve body 182 is displaced to the open valve position where the valve port 192 is closed.

By doing this, the lead out flow path 138 is closed since the valve port 192 is blocked, and ink does not flow to the downstream side of the valve port 192. Therefore, as a result of ink not flowing inside the liquid chamber 53 which is disposed more to the downstream side than the lead out flow path 138, the sensor 68 detects that the remaining amount of the ink is less than the threshold remaining amount since a state, where the light is interrupted between the light generating section and the light receiving section of the sensor 68, is maintained due to the remaining amount detection rod 45 being moved. Then, when the ink is newly introduced from the inlet port 73 into the inside of the ink chamber 137 due to receiving of the detection result, the buoyancy of the float member 181 is greater than the first pressing force of the coil spring 184 and the float member 181 floats so as to separate upward from the valve body 182 since the ink liquid surface IL inside the ink chamber 137 is again above the threshold remaining amount time line EL.

At this time, in a case where the valve body 182 which is at a closed valve position where the valve port 192 is blocked by being pushed downward by the pushing section 189 of the float member 181 which is pressed downward due to the first pressing force of the coil spring 184 is in the closed valve position state for a long time, there are cases where the valve body 182 is in a state of being stuck with regard to the valve port 192 even after the pushing from above by the float member 181 is eliminated. In this point, in the case of the present embodiment, since the second pressing force of the coil spring 195 presses the valve body 182 which is at the closed valve position toward the upper open valve position, the valve body 182 is released from the state of being stuck by being peeled off from the valve port 192 even when, for example, the valve body 182 is temporarily stuck to the valve port 192.

In addition, when the ink is vigorously introduced from the inlet port 73 to the inside of the ink chamber 137, there is a possibility that the ink inflow pressure into the ink chamber 137 during introduction will also be strong. As a result, there is a risk that the thin film member 186 which forms the gas chambers 187 by blocking the opening section 185*a* of the frame body 185 in the float valve 131 may suffer damage when such a strong inflow pressure is directly applied. In this point, in the case of the present embodiment, the float valve 131 is arranged inside the second ink chamber 152 which is partitioned by the partition wall 150 from the first ink chamber 151 where the inlet port 73 is formed. As a result, ink which is introduced from the inlet port 73 falling directly onto the float valve 131 from above is avoided.

In addition, there is a risk that the thin film member 186 of the float member 181 in the float valve 131 will suffer damage due to the inflow pressure even in a case where ink flows vigorously in from the first ink chamber 151 side to the second ink chamber 152 side via the wall communicating opening 155 which is formed in the partition wall 150. In this point, in the present embodiment, the float member 181 is arranged inside the second ink chamber 152 so as to be in a non-opposing state with regard to the front and back direction Y which is the ink inflow direction into the second ink chamber 152 via the wall communicating opening 155, that is, such that the thin film member 186 is in a state of being along the front and back direction Y. As a result, the inflow pressure of ink which flows from the wall communicating opening 155 into the inside of the second ink chamber 152 acts so as to flow in the front and back direction Y along the film surface with regard to the thin film member 186 of the float member 181.

Here, it is possible that several out of the plurality of (four in the present embodiment) gas chambers 187 may lose the sealed structure due to the thin film member 186 in the float member 181 being partially damaged due to aging or the like. Then, in this case, there is a possibility that a hindrance to the valve function of the float valve 131 will be generated since the buoyancy of all of the float members 181 decreases. However, in the present embodiment, the sum of the buoyancy which is produced by the one of the gas chambers 187 and the second pressing force of the coil spring 195 is equal to or more than the first pressing force of the coil spring 184 when the remaining amount of the ink is equal to or more than the threshold remaining amount even in a case where there is only one gas chamber 187. As a result, the float valve 131 exhibits the valve function without hindrance even in a case where there is one of the gas chambers 187.

In addition, when the float member 181 floats in the up and down direction Z according to changes in the remaining amount of the inside the ink chamber 137, the float member 181 is positionally aligned in the front and back direction Y and the left and right direction X by the rod shaped section 190 being inserted in the insertion hole 198*a* of the cylindrical section 198. Then, since the convex section 188 which protrudes from both side surfaces at the front and rear of the frame body 185 is inserted in the guide slot 201 of the regulating case 183, the rotation of the float member 181 with the rod shaped section 190 as the center is regulated. Furthermore, floating of the float member 181 in a state where the coil spring 184 is placed to a position which is higher than the open valve position of the valve body 182 is regulated by the upper wall of the cylindrical section 198 in the regulating case 183.

Furthermore, in a case where the float member 181 floats inside the ink chamber 137 in the front and back direction Y and the left and right direction X, for example, surface contact of the thin film member 186 with the side wall 196*a* which faces the regulating case 183 is regulated by the plate shaped section 191 with the cross shape and the inner side surface of the cylindrical section 198 coming into contact with each other in the horizontal direction. That is, when the float member 181 is in a state where the rod shaped section 190 is inserted in the insertion hole 198*a* of the cylindrical section 198, the interval distance between the front end edge of the plate shaped section 191 in the radial direction and the inner side surface of the cylindrical section 198 is smaller than the interval distance between the thin film member 186 and the inner surfaces of each of the side walls 196*a* at the left and right of the regulating case 183. Accordingly, surface contact of the thin film member 186 with both side walls 196*a* which oppose the thin film member 186 in the regulating case 183 is regulated in the float member 181. In this point, the plate shaped portion 191 functions as an example of a regulating abutting section which regulates the surface contact between the opposing surfaces of the regulating case 183 and the float member 181 which oppose each other in the horizontal direction.

In addition, in this case, since the side wall 196*a* of the regulating case 183 and the thin film member 186 of the float member 181 which oppose each other in the left and right direction X are formed with the cut away section 199 with a rectangular shape in the side wall 196*a* of the regulating case 183, damage to the thin film member 186 due to sliding on the inner surface of the side wall 196*a* of the regulating case 183 is suppressed.

In addition, in particular, when the float member 181 floats above the inside of the regulating case 183, there is a risk that the ink pressure will be increased by ink inside the regulating case 183 being pushed from below by the float member 181. In this point, since increases in the ink pressure permit ink from flowing out from the holes 202, which are formed in a plurality of locations in the regulating case 183 in the present embodiment, and the cut away section 199, the ink pressure is suppressed from increasing unnecessarily.

According to the first embodiment described above, it is possible to obtain the following effects.

(1) In the liquid holding container 21, since the inlet port 73 is formed at the first part (the first accommodating body section 37), which is positioned outside the printer 11, of the liquid accommodating body 33, it is possible to introduce ink in a state where the liquid accommodating body 33 is fixed to the printer 11. Accordingly, it is possible to suppress damage during the ink introduction operation and leaking of liquid which remains in the inner section. In addition, due to the second part (the second accommodating body section 38), which is positioned inside the printer 11, of the liquid accommodating body 33, the liquid accommodating body 33 has a higher probability of being held in the printer 11 without falling when the fixed state is released.

(2) In the liquid holding container 21, it is possible for the recording chip 75, which records relationship information on ink which is introduced into the liquid accommodating body 33 which is fixed to be not able to move, to be moved inside the printer 11 from outside the printer 11 using the slider 34 which slides with regard to the liquid accommodating body 33. As a result, if the recording chip is designed so as to come into contact with, for example, the electric terminal 78 or the like which is provided inside the liquid consuming apparatus when the recording chip is moved inside the liquid consuming apparatus, it is possible to correctly transmit the relationship information on ink which is introduced into the liquid accommodating body 33 to the printer 11. In addition, after the recording chip 75 is placed outside the printer 11 with regard to the chip holder 76 which is provided in a moving part of the slider 34, it is possible to easily insert the recording chip 75 which is placed in the chip holder 76 inside the printer 11 by sliding the slider 34.

(3) Since the inlet port 73 is covered by the slider 34, it is possible to suppress entry of foreign matter into the inlet port 73 without separately providing a lid for use with the inlet port 73.

(4) In a state where the slider 34 covers the inlet port 73, it is possible to cover and expose the inlet port 73 by displacement of the opening and closing cover 74 which is provided even when the slider does not slide.

(5) In a state where the opening and closing cover 74 is displaced from the closed lid position to the open lid position, the opening and closing cover 74 is positioned on the printer 11 side with regard to the inlet port 73. Accordingly, it is possible for the opening and closing cover 74 to not interfere with regard to the operation when ink is introduced into the inlet port 73.

(6) Since it is possible to stably maintain the opening and closing cover 74 at the closed lid position, it is possible to suppress the inlet port 73 from being exposed by inadvertently opening the opening and closing cover 74.

(7) Since the chip holder 76 is positionally aligned in the direction which intersects with the movement direction of the moving part inside the printer 11, the recording chip 75 which is placed in the chip holder 76 is also positionally aligned with high precision inside the printer 11. Accordingly, for example, since the electric terminal 78 which is provided in the printer 11 comes into contact with regard to the recording chip 75 in a state where shifts in position are suppressed, transmission of the relationship information which is recorded in the recording chip 75 to the printer 11 is performed with high probability.

(8) Since movement of the chip holder 76 in the sliding direction of the slider 34 is suppressed, the chip holder 76 is positionally aligned with high precision inside the printer 11 with regard to the sliding direction of the slider 34. In addition, since the recording chip 75 which is placed in the chip holder 76 is in a state of being inclined with regard to the sliding direction of the slider 34, the electric terminal 78 which is provided in the printer 11 is electrically connected by, for example, being moved while rubbing on the recording chip 75 (the electrode 75*a*). Accordingly, the reliability of the electrical conduction is increased.

(9) When the user introduces ink to the first ink chamber 151 (the ink chamber 137) of the liquid accommodating body 33 via the inlet port 73, it is possible to receive ink using the liquid receiving surface 116 even when ink drips onto the periphery of the inlet port 73. Then, since the liquid receiving surface 116 is inclined downward (in the direction of gravity) toward the inlet port 73, ink which is received by the liquid receiving surface 116 is guided to the inlet port 73 along the top of the liquid receiving surface 116 which is inclined. Accordingly, even in a case where the ink drips onto the outer circumference of the inlet port 73 when ink is introduced into the inlet port 73 of the liquid holding container 21, it is possible to suppress ink from moving along the surface of the liquid holding container 21 from the periphery of the inlet port 73 to foul the surroundings.

(10) When ink is introduced into the first ink chamber 151 of the liquid accommodating body 33 using the circumference wall section 117 which surrounds the periphery of the liquid receiving surface 116, it is possible to suppress ink from overflowing to the outside of the liquid receiving surface 116.

(11) When the user introduces ink to the first ink chamber 151 from the liquid introduction source 126 via the inlet port 73, it is possible to positionally align the liquid introduction source 126 by the liquid introduction source 126 abutting with the cut away groove 118 of the circumference wall section 117. According to this, it is possible to stably introduce ink when the user introduces ink from the liquid introduction source 126 to the first ink chamber 151.

(12) The covering body 120 which covers the inlet port 73 is fixed to the liquid accommodating body 33 via the coupling section 125 and the fixing section 123. As a result, when the covering body 120 is detached from the inlet port 73, it is possible to reduce the risk that the covering body will be lost. In addition, by covering the inlet port 73 with the covering body 120, it is possible to suppress ink from evaporating from the first ink chamber 151 or foreign matter from being mixed into the first ink chamber 151.

(13) It is possible to place the covering body 120 at the rear surface 74*a* of the opening and closing cover 74 which is positioned at the open lid position when ink is introduced. According to this, when the user introduces ink into the first ink chamber 151, it is possible to suppress the introduction operation of the ink in a state where, for example, one hand of the user is occupied due to the covering body 120 being held in that hand.

(14) When the covering body 120 is placed at the opening and closing cover 74 which is positioned at the open lid position, it is possible to suppress ink from leaking out to the outside of the opening and closing cover 74 using the shielding section even when ink is attached to the covering body 120.

(15) It is possible to place the covering body 120 so as to fit inside the surface region of the rear surface 74*a* of the opening and closing cover 74 which is positioned at the open lid position. Furthermore, since the rear surface 74*a* of the opening and closing cover 74 is inclined downward (in the direction of gravity) toward the inlet port 73, it is possible to suppress spreading of ink over the entire region of the rear surface 74*a* even when ink is attached to the covering body 120 which is placed at the rear surface 74*a* of the opening and closing cover 74.

(16) Since the coupling section 125 of the covering member is curved, it is possible to place the covering member with excellent fitting properties on the liquid receiving surface 116. In addition, it is possible for it to be difficult for ink to move along the coupling section 125 in a case where ink is attached to the covering body 120 when the covering body 120 is detached from the inlet port 73 compared to a case where the coupling section 125 is formed in a straight line.

(17) Since the fixing section 123 is fixed at a place, which is higher than the inlet port 73, on the liquid receiving surface 116, it is possible for it to be difficult for ink which flows on the liquid receiving surface 116 to be attached to the fixing section 123 of the covering member 121 when ink is introduced into the liquid accommodating body 33. According to this, it is possible to suppress an effect on the state of the fixing section 123 being fixed due to, for example, ink being attached to the fixing section 123 and solidified.

(18) When the user attempts to introduce a plurality of types of ink into a plurality of the liquid holding containers 21 (the ink chambers 137), it is possible to suppress the covering body 120 which is provided to correspond to one of the liquid holding containers 21 from covering the inlet ports 73 of the other liquid holding containers 21 which are provided in parallel with the one liquid holding container 21. According to this, by the inlet ports 73 of the other liquid holding containers 21 being covered by the covering body 120 which is provided to correspond to the one liquid holding container 21, it is possible to suppress ink from being mixed inside the ink chambers 137 of the other liquid holding containers 21 via the covering body 120.

(19) The wall communicating opening 155 is positioned at a position which is twisted with regard to the inlet port 73 and which is separated from the bottom surface 153. As a result, ink which is introduced from the inlet port 73 flows into the second ink chamber 152 via the wall communicating opening 155 and it is difficult for foreign matter which is mixed in from the inlet port 73 or foreign matter which is generated inside the first ink chamber 151 to pass through the wall communicating opening 155 compared to the ink. That is, since it is possible for the foreign matter to easily remain in the first ink chamber 151, ink where the mixing in of the foreign matter is suppressed flows into the second ink chamber 152. Accordingly, it is possible to favorably lead out the ink while reducing the risk that the foreign matter which is mixed in will be led out from the lead out port 69 even in a case where foreign matter is mixed in from the inlet port 73 or a case where foreign matter is generated in the inner section.

(20) Since the concave section 154 where the bottom surface 153 is recessed in the direction of gravity is formed, it is possible for foreign matter to be deposited inside the concave section 154 even in a case where foreign matter which remains in the first ink chamber 151 settles over time. That is, in a case where ink is introduced from the inlet port 73 in a state where the foreign matter is deposited inside the concave section 154, it is possible to suppress foreign matter which is deposited from inside the concave section 154 from rising up out of the concave section 154.

(21) It is possible for foreign matter which is mixed in or generated to be deposited in the concave section 154. Then, since the concave section 154 is provided by shifting its position from the inlet port 73 in the direction which intersects with the direction of gravity, it is possible to further suppress rising up of foreign matter which is deposited in the concave section 154 when ink is introduced from the inlet port 73.

(22) By the distance L1 between the flow path opening 162 and the partition wall 150 being shorter than the distance L2 between the upper end of the concave section 154 and the lower end of the wall communicating opening 155, it is possible to form the flow path opening 162 at a position which is close to the partition wall 150. As a result, it is possible to reduce the risk that ink from the first ink chamber 151 side to the second ink chamber 152 side and foreign matter which passes through the wall communicating opening 155 will settle inside the flow path opening 162 and enter the lead out flow path 138.

(23) Even in a case where foreign matter enters into the second ink chamber 152 or a case where foreign matter is generated inside the second ink chamber 152, it is possible for foreign matter which is settled inside the second ink chamber 152 to be deposited on the diagonal rib sections 158*a* to 158*d*. Accordingly, it is possible to further suppress mixing in of foreign matter into ink which is led out to the leading out flow path 138 from the flow path opening 162 which is positioned more to the direction of gravity side than the diagonal rib sections 158*a* to 158*d*.

(24) Since the diagonal rib sections 158*a* to 158*d* extend along the direction which intersects with regard to the up and down direction Z and the front and back direction Y, it is possible to collect foreign matter which is deposited on the diagonal rib sections 158*a* to 158*d* in one direction according to reduction in the amount of ink which is held in the second ink chamber 152.

(25) There is a risk that the float valve 131 which displaces the valve body 182 using the float member 181 which floats according to the changes in the remaining amount of the ink will malfunction due to the weight of foreign matter which is deposited when, for example, foreign matter is deposited on the float member 181. In this point, since it is possible to deposit foreign matter on the diagonal rib sections 158*a* to 158*d* which are provided more to the direction against gravity side than the float valve 131, it is possible to suppress foreign matter which is settled in the second ink chamber 152 from being deposited on the float member 181.

(26) Even in a case where the foreign matter, which is deposited on the third diagonal rib section 158*c* and the fourth diagonal rib section 158*d*, moves according to changes in the remaining amount of ink, which is accommodated in the second ink chamber 152, so as to fall off the third diagonal rib section 158*c* and the fourth diagonal rib section 158*d*, it is possible for foreign matter to fall so as to avoid the float valve 131.

(27) It is possible for ink which is led out from the flow path opening 162 to flow to the float valve 131 side after passing through the filter 166. That is, in foreign matter which is mixed into ink inside the first ink chamber 151 from the inlet port 73, foreign matter with, for example, a comparatively large size remains in the first ink chamber 151 and is deposited on the diagonal rib sections 158*a* to 158*d* in the second ink chamber 152. As a result, since foreign matter, which is mixed into ink which is led out from the flow path opening 162 to the leading out flow path 138, has a comparatively small size, clogging of the leading out flow path 138 is suppressed compared to a case where large foreign matter enters even in a case where the foreign matter enters from, for example, the flow path opening 162. Furthermore, it is possible to further reduce foreign matter which is mixed into ink which is led out from the lead out port 69 by ink passing through the filter 166 which is provided in the leading out flow path 138.

(28) Since the area of the wall communicating opening 155 is smaller than the area of the inlet port 73, it is possible to reduce the risk that foreign matter will enter into the second ink chamber 152 through the wall communicating opening 155 in a case where foreign matter with a large size is mixed in from the inlet port 73.

(29) It is easy for bubbles in ink to remain in a portion which is bent in the leading out flow path 138. In this point, bubbles which are positioned in the curved flow path section 163 are guided to the lead out port 69 side via the inclined flow path section 165. Accordingly, for example, since it is possible to reduce the risk that the leading out flow path 138 will be blocked by bubbles which remain in the curved flow path section 163 becoming larger, it is possible to lead out ink while reducing the effects of bubbles.

(30) It is possible to capture in advance bubbles which are already generated by passing bubbles through the filter 166 before the ink flows to the curved flow path section 163 where it is easy for bubbles to remain.

(31) Since bubbles which are generated in the ink chamber 137 move to the upper side in the direction of gravity, it is possible to reduce the risk that the bubbles will enter into the leading out flow path 138 from the flow path opening 162 by the flow path opening 162 being opened to the bottom surface 152*a*.

(32) It is possible to reinforce the ink chamber 137 by forming the diagonal rib sections 158*a* to 158*d*. Furthermore, since the diagonal rib sections 158*a* to 158*d* extend along the direction which intersects with the horizontal direction, it is possible to move bubbles along the diagonal rib sections 158*a* to 158*d* in a case where bubbles are generated in ink which is held in the ink chamber 137. That is, it is possible to reduce the risk that bubbles will be trapped by the diagonal rib sections 158*a* to 158*d*.

(33) It is possible to incline the bottom surface 152*a* of the ink chamber 137 along the inclined flow path section 165. That is, since the inclined flow path section 165 is formed such that the flow path opening 162 side is lowered, it is possible to gather ink inside the ink chamber 137 at the flow path opening 162 side.

(34) Since the cross sectional area of the inclined flow path section 165 is large, it is possible to reduce the risk that the inclined flow path section 165 will be blocked by bubbles which are generated in the curved flow path section 163.

(35) Since an upper surface 155*c* is inclined on the direction against gravity side, it is possible to reduce the risk that the bubbles will remain in the wall communicating opening 155 even in a case where bubbles are generated in the wall communicating opening 155.

(36) It is possible to reduce differences in pressure between the first ink chamber 151 and the second ink chamber 152 using the wall ventilation opening 156 which is formed in the partition wall 150. Furthermore, since the wall ventilation opening 156 which is formed in the partition wall 150 is formed closer to the ceiling surface 137*b* than the rib ventilation opening 160 which is formed in the intersecting rib sections 157*a* to 157*i*, it is possible to reduce the risk that ink inside the second ink chamber 152 will enter into the first ink chamber 151 from the wall ventilation opening 156.

(37) By forming the position alignment ridge 141, it is possible to easily adhere the air conducting path forming film 147 onto the winding grooves 142 and 143 while suppressing shifting of the air conducting path forming film 147.

(38) It is possible to easily replace the filter 166 by attaching the filter 166 to the first flow path forming concave section 168*a* which is formed in the lower surface 40 of the accommodating body case 130.

(39) In the float valve 131 which is arranged inside the second ink chamber 152 of the liquid accommodating body 33, the thin film member 186 which blocks the opening section 185*a* of the gas chamber 187 does not directly receive the inflow pressure of ink which flows into the inside of the second ink chamber 152 during introduction of ink from the inlet port 73. That is, the inflow pressure of ink acts along the film surface with regard to the thin film member 186. As a result, even in a case where ink is vigorously introduced into the inside from the outside of the first ink chamber 151 of the ink chamber 137 via the inlet port 73, it is possible to suppress the inflow pressure of ink strongly acting via the first ink chamber 151 with regard to the thin film member 186 of the float member 181 inside the second ink chamber 152 in the direction which pushes the thin film member 186. Accordingly, it is possible to maintain an appropriate valve operation without the float valve 131 which is arranged in the inner section being damaged due to the inflow pressure of ink which is introduced from outside.

(40) Since the float valve 131 is arranged in the second ink chamber 152 which is partitioned by the partition wall 150 from the first ink chamber 151 where the inlet port 73 is formed, it is possible to avoid ink which is introduced from outside via the inlet port 73 being directly applied with regard to the float valve 131, and in this point, it is possible to further reduce the risk that the float valve 131 will be damaged.

(41) Even if it is assumed that the sealed state of one out of a plurality (four as an example) of the gas chambers 187 is broken due to being damaged or the like, it is possible to favorably maintain the function of the float valve 131 if the volume of the gas chambers 187 is designed such that the total of the volumes of the other remaining gas chambers 187 produces the desired buoyancy in the float member 181.

(42) In particular, in a case where the remaining amount of ink is equal to or more than the threshold remaining amount due to introduction of ink via the inlet port 73 from a state where the remaining amount of ink is less than the threshold remaining amount for a long period and the valve body 182 is at the closed valve position, it is possible to suppress a state where the valve body 182 is stuck in the closed valve position and it is possible to gently displace the valve body 182 from the closed valve position to the open valve position.

(43) It is possible to reduce the risk that movement resistance will be generated by the float member 181 sliding in a state of being in surface contact with regard to the ring-shaped wall section 196 of the in the regulating case 183 when floating in the up and down direction Z while further suppressing the inflow pressure of ink which flows into the second ink chamber 152 from having a direct effect with regard to the float member 181 using the ring-shaped wall section 196 of the regulating case 183.

(44) It is possible to reduce the risk that the thin film member 186 will be scratched due to sliding against the ring-shaped wall section 196 of the regulating case 183 when the float member 181 floats in the up and down direction.

(45) Since ink is permitted to flow between the inner side and the outer side of the ring-shaped wall section 196 of the regulating case 183 via the hole 202 in a case where the float member 181 floats in the up and down direction Z, it is possible to ensure a smooth floating state for the float member 181 according to changes in the remaining amount of the ink.

(46) Since it is possible to reduce the risk that the opposing surfaces of the regulating case 183 and the float member 181 which face each other in the horizontal direction, that is, the thin film member 186 and the side wall 196*a* will be fixed by the surface tension of the ink, it is possible to favorably maintain the appropriate valve operation of the float valve 131.

(47) Since it is possible to operate the valve body 182 by displacing the valve body 182 between the open valve position and the closed valve position simply by pushing the float member 181 with a small stroke with regard to the valve body 182, it is possible to contribute to making the float valve 131 more compact.

Second Embodiment

Next, a second embodiment which is a liquid holding container will be described with reference to the diagrams. Here, the shape of a cover 210 which covers the case opening section 132 of the accommodating body case 130 in the second embodiment is different to the case of the first embodiment. Then, since the second embodiment is substantially the same as the first embodiment in other respects, overlapping description is omitted by giving the same reference numerals where the configurations are the same.

Figure 30:
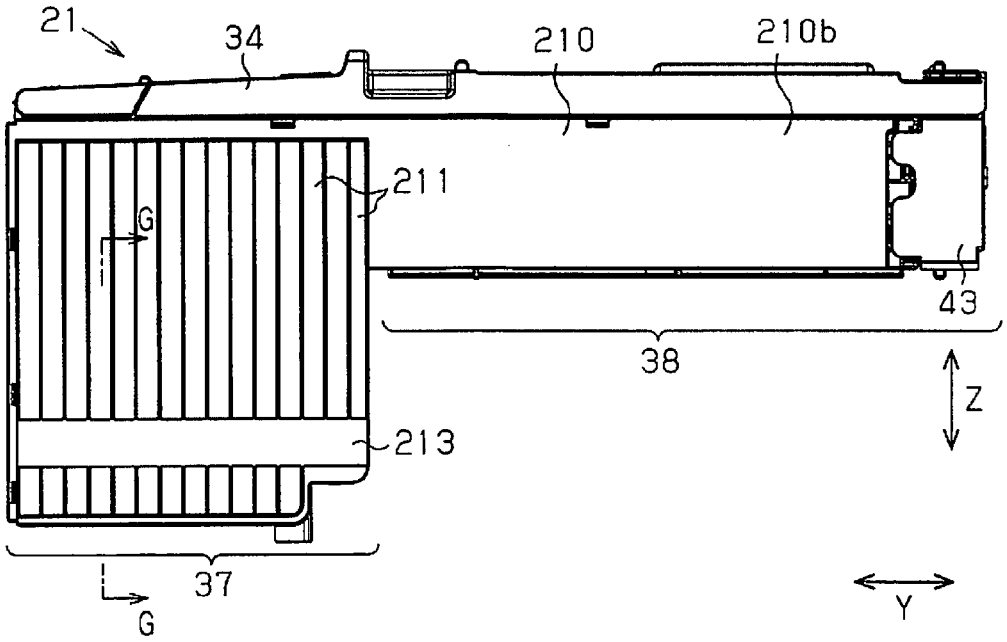
FIG. 30 is a side surface diagram of a liquid holding container of a second embodiment.
Figure 31:
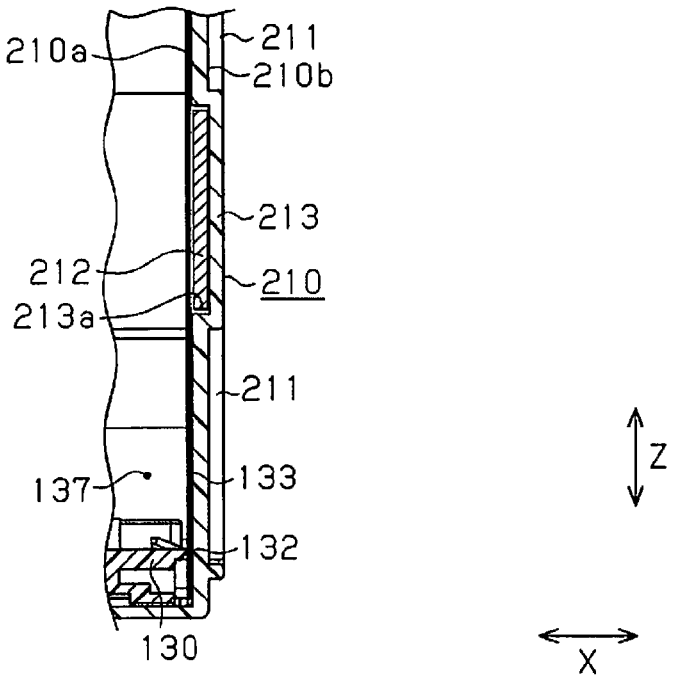
FIG. 31 is a diagram of a cross section viewed along an arrow line G-G in FIG. 30.

As shown FIG. 30 and FIG. 31, at least one reinforcing ridge 211, which extends along an opposing surface 210*a* which opposes the film 133, is formed at a portion, at the front side which configures the first accommodating body section 37, of the cover 210 which covers the case opening section 132 over the film 133. The reinforcing ridge 211 is formed on an outside surface 210*b* side which is the opposite side to the facing surface 210*a* to span in the up and down direction Z which intersects with the front and back direction Y which is the horizontal direction in the posture state during use. That is, at least a portion of the reinforcing ridge 211 is formed so as to be positioned at a lower side (the direction of gravity side) than the center position of the ink chamber 137 in the up and down direction Z. Here, in the present embodiment, the reinforcing ridge 211 is formed along the up and down direction Z, but the direction in which the reinforcing ridge 211 is formed is not limited to this. For example, there may be an aspect where the reinforcing ridge 211 is formed in the direction which intersects with the up and down direction Z and the front and back direction Y. In addition, there may be an aspect where the reinforcing ridge 211 is along the front and back direction Y.

Furthermore, in the portion of the cover 210 at the front side which configures the first accommodating body section 37, a support ridge 213 which is a part which supports a reinforcing member 212 is formed along the front and back direction Y which intersects with the up and down direction Z in which the reinforcing ridge 211 extends. Here, the width of the support ridge 213 in the up and down direction Z is wider than the width of the reinforcing ridge 211 in the front and back direction Y, and then, a recess 213*a* where each of the dimensions in the up and down direction Z and the left and right direction X are substantially the same dimensions as the reinforcing member 212 is formed as a recess on the opposing surface 210*a* side.

As shown in FIG. 31, the reinforcing member 212 is arranged inside the recess 213*a* on the facing surface 210*a* side of the support ridge 213 and provided in a state of being interposed between the film 133 and the cover 210 in the left and right direction X. That is, the reinforcing member 212 is provided along the surface of the film 133 at a position, which is the opposite side to the ink chamber 137, in the film 133. Then, when the film 133 is subjected to a load due to the weight of ink which is held in the ink chamber 137, the film 133 is pressed from the outside of the ink chamber 137 such that the reinforcing member 212 suppresses shape changing of the film 133. Here, the reinforcing member 212 of the present embodiment is a plate with a rectangular shape which is formed, for example, by metal such as iron or copper and does not easily change shape due to having rigidity greater than the cover 210 which is formed of resin or the like.

Figure 32:
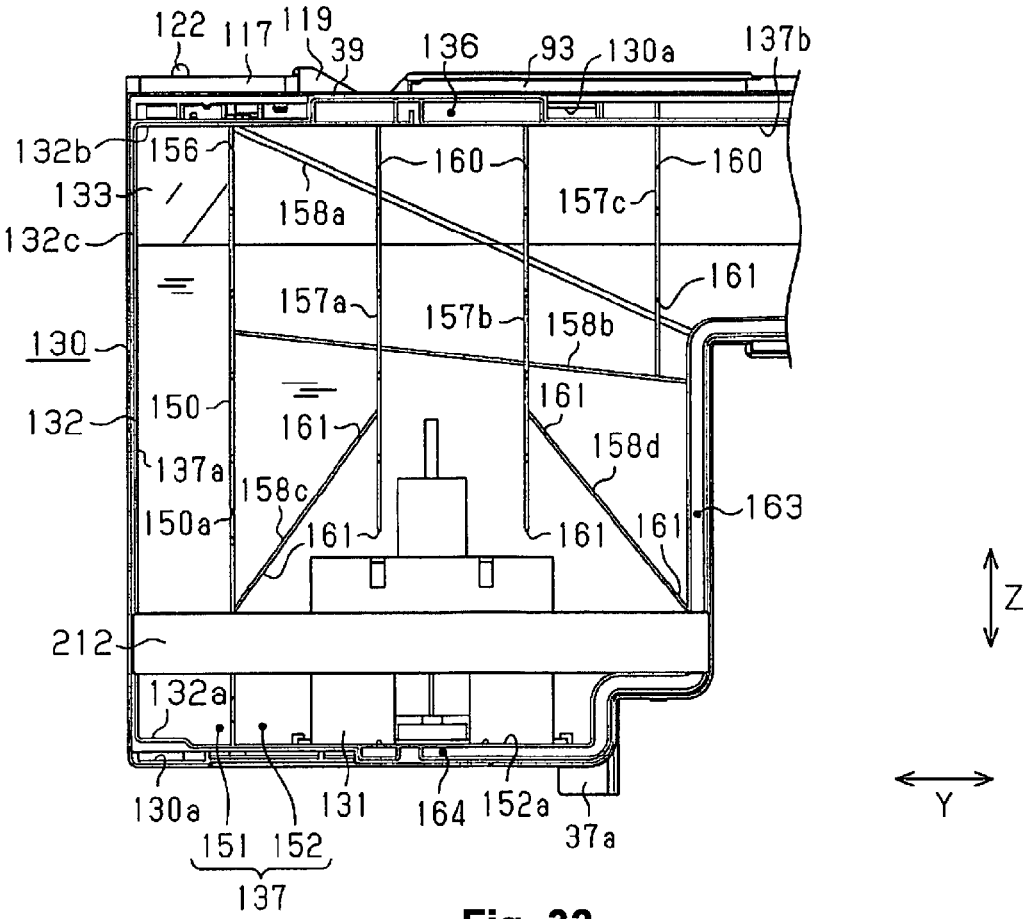
FIG. 32 is a partial side surface diagram of the accommodating body case where a film is adhered and a reinforcing member.

FIG. 32 illustrates the accommodating body case 130 and the reinforcing member 212 by omitting the cover 210. As shown in FIG. 32, the reinforcing member 212 is provided to span in the front and back direction Y at a position at the lower side lower than the center position of the ink chamber 137 in the up and down direction Z in a case of a state where the film 133 is along the direction of gravity. That is, the reinforcing member 212 is formed inside the ink chamber 137 and is provided in a region which opposes the adhesion surface 150*a* of the partition wall 150 which is an example of an adhesion rib where the film 133 is adhered. In addition, a portion (the front end section which is one end section in the front and back direction Y in FIG. 32) of the reinforcing member 212 is provided so as to be positioned at a position, which is the opposite side to the first ink chamber 151, in the film 133.

Here, the portion where the film 133 is adhered in a lower end section 132*a* and an upper end section 132*b* of the case opening section 132 is formed along the front and back direction Y, while the portion where the film 133 is adhered in an intermediate section 132*c* is formed along the up and down direction Z. As a result, the area of the portion where the film 133 is adhered in the intermediate section 132*c* in the horizontal direction is small compared to the area of the portion where the film 133 is adhered in the lower end section 132*a* and the upper end section 132*b*. Here, the intermediate section 132*c* is a position between the lower end section 132*a* and the upper end section 132*b* of the case opening section 132 in the up and down direction Z. Then, the reinforcing member 212 is provided at a position, which is the opposite side to the intermediate section 132*c*, in the film 133.

According to the second embodiment described above, it is possible to obtain the following effects.

(48) Even in a case where there is a tendency for the film 133 to change shape toward the opposite side to the ink chamber 137 side, it is possible to press the film 133 from the outside of the ink chamber 137 using the reinforcing member 212. As a result, it is possible to reduce the risk that the film 133 will peel off from the liquid accommodating body case 130.

(49) It is possible to press the film 133 from the outside of the ink chamber 137 using the cover 210 and it is also possible to suppress shape changing of the cover 210 due to the reinforcing member 212 pressing the film 133.

(50) By forming the reinforcing ridge 211 on the cover 210, it is possible to increase the rigidity of the cover 210. That is, shape changing of the cover 210 due to a load which is applied via the film 133 is suppressed and it is also possible to press the film 133 with the cover 210.

(51) Since at least a portion of the reinforcing ridge 211 is formed more to the direction of gravity side than the center position of the ink chamber 137, it is possible to increase the rigidity of the cover 210 on the direction of gravity side where it is easy for a large load to be applied. Accordingly, it is possible to further suppress shape changing of the cover 210 due to a load which is applied via the film 133.

(52) Since it is possible to further cover the reinforcing member 212 with the cover 210, it is possible to improve the external appearance compared to a case where the reinforcing member 212 is provided on the outer side of the cover 210.

(53) In a case where ink is accommodated in the ink chamber 137 in a state where the film 133 is along the direction of gravity, it is easy for the shape of the portion of the film 133 on the direction of gravity side to be changed compared to the portion on the direction against gravity side since a large load is applied on the direction of gravity side in the ink chamber 137 compared to the direction against gravity side in the ink chamber 137. In this point, since the reinforcing member 212 is positioned more to the direction of gravity side than the center position of the ink chamber 137, it is possible to press the portion where it is easy for the film 133 to change shape from outside while suppressing an increase in the size of the reinforcing member 212.

(54) It is possible to increase the area of the portion where the accommodating body case 130 and the film 133 are adhered by forming the partition wall 150. That is, it is possible for the adhesion state of the accommodating body case 130 and the film 133 to be more robust. Furthermore, it is possible to reduce the risk that the film 133 will peel off from the partition wall 150 by the reinforcing member 212 pressing the film 133 at a position where the partition wall 150 and the film 133 are adhered.

(55) In the liquid holding container 21 where it is possible to introduce ink, force is also applied to the film 133 when ink is introduced from the inlet port 73 and it is easy for a large load to be applied due to the film 133 which configures the first ink chamber 151. In this point, it is possible to press the film 133 which configures the first ink chamber 151 by dividing the ink chamber 137 into the first ink chamber 151 and the second ink chamber 152 and a portion (the front end section in FIG. 32) of the reinforcing member 212 being provided at the first ink chamber 151 where the inlet port 73 is formed.

(56) It is easier for peeling to occur if the area of the portion where the film 133 and the accommodating body case 130 are adhered is smaller. In this point, the reinforcing member 212 presses the film 133 in the intermediate section 132*c* where the area of the portion where the film 133 and the accommodating body case 130 are adhered is small. Accordingly, it is possible to further reduce the risk that the film 133 will peel off.

(57) By setting the size of the reinforcing member 212 to a size which is able to press a portion of the film 133, it is possible to achieve a reduction in the weight of the liquid holding container 21 compared to a case of providing a reinforcing member which is able to press the entire surface of the film 133.

Here, the embodiments described above may be changed to other embodiments as be low.

Figure 33:
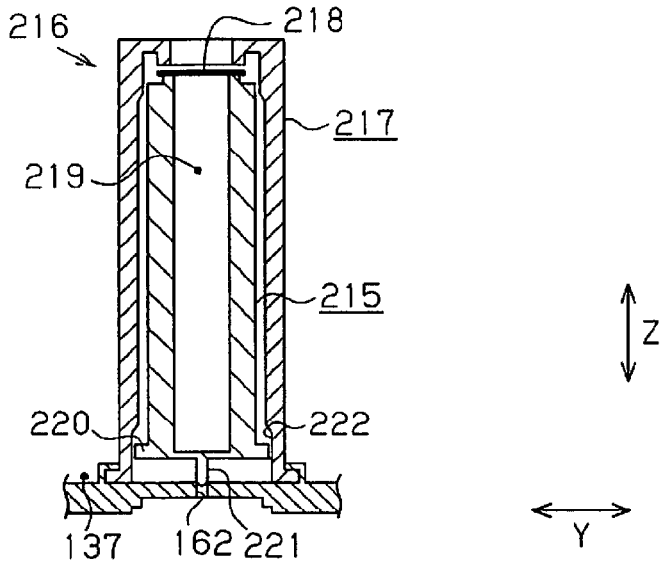
FIG. 33 is a cross sectional diagram of a float valve in a first modified example.

In each of the embodiments described above, there may be a float valve 216 as shown in FIG. 33 where the flow path opening 162 is directly blocked by downwardly displacing a float member 215 which is displaced in the up and down direction Z according to the amount of ink which is held in the ink chamber 137 (a first modified example). That is, the float valve 216 has the float member 215 with a cylindrical shape which has a bottom, and a regulating case 217 which is arranged so as to surround the float member 215. Then, the float member 215 has a gas chamber 219 which is formed by blocking an opening section, which is formed in the upper part, with a thin film member 218. Furthermore, convex sections 220 which protrude in the front and back direction Y are each formed at the lower sections of both side surfaces at the front and rear of the float member 215, and a blocking section 221 with a shape which is able to block the flow path opening 162 is provided to project vertically downward from the center position in the lower surface. In addition, the regulating case 217 has a cylindrical shape where it is possible to insert the float member 215 from below and a guiding slot 222 which guides the convex section 220 on the float member 215 side is formed along the up and down direction Z. As a result, in a case where the float member 215 is lowered as the remaining amount of ink inside the ink chamber 137 decreases and the remaining amount of ink is less than the threshold remaining amount, the blocking section 221 blocks the flow path opening 162 which is formed at a lower position than the float member 215. Here, it is preferable that the blocking section 221 be formed or coated with an elastic member. In addition, the blocking section 221 may block an intermediate position in the coupling flow path section 164.

Figure 34:
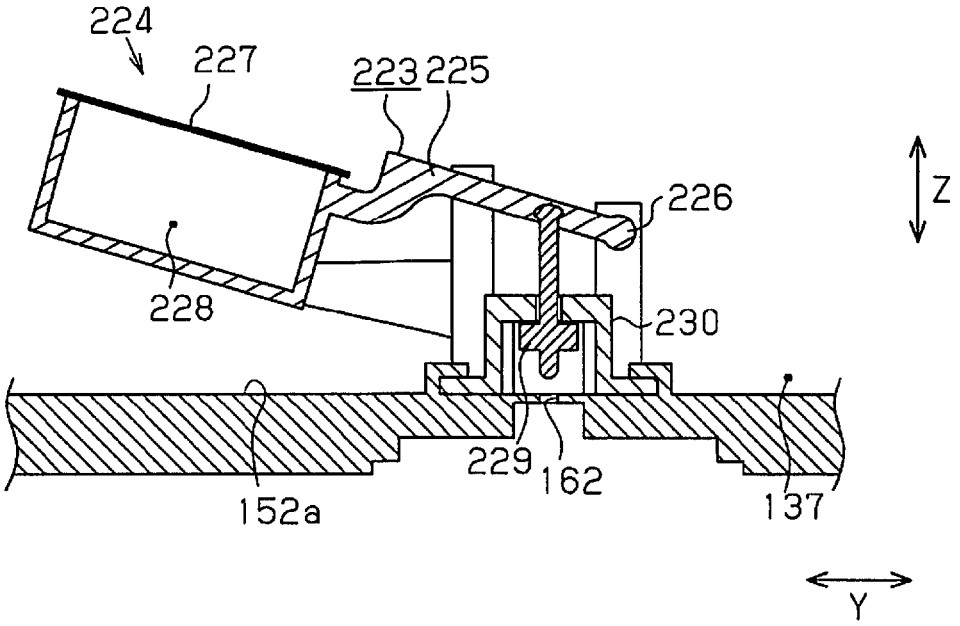
FIG. 34 is a cross sectional diagram of a float valve in the second modified example where a float member is positioned at an upper position.
Figure 35:
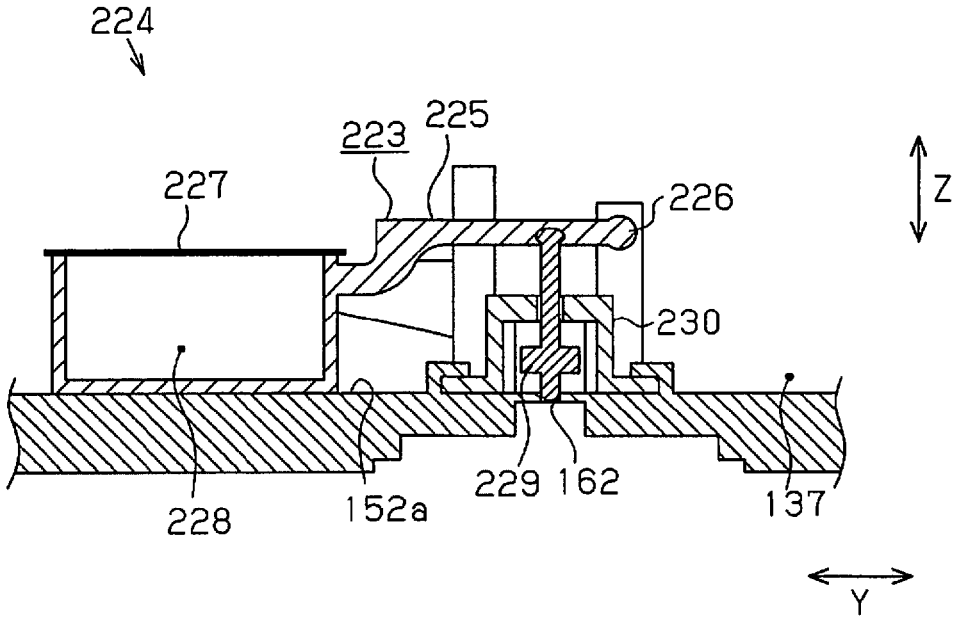
FIG. 35 is a cross sectional diagram of the float valve where the float member is lowered from the upper position.

In each of the embodiments described above, there may be a float valve 224 as shown in FIG. 34 and FIG. 35 where a float member 223 swings centered on a fulcrum (a second modified example). That is, in the float member 223, a support axis 226 is formed at one end side of an arm section 225 and a gas chamber 228 where the opening section is blocked by a thin film member 227 is formed at the other end side of an arm section 225. In addition, a blocking member 229 which is displaced in the up and down direction Z by being axially supported by the arm section 225 and which is able to block the flow path opening 162 is accommodated inside a support case 230 which supports the float member 223 between the support axis 226 and the gas chamber 228. As a result, as shown in FIG. 34, in a case where the remaining amount of the ink inside the ink chamber 137 is considerable, the float member 223 and the blocking member 229 are positioned at an upper position which is separated from the bottom surface 152*a*. Then, as shown in FIG. 35, when the float member 223 and the blocking member 229 are lowered according to a decrease in the remaining amount of ink inside the ink chamber 137, the flow path opening 162 is blocked by the float member 223 and the blocking member 229 being lowered. Here, the blocking member 229 may block an intermediate position in the coupling flow path section 164.

Figure 36:
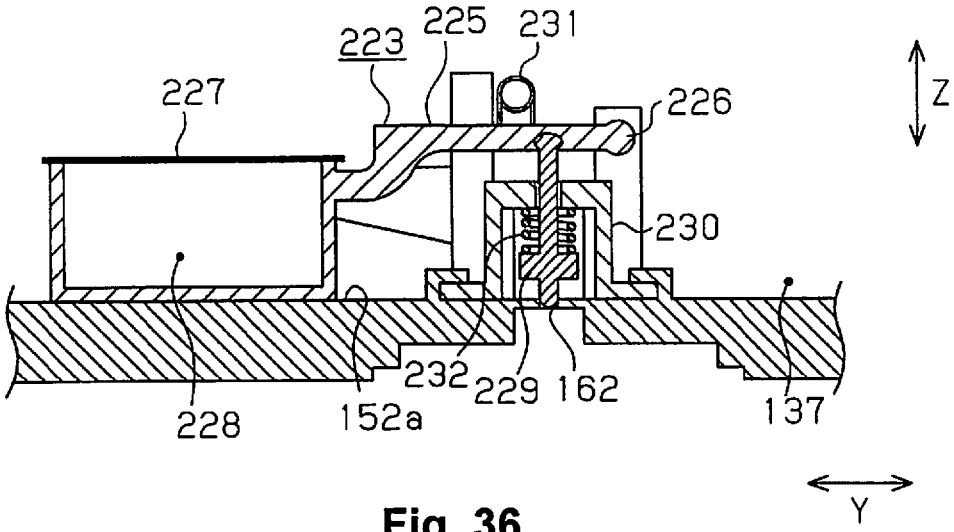
FIG. 36 is a cross sectional diagram of a float valve in a third modified example.

In the second modified example described above, a first spring 231 which presses the arm section 225 upward and a second spring 232 which presses the blocking member 229 downward may be provided as shown in FIG. 36 (a third modified example). That is, when the remaining amount of the ink inside the ink chamber 137 decreases, the weight of the float member 223 is applied to the blocking member 229 via the arm section 225. As a result, when the remaining amount of ink inside the ink chamber 137 decreases and the total of the weight of the float member 223 and the pressing force of the second spring 232 is greater than the total of the buoyancy applied to the float member 223 and the pressing force of the first spring 231, the blocking member 229 is moved to a blocking position where the flow path opening 162 is blocked. That is, by providing the first spring 231 and the second spring 232, it is possible to quickly perform blocking of the flow path opening 162.

In the second modified example described above, a spring which presses the blocking member 229 upward may be provided between the blocking member 229 and the bottom surface 152*a*. By providing the spring, the blocking member 229 is moved to a blocking position where the flow path opening 162 is blocked in a case where the weight of the float member 223 is larger than the total of the buoyancy which is applied to the float member 223 and the pressing force of the spring. That is, by providing the spring, it is possible to quickly perform blocking of the flow path opening 162.

Figure 37:
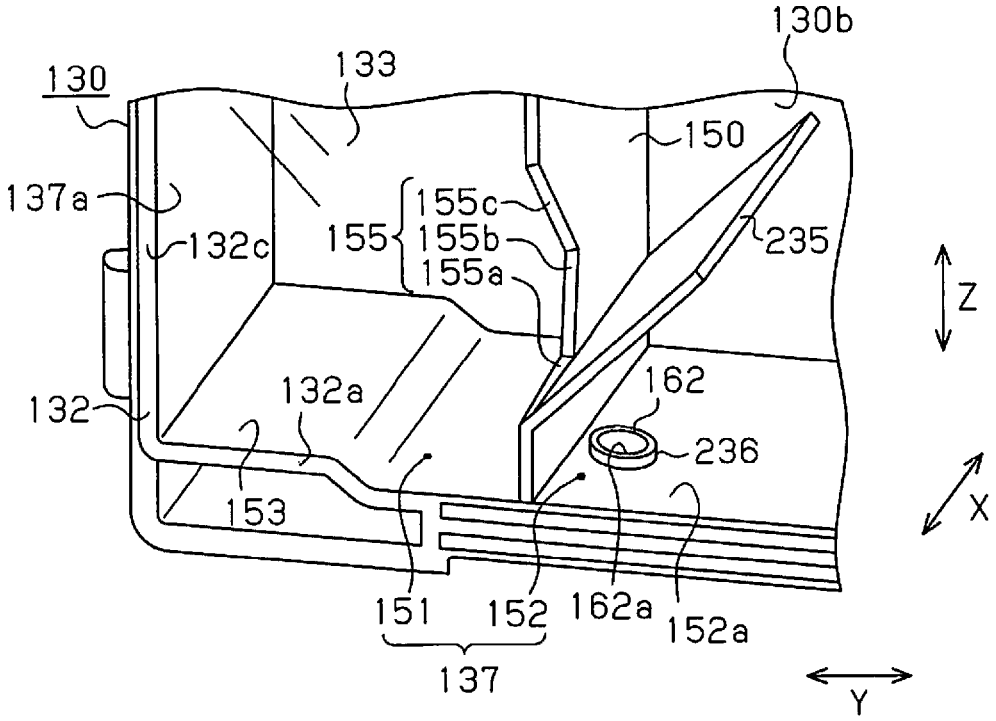
FIG. 37 is a perspective diagram of an accommodating body case in the fourth modified example and the fifth modified example where a film is adhered.

In each of the embodiments described above, an overhanging rib section 235 may be formed as an example of an adhesion rib section in the second ink chamber 152 as shown in FIG. 37 (a fourth modified example). The overhanging rib section 235 is formed to be an upwardly inclined surface from the lower side of the wall communicating opening 155 which is formed in the partition wall 150 toward the inside of the second ink chamber 152. Here, the overhanging rib section 235 is integrally molded with the accommodating body case 130 so as to be orthogonal with the side wall 130*b* of the accommodating body case 130 and to protrude from the side wall 130*b* toward the case opening section 132 side. In addition, the width of the overhanging rib section 235 in the left and right direction X is substantially equal to the width from the side wall 130*b* of the accommodating body case 130 to the case opening section 132, and the film 133 is also adhered to the overhanging rib section 235. Then, by providing the overhanging rib section 235, it is possible to further suppress the entry of foreign matter from the first ink chamber 151 to the second ink chamber 152. In addition, it is preferable that the lower end of the overhanging rib section 235 be formed so as to coincide with the lower surface 155*a* of the wall communicating opening 155. Due to the overhanging rib section 235 and the lower surface 155*a* coinciding, it is possible to reduce the risk that foreign matter will be deposited between the partition wall 150 and the overhanging rib section 235. Here, the width of the overhanging rib section 235 in the left and right direction X may be smaller than the width from the side wall 130*b* of the accommodating body case 130 to the case opening section 132, and the film 133 need not be adhered to the overhanging rib section 235.

In each of the embodiments described above, the flow path opening 162 may be formed so as to protrude from the bottom surface 152*a* as shown in FIG. 37 (a fifth modified example). That is, a cylindrical section 236 where the through hole 162*a* is formed may be provided in the bottom surface 152*a*. In addition, a staged section which protrudes from the bottom surface 152*a* may be formed and the through hole 162*a* may be formed in the staged section. Furthermore, it is not necessary for the circumference edge of the flow path opening 162 to be surrounded, and a protrusion section which protrudes from the bottom surface 152*a* may be formed at a position which is, for example, the edge of the flow path opening 162 along the left and right direction X. By providing the cylindrical section 236, the staged section, and the protrusion section, it is possible to suppress the entry of foreign matter into the flow path opening 162. Here, in a case where the protrusion section is formed, it is preferable that the width in the left and right direction X be formed to be shorter than the width from the side wall 130*b* of the accommodating body case 130 to the case opening section 132, or that a communicating hole or groove which joins both sides in the front and back direction Y be formed.

Figure 38:
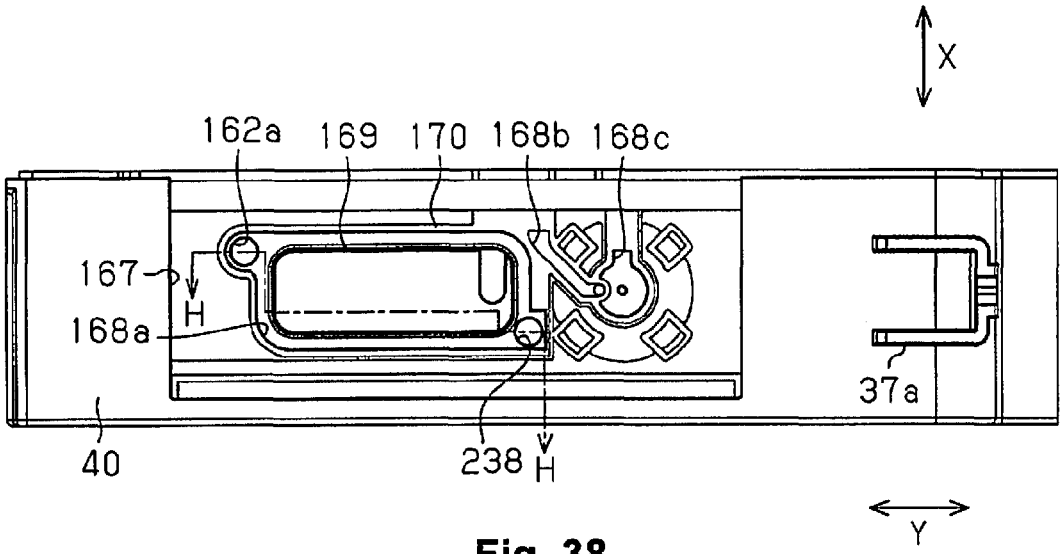
FIG. 38 is a bottom surface diagram of an accommodating body case in the sixth modified example.
Figure 39:
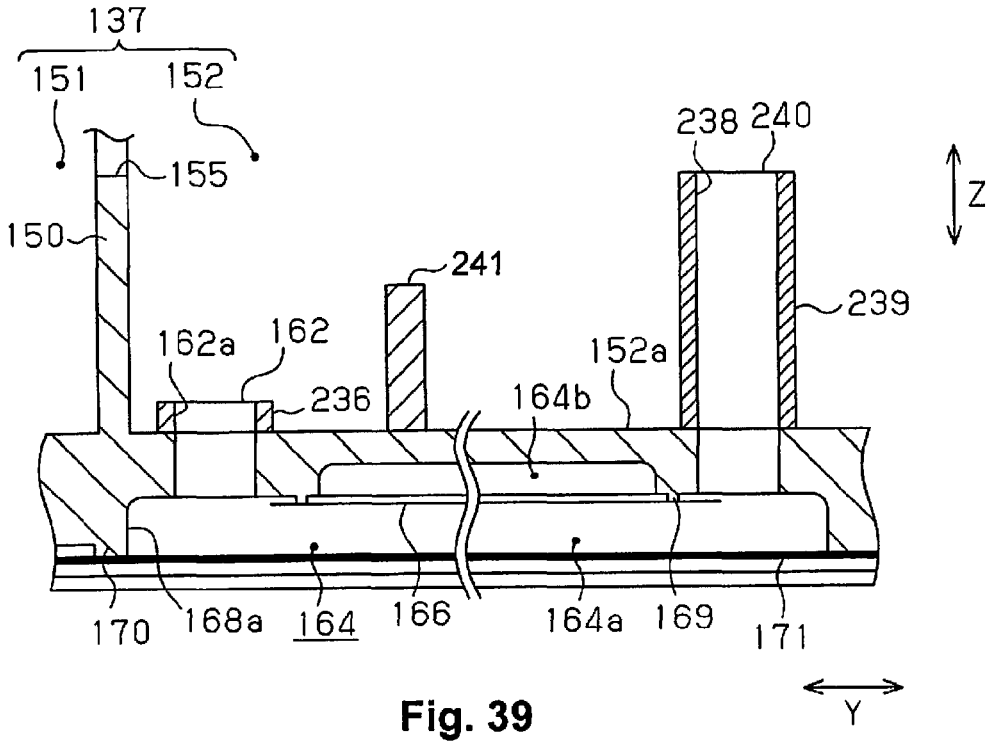
FIG. 39 is a diagram of a cross section viewed along an arrow line H-H in FIG. 38.

In each of the embodiments described above, two or more (two in FIG. 38) of a first through hole 162*a* and a second through hole 238 which link the second ink chamber 152 may be formed as an example of a liquid accommodating chamber in the first flow path forming concave section 168*a* as shown in FIG. 38 and FIG. 39 (a sixth modified example). That is, the through holes 162*a* and 238 are formed in the bottom surface 152*a* such that one end of each is opened into the second ink chamber 152, and the other ends are opened into the first coupling flow path section 164*a* as an example of a flow path more to the second ink chamber 152 side in the direction in which ink flows than the filter 166. Accordingly, the first through hole 162*a* and the second through hole 238 are each communicated with the first coupling flow path section 164*a*, and the second ink chamber 152 and the first coupling flow path section 164*a* are communicated. Here, the first through hole 162*a* is formed at a position which is closer to the inlet port 73 in the ink flow direction than the second through hole 238.

As shown in FIG. 38, the through holes 162*a* and 238 are formed so as to interpose the filter 166 in the front and back direction Y which intersects with (to be orthogonal with in FIG. 38) the direction of gravity. Here, it is preferable that the through holes 162*a* and 238 be formed to be separated from each other at positions which are diagonal to the first flow path forming concave section 168*a* with a substantially rectangular shape in a bottom surface view. In addition, the through holes 162*a* and 238 may be formed so as to interpose the filter 166 in the left and right direction X.

In addition, as shown in FIG. 39, it is preferable that a second cylindrical section 239 which is an example of a tubular section where the second through hole 238 is formed be provided in the bottom surface 152*a* of the second ink chamber 152 along the up and down direction Z which intersects with (is orthogonal with in FIG. 38) the horizontal direction. Then, it is preferable that the height of the second cylindrical section 239 in the up and down direction Z where the second through hole 238 is formed be higher than the first cylindrical section 236 where the first through hole 162*a* is formed or the first through hole 162*a* and that the opening section 240 on the upper side of the second cylindrical section 239 be positioned above the flow path opening 162 or the second through hole 162*a*.

Furthermore, as shown in FIG. 39, it is preferable that a protrusion section 241 which protrudes upward from the bottom surface 152*a* be provided at a position between the first through hole 162*a* and the second through hole 238. Here, the protrusion section 241 is formed to extend along the left and right direction X, and the height in the up and down direction Z is higher than the height of the first cylindrical section 236 and lower than the height of the second cylindrical section 239. In addition, it is preferable that the inner diameter of the second through hole 238 or the opening section 240 be 6 mm or more in a case where the density of the ink is 1.05 g/cm$^3$ and the surface tension is 27.6 mN/m.

Then, it is preferable that the opening on the first coupling flow path section 164*a* side of the first through hole 162*a* and the opening on the first coupling flow path section 164*a* side of the second through hole 238 be positioned at the same height as the filter 166 or above the filter 166 (on the direction against gravity side). That is, as shown in FIG. 39, in a case where the filter 166 is positioned above the flow path forming film 171, it is preferable that the interval between the flow path forming film 171 and the through holes 162*a* and 238 be large compared to the interval between the flow path forming film 171 and the filter 166. Here, the through holes 162*a* and 238 may be formed such that the positions of the openings on the first flow path forming concave section 168*a* side are different to each other in the up and down direction Z.

Here, in an initial state where the ink is not accommodated in the ink chamber 137, the ink chamber 137 and the coupling flow path section 164 are both filled with air. Therefore, in a case where, for example, only one through hole 162*a* is formed in the first flow path forming concave section 168*a*, there are cases where air remains inside the first coupling flow path section 164*a* without passing through the filter 166 and the flow of ink is impaired.

However, in the case of the sixth modified example, it is possible to obtain the following effects.

(58) In a case where ink flows in from one through hole, it is possible to discharge air from the other through hole since the two through holes 162*a* and 238 are formed in the first flow path forming concave section 168*a*. In addition, since the through holes 162*a* and 238 are formed, first, ink which is introduced flows into the inside of the first coupling flow path section 164*a* from the flow path opening 162 which is formed at a low position by passing through the first through hole 162*a*. At this time, air inside the first coupling flow path section 164*a* is expelled to the second ink chamber 152 via the second through hole 238 without ink flowing in from the second through hole 238 where the opening section 240 is positioned above the flow path opening 162. Accordingly, it is possible to reduce the amount of air which remains inside the first coupling flow path section 164*a* and it is possible to reduce the risk that air will be trapped in the filter 166 which is provided in the first coupling flow path section 164*a*.

(59) Since the second cylindrical section 239 is provided, all of the buoyancy of air (bubbles) in the hollow portion of the second cylindrical section 239 is applied in an air discharging direction (the second ink chamber 152 side) and it is possible to discharge air efficiently.

(60) Since the two through holes 162*a* and 238 are formed to be separated from each other to interpose the filter 166, it is possible to discharge air efficiently from the second through hole 238 due to the flow of ink which flows in from the first through hole 162*a* to the first coupling flow path section 164*a*.

(61) It is possible to interrupt the inflow of ink into one of the through holes out of the two through holes 162*a* and 238 using the protrusion section 241. That is, it is possible to create a state where the ink does not flow in from the second through hole 238 to the first coupling flow path section 164*a* regardless of ink flowing in from the first through hole 162*a* to the first coupling flow path section 164*a*. Due to this, it is possible to discharge air efficiently using the pressure difference which is generated between the first through hole 162*a* and the second through hole 238.

(62) Since the heights of the openings on the first coupling flow path section 164*a* side of the first through hole 162*a* and the second through hole 238 are the same as or more than the height where the filter 166 is provided, it is easy for air to move into the through holes 162*a* and 238 which are at positions which are higher than the filter 166. Due to this, it is possible to suppress air from remaining directly below the filter 166.

(63) Since the inner diameters of the second through hole 238 and the opening section 240 are 6 mm or more in a case where the density of the ink is 1.05 g/cm$^3$ and the surface tension is 27.6 mN/m, it is possible to discharge air using buoyancy even in a case where the second through hole 238 or the opening section 240 are blocked by ink.

(64) The heights of the cylindrical sections 236 and 239 may be the same in the up and down direction Z. That is, the flow path opening 162 and the opening section 240 may be formed at the same positions in the up and down direction Z. In addition, the cylindrical sections 236 and 239 need not be formed. Even in this case, first, ink which is introduced flows into the inside of the first coupling flow path section 164*a* by passing through the first through hole 162*a* which is formed at a position which is close to the inlet port 73. At this time, air inside the first coupling flow path section 164*a* is expelled to the second ink chamber 152 via the second through hole 238 without ink flowing in from the second through hole 238 which is positioned at a location which is further separated from the inlet port 73 than the first through hole 162*a*. Accordingly, it is possible to reduce the amount of air which remains inside the first coupling flow path section 164*a*.

(65) After initial filling, ink flows from the first through hole 162*a* and the second through hole 238 to the first coupling flow path section 164*a*. Accordingly, it is possible to increase the ink inflow speed to the first coupling flow path section 164*a*. Furthermore, even in a case where either of the first through hole 162*a* or the second through hole 238 is blocked due to foreign matter or the like, it is possible for the ink to flow in from the other through hole.

Figure 40:
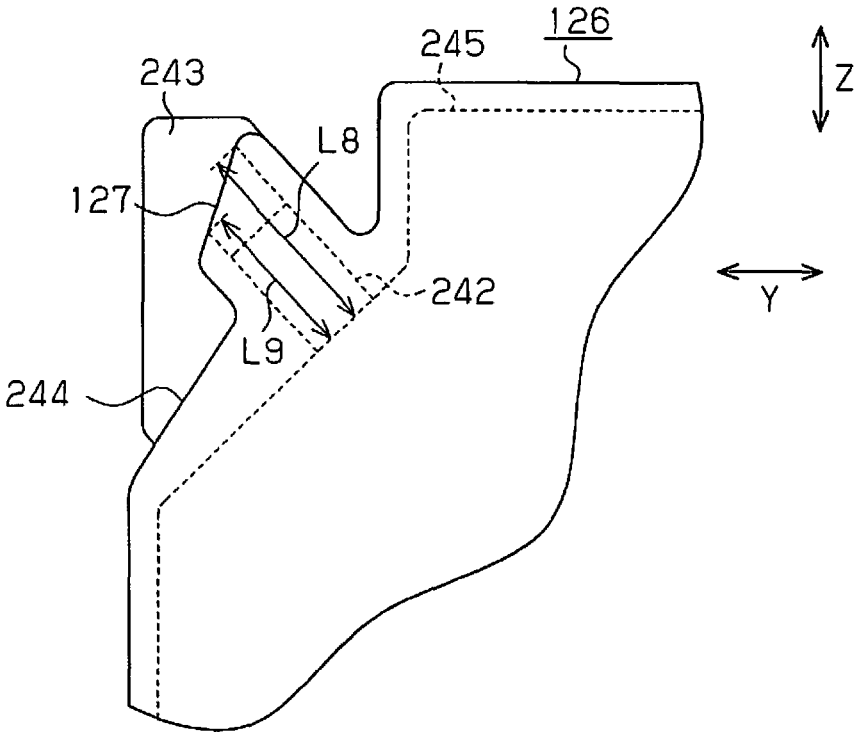
FIG. 40 is a partial side surface diagram illustrating a vicinity of a pouring spout of a liquid introduction source in a seventh modified example.

In each of the embodiments described above, the liquid introduction source 126 may be provided with a ring-shaped member (a spout) 242 which has greater rigidity than the film and which configures the liquid introduction source 126 inside the pouring spout 127 as shown in FIG. 40 (a seventh modified example). Here, the ring-shaped member 242 may be provided so as to interpose the film from outside in a state of being split into two. That is, the film may be stuck to the inner surface of the ring-shaped member 242 and may impart rigidity to the pouring spout 127. In addition, by thickening the film at the portion of the pouring spout 127, rigidity may be imparted compared to other portions.

In each of the embodiments described above, a cutting 244 may be inserted at an arbitrary position in a corner section 243 where the pouring spout 127 of the liquid introduction source 126 is formed as shown in FIG. 40. For example, in a case where the side where the side where pouring spout 127 is formed is the upper side, the cutting 244 may be provided such that a distance L8 from the upper end of the pouring spout 127 to an ink accommodating section 245 is longer than the distance L9 from the lower end to the ink accommodating section 245. That is, by cutting away the corner section 243 along the cutting 244, it is possible for the user to pour out ink which is held in the ink accommodating section 245 from the pouring spout 127. Here, a cut out line may be marked without forming the cut line 244.

Figure 41:
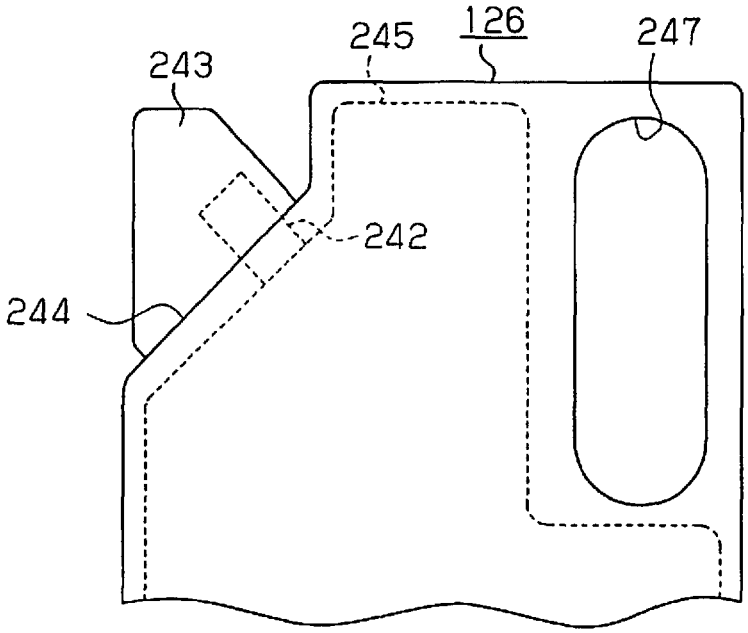
FIG. 41 is a partial side surface diagram illustrating a vicinity of a pouring spout of a liquid introduction source in an eighth modified example.

In each of the embodiments described above, the cutting 244 may be formed in the liquid introduction source 126 so as to intersect with the ring-shaped member 242 as shown in FIG. 41 (an eighth modified example). That is, when the corner section 243 is cut away along the cutting 244 by the user, the ring-shaped member 242 may be exposed to the outside. In addition, a grip section 247 where it is possible for the user to insert a finger or a hand may be formed in the liquid introduction source 126.

Figure 42:
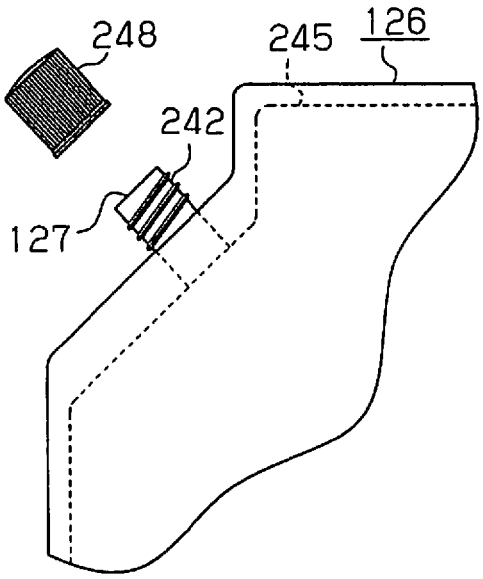
FIG. 42 is a partial side surface diagram illustrating a vicinity of a pouring spout of a liquid introduction source in a ninth modified example.

In each of the embodiments described above, the ring-shaped member 242 may be provided in the liquid introduction source 126 so as to protrude from the film and a screw may be formed in the liquid introduction source 126 in a portion which protrudes from the film as shown in FIG. 42 (a ninth modified example). Then, the pouring spout 127 may be sealed by a cap 248 which is able to be screwed to the ring-shaped member 242.

Figure 43:
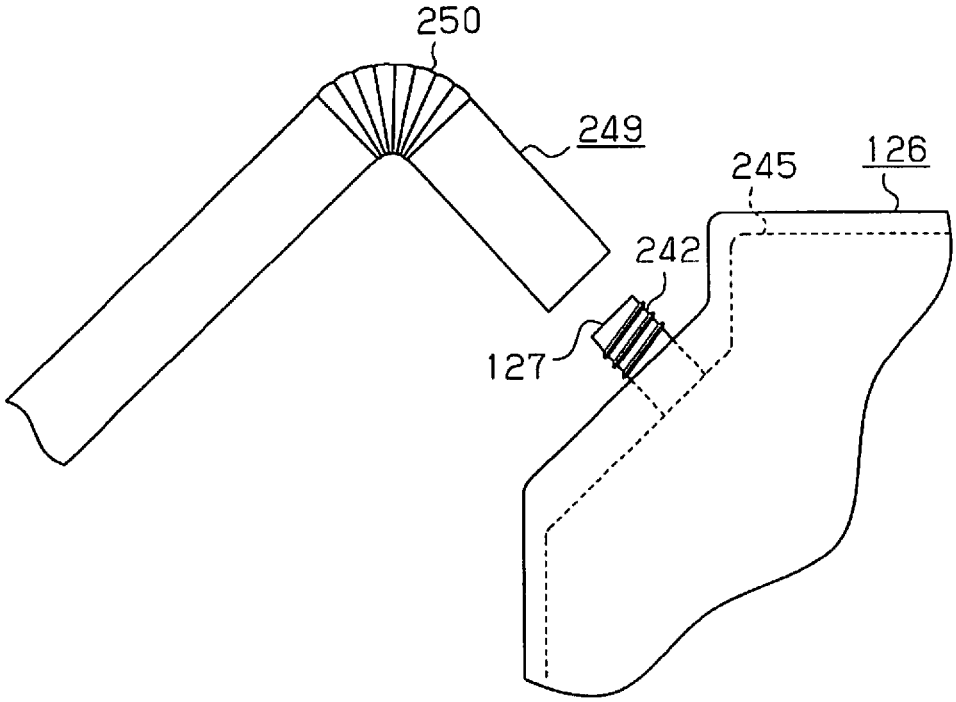
FIG. 43 is a partial side surface diagram illustrating a vicinity of a pouring spout of a liquid introduction source in a tenth modified example.

In the ninth modified example described above, a straw member 249 which is able to be screwed to the ring-shaped member 242 may be provided as shown in FIG. 43 (a tenth modified example). Here, the straw member 249 may be straight, or may be able to bend by having a bellows section 250 as shown in FIG. 43. Furthermore, the bellows section 250 may be formed over the entirety of the straw member 249.

Figure 44:
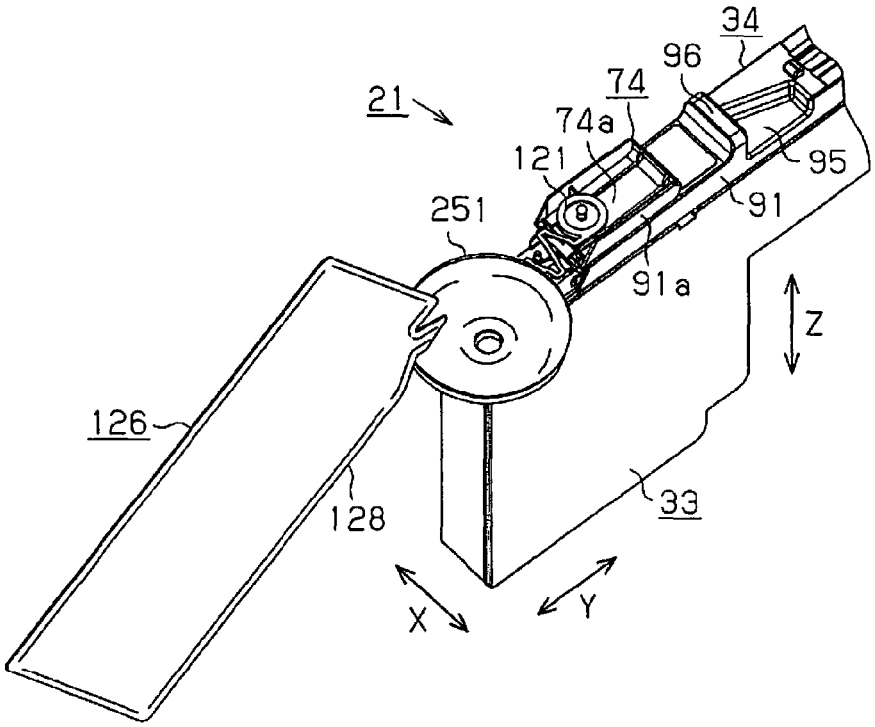
FIG. 44 is a perspective diagram of a liquid introduction source and a liquid accommodating body container in an eleventh modified example.

In each of the embodiments described above, ink may be introduced into the liquid holding container 21 from the liquid introduction source 126 via a funnel member 251 as shown in FIG. 44 (an eleventh modified example).

In each of the embodiments described above, the cut away section 199 may be formed in the funnel member 251.

Figure 45:
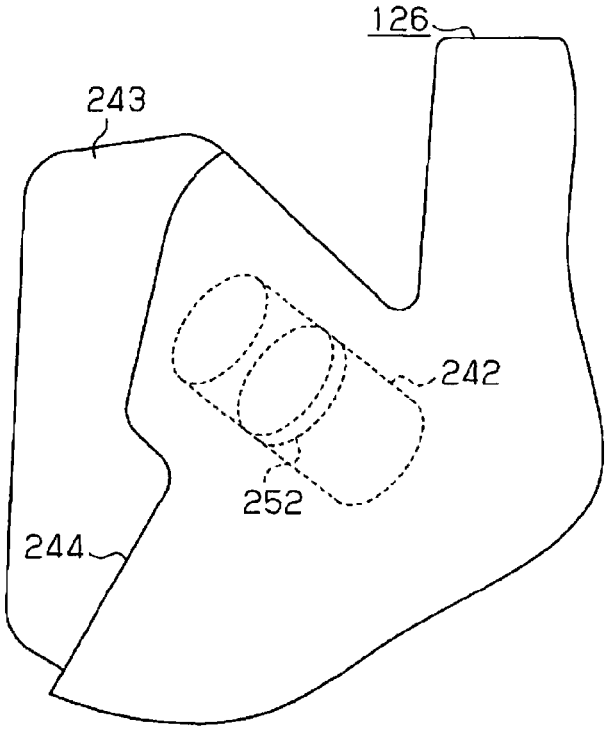
FIG. 45 is a partial perspective diagram illustrating a vicinity of a pouring spout of a liquid introduction source in a twelfth modified example.

In each of the embodiments described above, a filter member 252 may be provided inside the ring-shaped member 242 as shown in FIG. 45 (a twelfth modified example). Here, it is possible for the shape of the filter member 252 to be an arbitrary shape without being limited to a disk shape. For example, the filter member 252 may have a columnar shape or a conical shape. In addition, in a case where the opening shape of the ring-shaped member 242 is a polygon such as a triangle or a rectangle instead of a circle, the shape of the filter member 252 may be set to a polygonal shape to match with the shape of the ring-shaped member 242. In addition, two or more of the filter members 252 may be provided and the filter members 252 may be provided in the funnel member 251.

In the second embodiment described above, the reinforcing member 212 may be a size which is able to press the entire surface of the film 133. In addition, the reinforcing member 212 may be an arbitrary size in the front and back direction Y and the up and down direction Z and may be a square shape in a side surface view. Furthermore, two or more of the reinforcing members 212 may be provided and it is possible to provide the reinforcing members 212 at arbitrary positions. For example, the reinforcing member may be provided at a position which is the opposite side to the lower end section 132*a* or the upper end section 132*b* in the film 133 or a position which is the opposite side to the second ink chamber 152 side in the film 133. Furthermore, the reinforcing member 212 may be provided at a position, which is the opposite side to the intersecting rib sections 157*a* to 157*i* or the third diagonal rib section 158*c* and the fourth diagonal rib section 158*d*, in the film 133. Here, in this case, the intersecting rib sections 157*a* to 157*i*, the third diagonal rib section 158*c*, and the fourth diagonal rib section 158*d* function as an example of adhesion rib sections.

In the second embodiment described above, the reinforcing member 212 may be provided on the outside of the cover 210. In addition, the reinforcing member 212 may be fixed by being adhered, screwed, or the like to the film 133 or the cover 210.

In the second embodiment described above, the reinforcing member 212 may be a rod. In addition, the film 133 may be pressed by winding tape or a cord around the accommodating body case 130.

In the second embodiment described above, the reinforcing ridges 211 need not be formed in the cover 210. In addition, it is possible to arbitrarily change the direction in which the reinforcing ridges 211 extend, the size of the reinforcing ridges 211, and the positions where the reinforcing ridges 211 are formed.

In each of the embodiments described above, there may be a configuration where the covers 134 and 210 are not provided.

In each of the embodiments described above, there may be a configuration where the inlet port 73 is not provided.

In each of the embodiments described above, the chip holder 76 may be provided in the slider 34 by being inserted from a direction along the sliding direction of the slider 34 with regard to the liquid accommodating body 33 of the slider 34, that is, from the direction along the longitudinal direction with regard to the slider 34. In addition, the recording chip 75 which is attached to the chip holder 76 may be placed in the chip holder 76 in, for example, a state of being parallel with the sliding direction or a state of being orthogonal to the sliding direction and not in a state of always being inclined with regard to the sliding direction of the slider 34.

In each of the embodiments described above, the groove shaped section 107 which is an example of a position aligning shape section which is positionally aligned inside the printer 11 when the moving part of the slider 34 is moved inside the printer 11 need not always be provided in the chip holder 76. For example, a position aligning shape section is not necessary in a case where the slider 34 is inserted in the mounting section 31 in a state of being positionally aligned with regard to the communication section 77.

In each of the embodiments described above, an engaging section (the groove section 112) with the opening and closing cover 74 need not always be provided in the slider 34. For example, the engagement section is not necessary in a case where the bearing section 90 of the opening and closing cover 74 is configured to engage with the rotation shaft 89 of the slider 34 in an interference fitted state since the rotation load is obtained due to interference fitting.

In each of the embodiments described above, the opening and closing cover 74 need not always be configured to rotate with the axis which extends along the lateral direction of the liquid accommodating body 33 as the center of rotation. For example, the opening and closing cover 74 may also be configured to be displaced from the closed lid position to the open lid position by being moved in parallel in the longitudinal direction with regard to the slider 34.

In each of the embodiments described above, the opening and closing cover 74 need not always be provided in the slider 34 which is provided in the state of covering the inlet port 73. In this case, it is sufficient if the inlet port 73 of ink is exposed by the slider 34 being taken out from the printer 11 (the mounting section 31).

In each of the embodiments described above, the inlet port 73 need not always be provided on the upper surface 39 which is on the direction against gravity side in the liquid accommodating body 33. For example, the inlet port 73 may be provided on the side surface which is positioned on the horizontal direction side. In addition, the slider 34 need not always be provided in a state which covers the inlet port 73. In this case, there may be a configuration where the inlet port 73 is covered with a different member to the slider 34.

In each of the embodiments described above, the chip holder 76 is not necessarily limited to a configuration of being attached to the holder attachment section 86 of the slider 34. For example, there may be a configuration where the chip holder 76 is formed integrally with a portion of the slider 34.

In each of the embodiments described above, the medium is not limited to the paper S and may be a plate shaped member formed of a material such as a metal plate, a resin plate, or cloth. That is, it is possible to adopt any member, where recording (printing) is possible using liquid which is ejected by the liquid ejecting head 24, as the medium.

In each of the embodiments described above, the liquid consuming apparatus is not limited to the printer 11 which is a serial printer where the liquid ejecting head 24 is moved back and forth along with the carriage 25, and may be a line head printer where printing is possible over the range of the widest range of the paper while the liquid ejecting head 24 is fixed.

In each of the embodiments described above, it is sufficient if the covering member 121 is provided with at least the covering body 120.

In each of the embodiments described above, an absorbing material which is able to absorb ink may be arranged at the rear surface 74*a* of the opening and closing cover 74.

In each of the embodiments described above, the coupling section 125 need not have a shape which is folded a plurality of times on the liquid receiving surface 116. For example, the coupling section 125 may be formed in an L shape in a plan view by being curved only one time in a portion of the coupling section 125. In addition, the coupling section 125 may be formed by a chain made of metal or the like and placed on the liquid receiving surface 116.

In each of the embodiments described above, when the opening and closing cover 74 is positioned at the open lid position, the rear surface 74*a* of the opening and closing cover 74 need not have a surface with downward gradient toward the inlet port 73. In this case, it is desirable to arrange the ink absorbing material described above at the rear surface 74*a* of the opening and closing cover 74 in a portion where the covering body 120 is placed.

In each of the embodiments described above, the covering body 120 of the covering member 121 need not be placed at the rear surface 74*a* of the opening and closing cover 74.

In each of the embodiments described above, the cut away groove 118 may be provided at a circumference edge position of the inlet port 73 excluding the circumference wall section 117. For example, the cut away groove 118 may be formed on the opening edge 73*a* of the inlet port 73. In addition, instead of the cut away groove 118 as the concave section, a convex section which protrudes upward from the circumference wall section 117 may be provided. Here, in this case, it is desirable that two of the convex sections be provided such that it is possible to positionally align the liquid introduction source 126 from both sides.

In each of the embodiments described above, the area of the wall communicating opening 155 may be the same size as the area of the inlet port 73. In addition, the area of the wall communicating opening 155 may be larger than the area of the inlet port 73.

In each of the embodiments described above, there may be a configuration where the filter 166 is not provided. In addition, the filter 166 may be provided inside the second ink chamber 152 so as to cover the flow path opening 162.

In each of the embodiments described above, there may be a configuration where the float valve 131 is not provided.

In each of the embodiments described above, there may be a configuration where the diagonal rib sections 158*a* to 158*d* are not provided. In addition, there may be a configuration where the diagonal rib sections 158*a* to 158*d* are provided individually, and it is possible to arbitrarily select whether each of the diagonal rib sections 158*a* to 158*d* are provided. For example, there may be a configuration where only one of the diagonal rib sections out of any of the diagonal rib sections 158*a* to 158*d* is provided. In addition, for example, there may be a configuration where any two of the diagonal rib sections are provided such as the third diagonal rib section 158*c* and the fourth diagonal rib section 158*d* or any three diagonal rib sections are provided such as the first to third diagonal rib sections 158*a* to 158*c*.

In each of the embodiments described above, the diagonal rib sections 158*a* to 158*d* need not extend only along one direction and may be partially curved or bent. That is, for example, the diagonal rib sections 158*a* to 158*d* may have both of a portion which extends along the direction of gravity and a portion which intersects with the direction of gravity.

In each of the embodiments described above, the third diagonal rib section 158*c* and the fourth diagonal rib section 158*d* need not be line symmetric. That is, for example, the third diagonal rib section 158*c* and the fourth diagonal rib section 158*d* may be formed to be shifted once in the up and down direction Z. In addition, as long as the axis which is the reference for the line symmetry of the third diagonal rib section 158*c* and the fourth diagonal rib section 158*d* is along the direction of gravity, the axis may pass through the float valve 131 at any position. Then, portions of the third diagonal rib section 158*c* and the fourth diagonal rib section 158*d* may be line symmetric with the axis as a reference.

In each of the embodiments described above, the diagonal rib sections 158*a* to 158*d* may be formed so as to extend along the front and back direction Y. In addition, the diagonal rib sections 158*a* to 158*d* may be formed so as to extend in the direction which intersects with regard to the left and right direction X.

In each of the embodiments described above, the diagonal rib sections 158*a* to 158*d* may be provided at positions which are shifted from the flow path opening 162 in the up and down direction Z.

In each of the embodiments described above, the flow path opening 162 may be formed at a position other than the bottom surface 152*a*. For example, a flow path opening may be formed in the side wall 130*b*. In addition, the flow path opening 162 may be formed at a position which is separated from the partition wall 150. That is, the distance L1 may be longer than the distance L2.

In each of the embodiments described above, there may be a configuration where the concave section 154 is not provided in the bottom surface 153. In addition, the concave section 154 may be formed so as be a recess toward the direction which intersects with the direction of gravity. Furthermore, the concave section 154 may be formed so as to coincide with the introduction virtual line M. That is, the concave section 154 may be formed at a position on the direction of gravity side of the inlet port 73. Here, the concave section 154 and the inlet port 73 have different shapes in the upper surface view and the size of the concave section 154 in the left and right direction X is larger than the inlet port 73. As a result, even when the concave section 154 is formed at a position on the direction of gravity side of the inlet port 73, a portion of the concave section 154 is positioned at a position which is shifted from the inlet port 73 in the direction which intersects with the direction of gravity. Therefore, the concave section 154 may be formed to be smaller than the inlet port 73 in the upper surface view, or the inlet port 73 and the concave section 154 may be formed with the same shape.

In each of the embodiments described above, the liquid holding container 21 may have a configuration where the slider 34 is not provided. That is, the liquid holding container 21 may be configured only with the liquid accommodating body 33.

In each of the embodiments described above, the partition wall 150 may be provided so as to intersect with the up and down direction Z.

In each of the embodiments described above, the accommodating body case 130 may have a configuration where the intersecting rib sections 157*a* to 157*i* are not provided.

In each of the embodiments described above, the accommodating body case 130 may have a configuration where the partition wall 150 is not provided.

In each of the embodiments described above, the upper surface 155*c* of the wall communicating opening 155 may be formed along the horizontal direction.

In each of the embodiments described above, the cross sectional area of the inclined flow path section 165 may be the same size as the cross sectional area of the coupling flow path section 164. In addition, the cross sectional area of the inclined flow path section 165 may be larger than the cross sectional area of the curved flow path section 163. In addition, the cross sectional area of the inclined flow path section 165 may be smaller than the cross sectional area of the coupling flow path section 164 and the cross sectional area of the curved flow path section 163.

In each of the embodiments described above, the inclined flow path section 165 may be provided at a position which is shifted from the lower side position of the ink chamber 137 in the direction of gravity. That is, for example, the inclined flow path section 165 may be provided so as to be adjacent to the ink chamber 137 via the side wall 130*b*.

In each of the embodiments described above, the valve body 182 which is fixed on the bottom surface 152*a* of the second ink chamber 152 may be omitted and the pushing section 189 which protrudes vertically downward from the lower surface of the float member 181 may fulfill a function as a valve body which is able to block the valve port 192 when moving down.

In each of the embodiments described above, the plate shaped section 191 which functions as an example of a regulating abutting section with regard to the regulating case 183 in the float member 181 may have a cross sectional shape other than a cross shape. In short, as long as there is a relationship where the interval distance between the part which configures the regulating abutting section and the inner surface of the cylindrical section 198 is smaller than the interval distance between the thin film member 186 and the inner surface of the ring-shaped wall section 196, it is possible to arbitrarily change the shape of the plate shaped section 191.

In each of the embodiments described above, the shape of the hole 202 in the regulating case 183 may have a circular shape, a triangular shape, or a cut away shape without being limited to a rectangular shape. In short, as long as the hole 202 has a shape which permits the passage of ink in a case where the float member 181 floats, it is possible to arbitrarily change the shape of the hole 202.

In each of the embodiments described above, the cut away section 199 which is formed in the side wall 196*a* along the front and back direction Y of the regulating case 183 may be omitted. Alternatively, the cut away section 199 may be formed in the side wall 196*b* along the left and right direction X. Also in this case, the cut away section 199 permits the flow of ink by passing through the inside and outside of the regulating case 183 and is also able to fulfil a function of reducing the risk of the float member 181 sliding when floating.

In each of the embodiments described above, the coil spring 195 which has the second pressing force which presses the valve body 182 toward the upper open valve position may be omitted.

In each of the embodiments described above, it is sufficient if there is at least one of the gas chambers 187 in the float member 181. That is, the number of the gas chambers 187 is not necessarily limited to four, and may be at least one or more such as two, three, or five.

In each of the embodiments described above, the partition wall 150 which partitions the ink chamber 137 into the first ink chamber 151 and the second ink chamber 152 may be omitted. That is, there may be a configuration where there is only one of the ink chambers 137 in the liquid accommodating body 33 and the float valve 131 is arranged inside the one ink chamber 137.

In each of the embodiments described above, the shape of the regulating case 183 is not limited to a box shape, and it is possible to arbitrarily change the shape of the regulating case 183 as long as the shape has the ring-shaped wall section 196 which surrounds the float member 181 so as to protect the float member 181 with regard to the inflow pressure of ink which flows into the inside of the second ink chamber 152.

In each of the embodiments described above, the regulating member need not have a box shape such as the regulating case 183 and may have a frame shape. In short, it is possible to arbitrarily change the shape of the regulating member as long as the shape has a structure of regulating by abutting so as to stop the upward floating at a position which is lower than the ceiling of the ink chamber 137 in a case where the float member 181 floats upward according to rising of the ink liquid surface.

In each of the embodiments described above, the thin film member 186 which forms the gas chambers 187 by blocking the opening section 185*a* of the float member 181 may be a thin sheet, plate, or the like made of resin other than a film.

In each of the embodiments described above, the posture state during use of the liquid holding container 21 may be a state where the liquid holding container 21 is used by connecting a tube so as to be able to supply liquid in a state of being placed to the side of the printer 11 rather than a state where the liquid holding container 21 is fixed to be not able to move with regard to the printer 11 by being mounted onto the mounting section 31 of the printer 11.

In each of the embodiments described above, the liquid holding container and the liquid introduction source were described, but it is possible to realize both in a liquid container.

In each of the embodiments described above, the liquid consuming apparatus may be a liquid ejecting apparatus which ejects or discharges a liquid other than ink. Here, the state of the liquid which is discharged from the liquid ejecting apparatus as liquid droplets of minute amounts includes granular shapes, tear shapes, and thread shapes which have a tail. In addition, here, it is sufficient if the liquid is a material which is able to be ejected from the liquid ejecting apparatus. For example, it is sufficient if the liquid is a liquid in a state where the substance is in a liquid phase, and the liquid includes a fluid material such as high or low viscosity liquid bodies, sols, gels, gel water, other inorganic solvents, organic solvents, solutions, liquid resins, liquid metals (metal melts). In addition, in addition to liquids where the substance is in one state, liquids where particles of a functional material which is formed from a solid material such as pigments or metal particles are dissolved, dispersed, or mixed or the like are also included. Representative examples of the liquid include the inks, liquid crystals, and the like which are described in the embodiments described above. Here, the inks encompass various types of liquid compositions such as typical aqueous inks, oil-based inks, gel inks, and hot melt inks. Specific examples of the liquid ejecting apparatus include liquid ejecting apparatuses which eject liquids which include materials in a dispersed or dissolved form such as electrode materials, coloring materials, or the like which are used in the manufacturing or the like of, for example, liquid crystal displays, EL (electroluminescent) displays, surface-emitting displays, and color filters. In addition, the liquid ejecting apparatus may be a liquid ejecting apparatus which ejects biological organic matter which is used in biochip manufacturing, a liquid ejecting apparatus which is used as a precision pipette to eject liquid which is a sample, a textile printing apparatus, a micro-dispenser, or the like. Furthermore, the liquid ejecting apparatus may be a liquid ejecting apparatus which ejects lubricant in a pin point manner into precision machines such as watches or cameras, or a liquid ejecting apparatus which ejects a transparent resin liquid such as ultraviolet curable resin onto a substrate in order to form a minute hemispherical lens (an optical lens) or the like which is used in optical communication elements or the like. In addition, the liquid ejecting apparatus may be a liquid ejecting apparatus which ejects an etchant such as an acid, an alkali, or the like in order to etch the substrate or the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid holding container comprising:

an accommodating body case configured to be coupled to a liquid consuming apparatus to supply liquid to the liquid consuming apparatus;

a liquid accommodating chamber disposed in the accommodating body case and configured and arranged to hold the liquid;

a flow path disposed in the accommodating body case;

a wall member disposed in the accommodating body case and partitioning the flow path from the liquid accommodating chamber with the wall member defining a first through hole and a second through hole so that the flow path is communicated with the liquid accommodating chamber via the first through hole and the second through hole; and a filter disposed in the flow path, the filter being disposed between the first through hole and the second through hole with respect to a direction intersecting with a direction of gravity, the wall member being disposed between the liquid accommodating chamber and the filter with respect to the direction of gravity, and each of the first through hole and the second through hole having an upper opening which opens to the liquid accommodating chamber and a lower opening which opens to the flow path.

2. The liquid holding container according to claim 1, wherein the second through hole is disposed in a tubular section provided along a direction intersecting with a horizontal direction.

3. The liquid holding container according to claim 1, wherein the first through hole and the second through hole are disposed closer to the liquid accommodating chamber than the filter with respect to a direction in which the liquid flows, with the filter being disposed between the first through hole and the second through hole with respect to a direction intersecting with a direction of gravity.

4. The liquid holding container according to claim 1, wherein the first through hole and the second through hole are formed on a bottom surface of the liquid accommodating chamber, and the liquid accommodating chamber includes a protrusion section protruding from the bottom surface between the first through hole and the second through hole.

5. The liquid holding container according to claim 1, wherein an opening of each the first through hole and the second through hole on a side of the flow path is positioned at the same position as the filter with respect to a direction of gravity or positioned toward a direction against gravity than the filter.

6. The liquid holding container according to claim 1, wherein an inner diameter of the second through hole is 6 mm or more in a case where a density of the liquid is 1.05 $g/cm^3$ and a surface tension of the liquid is 27.6 mN/m.

7. The liquid holding container according to claim 1, further comprising:

an inlet port through which the liquid is introduced into the liquid accommodating chamber, wherein the first through hole is formed at a position closer to the inlet port than the second through hole in a direction in which the liquid flows.

8. The liquid holding container according to claim 1, wherein the first through hole and the second through hole are formed on a bottom surface of the liquid accommodating chamber in a direction along the direction of gravity.

9. The liquid holding container according to claim 1, wherein the first through hole and the second through hole are at the same height in a direction along the direction of gravity.

10. The liquid holding container according to claim 1, wherein at least a part of the flow path is formed of a film opposite the wall member with respect to the direction of gravity.

11. The liquid holding container according to claim 10, wherein the filter is disposed opposite the film with respect to the direction of gravity.

* * * * *